US010603901B2

(12) United States Patent
Shinkawa et al.

(10) Patent No.: US 10,603,901 B2
(45) Date of Patent: Mar. 31, 2020

(54) LIQUID DISCHARGING APPARATUS

(71) Applicant: SEIKO EPSON CORPORATION, Tokyo (JP)

(72) Inventors: Osamu Shinkawa, Nagano (JP); Yasuhiro Hosokawa, Nagano (JP); Noriaki Saito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/285,272

(22) Filed: Feb. 26, 2019

(65) Prior Publication Data

US 2019/0263112 A1 Aug. 29, 2019

(30) Foreign Application Priority Data

Feb. 28, 2018 (JP) ..... 2018-035274

(51) Int. Cl.
*B41J 2/045* (2006.01)
*B41J 2/165* (2006.01)

(52) U.S. Cl.
CPC ..... *B41J 2/0451* (2013.01); *B41J 2/04581* (2013.01); *B41J 2/04588* (2013.01); *B41J 2/16579* (2013.01)

(58) Field of Classification Search
CPC .. B41J 2/0451; B41J 2/04581; B41J 2/04588; B41J 2/16579
See application file for complete search history.

(56) References Cited

U.S. PATENT DOCUMENTS

| | | | | |
|---|---|---|---|---|
| 9,090,059 | B1 | 7/2015 | Sayama et al. | |
| 9,227,397 | B2 * | 1/2016 | Yamamoto | B41J 2/04541 |
| 2008/0088657 | A1 | 4/2008 | Shinkawa et al. | |
| 2012/0306954 | A1 * | 12/2012 | Nishikawa | B41J 2/04516 347/11 |
| 2015/0138265 | A1 * | 5/2015 | Ito | B41J 2/04581 347/10 |

FOREIGN PATENT DOCUMENTS

| | | |
|---|---|---|
| JP | 2004-314457 A | 11/2004 |
| JP | 2015-168146 A | 9/2015 |

* cited by examiner

*Primary Examiner* — Lamson D Nguyen
(74) *Attorney, Agent, or Firm* — Global IP Counselors, LLP

(57) ABSTRACT

A printer as an example of a liquid discharging apparatus includes a nozzle, a drive signal generation unit that generates a drive signal for driving a piezoelectric element, and a discharge abnormality detection unit that detects a change of an electromotive force of the piezoelectric element, which is caused by residual vibration in a cavity after the drive signal is supplied. The drive signal generation unit generates a first drive signal for checking whether or not a first discharge abnormality caused by a foreign substance adhering to a surface on which the nozzle opens occurs and a second drive signal for checking whether or not a second discharge abnormality caused by a cause other than the foreign substance occurs. The potential change for detecting the first drive signal is greater than the potential change for detecting the second drive signal.

15 Claims, 24 Drawing Sheets

| SI [m] (b1, b2, b3) | Tc1 | | | Tc2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

LIQUID DISCHARGING APPARATUS

The entire disclosure of Japanese Patent Application No2018-035274, filed Feb. 28, 2018 is expressly incorporated by reference herein.

BACKGROUND

1. Technical Field

The present invention relates to a liquid discharging apparatus which includes nozzles configured to discharge liquid and has a check function to check whether or not a discharge abnormality in that it is not possible to normally discharge liquid from the nozzles occurs.

2. Related Art

In the related art, an ink jet type printer that prints a document, an image, or the like on a medium such as paper by discharging inks (as an example of liquid) from a plurality of nozzles provided in a discharge head is known as this type of liquid discharging apparatus. In such a printer, a discharge abnormality may occur. The discharge abnormality refers to a situation in which it is not possible to normally discharge droplets from nozzles by, for example, clogging in which the nozzles of a discharge head become clogged with the thickened or dried ink, or bubbles in an ink in a pressure chamber communicating with the nozzles. In a case where foreign substances such as paper dust adhere to the vicinity of the nozzle of the discharge head, a discharge abnormality such as flying curve in which droplets discharged from the nozzles are brought into contact with the foreign substances so as to bend the flying pathways of the droplets may also occur.

JP-A-2004-314457 discloses a liquid discharging apparatus including a discharge abnormality check unit capable of checking this type of discharge abnormality. In the liquid discharging apparatus, whether or not foreign substances such as paper dust are adhering is detected based on information of a residual vibration of liquid in a pressure chamber just after a piezoelectric element to which a drive signal has been applied drives. In the technology, a discharge abnormality caused by foreign substances such as paper dust adhere to the vicinity of the nozzle and a discharge abnormality caused by other factors for example clogging and mixing of bubbles are checked based on measurement results obtained in a manner as follows. That is, a drive signal having the same check waveform is applied to the piezoelectric element. While liquid in the nozzles is vibrated, the change of a residual vibration just after driving by this application is measured, and thereby the measurement results are obtained.

JP-A-2015-168146 discloses a technology of adjusting the meniscus position (liquid level position) of liquid in nozzles in consideration of the entrance of fuzz and the like of paper into nozzle openings. In the technology, the meniscus position of liquid in the nozzles is controlled so as to avoid an occurrence of problems such as discharge abnormalities which may occur by fuzz and the like of paper touching the liquid in the nozzles in a printing operation.

However, in the liquid discharging apparatus disclosed in JP-A-2004-314457 and JP-A-2015-168146, in a case where an adhering situation in which foreign substances such as paper dust adhere to a head surface (on which the nozzle of the discharge head opens) in the vicinity of the nozzle, and some of the adhering foreign substances floats from the head surface so as to be positioned with spaced from the nozzle in a discharge direction occurs, this situation may not be detected as a discharge abnormality. That is, there is a problem in that, even though the foreign substances as the cause of the occurrence of the discharge abnormality adhere, detecting this case as the discharge abnormality has difficulty because a difference of the change of the residual vibration is smaller than that in the normal time.

SUMMARY

An advantage of some aspects of the invention is to provide a liquid discharging apparatus capable of improving check accuracy for checking whether or not a discharge abnormality of liquid by foreign substances adhering to a surface on which a nozzle opens occurs.

Hereinafter, means of the invention and operation effects thereof will be described.

According to an aspect of the invention, a liquid discharging apparatus includes a nozzle that discharges liquid by driving a piezoelectric element, a drive signal generation unit that generates a drive signal for driving the piezoelectric element, and a residual vibration detection unit that detects a change of an electromotive force of the piezoelectric element, which is caused by a residual vibration in a pressure chamber communicating with the nozzle after the drive signal is supplied. The drive signal generation unit generates a first drive signal for checking whether or not a first discharge abnormality caused by a foreign substance adhering to a surface on which the nozzle opens occurs and a second drive signal for checking whether or not a second discharge abnormality caused by a cause other than the foreign substance occurs. A potential change for detecting the first drive signal is greater than a potential change for detecting the second drive signal.

According to this configuration, the potential change for detecting the first drive signal for checking whether or not the first discharge abnormality caused by the foreign substance (such as paper dust) adhering to the surface on which the nozzle opens occurs is greater than the potential change for detecting the second drive signal for checking whether or not the second discharge abnormality caused by the cause other than the foreign substance occurs. Thus, the amplitude of the liquid in the nozzle by the residual vibration in the pressure chamber when the first drive signal is supplied to the piezoelectric element is greater than the amplitude of the liquid in the nozzle by the residual vibration in the pressure chamber when the second drive signal is supplied to the piezoelectric element. Accordingly, an abnormal time being in a state where the foreign substance adhering to the surface on which the nozzle opens has been in contact with the liquid in the nozzle and a normal time in which the foreign substance is not provided have a significant difference of a liquid level position in the nozzle in a residual vibration period. The significant difference in the liquid level position is shown as a significant difference of the change of the residual vibration. Thus, the residual vibration detection unit detects the difference of the change of the residual vibration, and thereby it is possible to check whether or not the first discharge abnormality caused by adhering of the foreign substance occurs, with high accuracy.

In the liquid discharging apparatus, preferably, the first drive signal and the second drive signal have the same mode, the mode being for defining discharge or non-discharge.

According to this configuration, when checking is performed by discharging liquid in order to secure high check accuracy, both the first drive signal and the second drive signal are in a discharge mode in which the potential change allowing discharging of the liquid is provided. When checking is performed in a non-discharge state in which liquid is not discharged, for example, in order to save the consumption of the liquid or because of being in the process of printing, both the first drive signal and the second drive signal are in a non-discharge mode in which the potential change which does not cause discharge of the liquid is provided. It is possible to perform checking (first checking) of whether or not the first discharge abnormality caused by adhering of the foreign substance occurs and checking (second checking) of whether or not the second discharge abnormality caused by the cause other than the foreign substance occurs, even in any case of discharge and non-discharge depending on the situation or needs at time of checking.

In the liquid discharging apparatus, preferably, the first drive signal and the second drive signal have a first potential in a first period, a second potential in a second period, and a third potential in a third period, and the first drive signal and the second drive signal transition from the first potential to the second potential and transition from the second potential to the third potential.

According to this configuration, the potentials of the first drive signal and the second drive signal transition in an order of the first potential, the second potential, and the third potential. At least one of the potential difference in the process of transitioning from the first potential to the second potential and the potential difference in the process of transitioning from the second potential to the third potential in the first drive signal is greater than that in the second drive signal. Accordingly, it is possible to check whether or not the first discharge abnormality caused by adhering of the foreign substance occurs, with high accuracy.

In the liquid discharging apparatus, preferably, a potential difference between the second potential and the third potential in the first drive signal is greater than a potential difference between the second potential and the third potential in the second drive signal.

According to this configuration, the amount (potential difference) of changing the potential when the first drive signal supplied to the piezoelectric element when checking for a discharge abnormality caused by adhering a foreign substance is performed transitions from the second potential to the third potential is greater than the amount (potential difference) of changing the potential when the second drive signal supplied to the piezoelectric element when checking for a discharge abnormality caused by the cause other than the foreign substance is performed transitions from the second potential to the third potential. Therefore, it is possible to draw the liquid in the pressure chamber, which has been pushed in the discharge direction by deformation of the piezoelectric element when a transition from the first potential to the second potential is performed, toward an opposite side of the discharge direction at large pressure. Thus, the amplitude of the liquid in the nozzle by a residual vibration increases. Accordingly, a significant difference in a liquid level position in the nozzle in a residual vibration period after the liquid in the pressure chamber has been drawn occurs between an abnormal time being in a state where the adhering foreign substance is in contact with the liquid in the nozzle, a normal time in which the foreign substance does not adhere. The difference in the liquid level position is shown as a difference of the change of the residual vibration. Thus, the residual vibration detection unit detects the difference of the change of the residual vibration, and thereby it is possible to check whether or not the first discharge abnormality caused by adhering of the foreign substance occurs, with high accuracy.

In the liquid discharging apparatus, preferably, a potential difference between the first potential and the second potential in the first drive signal is greater than a potential difference between the first potential and the second potential in the second drive signal.

According to this configuration, the liquid in the pressure chamber when the first drive signal is supplied to the piezoelectric element can be excited in the discharge direction stronger than that when the second drive signal is supplied to the piezoelectric element. Thus, the amplitude of the liquid level in the nozzle performing displacement by a residual vibration in checking for a discharge abnormality caused by a cause other than a foreign substance can be set to be larger than that in checking for a discharge abnormality caused by adhering of the foreign substance. A significant difference in a liquid level position in the nozzle in a residual vibration period is provided between an abnormal time in which the foreign substance has adhered and a normal time in which the foreign substance does not adhere. Thus, the residual vibration detection unit detects a difference of a change of the residual vibration from that in the normal time, and thereby it is possible to check whether or not a discharge abnormality caused by adhering of the foreign substance occurs, with high accuracy.

In the liquid discharging apparatus, preferably, in a normal time in which the discharge abnormality does not occur, an amplitude of a liquid level in the nozzle when the first drive signal is supplied to the piezoelectric element is greater than the amplitude of the liquid level in the nozzle when the second drive signal is supplied to the piezoelectric element.

According to this configuration, since the amplitude of the liquid level in the nozzle is set to be large, a significant difference in the liquid level position in the nozzle in the residual vibration period is provided between the abnormal time in which a foreign substance has adhered and the normal time. The significant difference in the liquid level position is shown as a significant difference of the change of the residual vibration. Thus, the residual vibration detection unit detects the residual vibration, and thereby it is possible to check whether or not the first discharge abnormality caused by adhering of the foreign substance occurs, with high accuracy. In a case of the non-discharge mode, the amplitude of the liquid level in the nozzle when the first drive signal is supplied to the piezoelectric element is large. Thus, in a case where a portion of the liquid protrudes from an opening of the nozzle by the large amplitude, the foreign substance such as paper dust, which has adhered to the surface on which the nozzle opens and the liquid easily come into contact with each other.

In the liquid discharging apparatus, preferably, the first potential and the third potential in the first drive signal are equal to each other.

According to this configuration, since the first potential and the third potential in the first drive signal are equal to each other, the next operation can be simply started without changing the potential after the residual vibration is attenuated, that is, after the checking ends. For example, if the first potential is different from the third potential, the change of pressure of the liquid in the pressure chamber is caused by the change of the potential after the checking ends, and this may influence the next discharge of the liquid. However, since the first potential and the third potential in the first drive signal are equal to each other, there is no concern of this type.

In the liquid discharging apparatus, preferably, the first potential in the first drive signal is a potential between the second potential and the third potential.

According to this configuration, the second potential and the third potential are set to potentials causing the first potential to be interposed between the second potential and the third potential. Thus, it is possible to create a residual vibration having a large amplitude, and to check whether or not a first discharge abnormality having a concern that it is not possible to normally discharge liquid because of adhering of a foreign substance, with high accuracy.

In the liquid discharging apparatus, preferably, the first drive signal transitions from the first potential to the second potential via a fourth potential, and the first potential is a potential between the second potential and the fourth potential.

According to this configuration, since the first drive signal transitions from the first potential to the second potential via the fourth potential, the piezoelectric element can be deformed once in a pull direction on an opposite side of a direction in which the liquid in the pressure chamber is pushed in the discharge direction, and then be largely deformed in the direction of pushing the liquid in the discharge direction. Thus, it is possible to largely vibrate the liquid in the pressure chamber by the large deformation of the piezoelectric element. As a result, it is possible to increase the amplitude of the liquid level in the nozzle. The significant difference in the liquid level position in the nozzle N in the residual vibration period is provided between the abnormal time in which the foreign substance has adhered and the normal time in which the foreign substance does not adhere. The significant difference in the liquid level position is shown as the significant difference of the change of the residual vibration. The residual vibration detection unit detects the residual vibration, and thereby it is possible to check whether or not the discharge abnormality caused by adhering of the foreign substance occurs, with high accuracy.

In the liquid discharging apparatus, preferably, the first drive signal transitions from the third potential to the first potential via a fifth potential, and the fifth potential is a potential between the third potential and the first potential.

According to this configuration, since the first drive signal returns stepwise from the third potential to the first potential via the fifth potential, it is possible to suppress erroneous discharge or the like after the transition, without the rapid potential change.

In the liquid discharging apparatus, preferably, a first holding time at which the first drive signal is held to be the second potential is different from a second holding time at which the second drive signal is held to be the second potential.

According to this configuration, the first holding time at which the first drive signal is held to be the second potential is set to be an appropriate time which is different from the second holding time at which the second drive signal is held to be the second potential, and thereby it is possible to increase the difference of the change of the residual vibration between the abnormal time in which a foreign substance adheres and the normal time. Accordingly, the residual vibration detection unit detects the difference of the change of the residual vibration, and thereby it is possible to check whether or not the first discharge abnormality caused by adhering of the foreign substance occurs, with high accuracy.

In the liquid discharging apparatus, preferably, when the first drive signal has been supplied, the residual vibration detection unit detects an amplitude of the residual vibration based on an electromotive force of the piezoelectric element and checks whether or not the first discharge abnormality occurs, based on the detected amplitude.

According to this configuration, when the first drive signal has been supplied, the residual vibration detection unit detects the amplitude of the residual vibration based on the change of the electromotive force of the piezoelectric element. In an abnormal time in which the foreign substance adheres and the normal time, a significant difference in a liquid level position in the nozzle is provided by the residual vibration, and the significant difference of the liquid level position is shown as the significant difference of the amplitude of the residual vibration. Therefore, it is possible to check whether or not the first discharge abnormality caused by adhering of the foreign substance occurs, with high accuracy by performing the checking based on the amplitude of the residual vibration, which has been detected by the residual vibration detection unit.

In the liquid discharging apparatus, preferably, when the first drive signal has been supplied, the residual vibration detection unit detects a phase of the residual vibration based on an electromotive force of the piezoelectric element and checks whether or not the first discharge abnormality occurs, based on the detected phase.

According to this configuration, the residual vibration detection unit detects the phase of the residual vibration based on the change of the electromotive force of the piezoelectric element when the first drive signal has been supplied. In an abnormal time in which the foreign substance adheres and the normal time, a significant difference in a liquid level position in the nozzle is provided by the residual vibration, and the significant difference of the liquid level position is shown as the significant difference of the phase of the residual vibration. Therefore, it is possible to check whether or not the first discharge abnormality caused by adhering of the foreign substance occurs, with high accuracy by performing the checking based on the phase of the residual vibration, which has been detected by the residual vibration detection unit.

In the liquid discharging apparatus, preferably, the mode is the discharge mode in which liquid is discharged from the nozzle. According to this configuration, in a case where a foreign substance such as paper dust adheres to the surface on which the nozzle opens, the liquid discharged from the nozzle comes into contact with the foreign substance. Thus, the liquid level position in the nozzle just after discharge is different from that in the normal time. Thus, a significant difference in the liquid level position in the nozzle is provided in comparison to the normal time. The significant difference in the liquid level position is shown as a significant difference of the change of the residual vibration. Thus, the residual vibration detection unit detects the significant difference of the change of the residual vibration, and thereby it is possible to check whether or not the first discharge abnormality caused by adhering of the foreign substance occurs, with high accuracy. With the checking in the discharge mode, it is possible to increase an amplitude of the liquid level in the nozzle by a residual vibration, and to improve check accuracy.

In the liquid discharging apparatus, preferably, the mode is the non-discharge mode in which liquid is not discharged from the nozzle. According to this configuration, a foreign substance such as paper dust, which has adhered to the surface on which the nozzle opens comes into contact with liquid remaining in previous discharging before checking or comes into contact with liquid which temporarily protrudes from the opening of the nozzle in checking in the non-discharge mode. Thus, the foreign substance is in a state of being in contact with the liquid in the nozzle. Since the potential change of the first drive signal is greater than the potential change of the second drive signal, when the first drive signal has been supplied to the piezoelectric element, a significant difference in the liquid level position in the nozzle by a residual vibration is provided between the abnormal time due to adhering of the foreign substance and the normal time. The significant difference in the liquid level position is shown as the significant difference of the change of the residual vibration. Therefore, the residual vibration detection unit detects the change of the residual vibration, and thereby it is possible to check whether or not the first discharge abnormality caused by adhering of the foreign substance occurs, with high accuracy. With checking in the non-discharge mode, it is possible to check an occurrence of a discharge abnormality even in the process of a printing operation. It is possible to check whether or not a discharge abnormality occurs, without consuming the liquid.

To solve the above problems, a liquid discharging apparatus includes a nozzle that discharges liquid by driving a piezoelectric element, a drive signal generation unit that generates a drive signal for driving the piezoelectric element, and a residual vibration detection unit that detects a change of an electromotive force of the piezoelectric element, which is caused by a residual vibration in a pressure chamber communicating with the nozzle after the drive signal is supplied. The drive signal generation unit generates a first drive signal and a second drive signal. The first drive signal is used for performing first checking in which it is checked whether or not a first discharge abnormality caused by a foreign substance adhering to a surface on which the nozzle opens occurs and second checking in which it is checked whether or not a second discharge abnormality caused by a cause other than the foreign substance occurs, together. The second drive signal is used for performing printing by discharging the liquid from the nozzle to a medium. A potential change for detecting the first drive signal is greater than a potential change for detecting the second drive signal.

According to this configuration, the potential change of the first drive signal supplied to the piezoelectric element when the first checking and the second checking are performed together is greater than the potential change of the second drive signal supplied to the piezoelectric element when the liquid is discharged to the medium. Thus, it is possible to improve check accuracy of the first checking in which it is checked whether or not the first discharge abnormality caused by the foreign substance occurs. In addition, since the first checking and the second checking are performed by detecting the common residual vibration, it is possible to reduce time required for discharge abnormality checking. In checking in the discharge mode, it is possible to reduce the consumed amount of the liquid at the time of the discharge abnormality checking.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
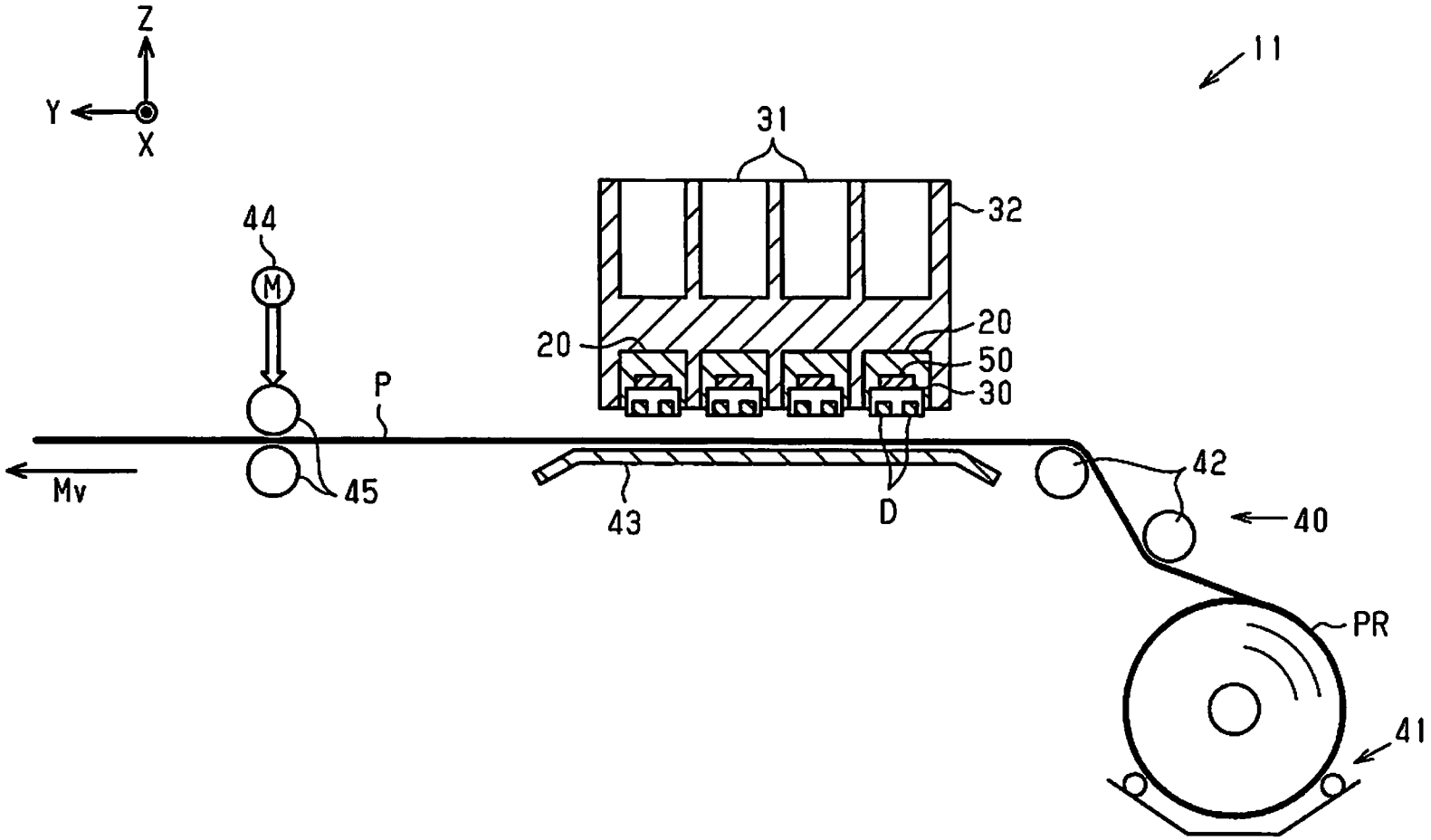
FIG. 1 is a schematic side sectional view illustrating a printer according to an embodiment.

Hereinafter, an embodiment will be described with reference to the drawings. In the drawings, the dimensions and the scales of the units are appropriately different from those in practice. Embodiments described below are preferred specific examples of the invention. Thus, various limitations which are technically preferable are given. However, the scope of the invention is not limited to the forms unless particular statements of limiting the invention are provided in the following descriptions.

An ink jet type printer as an example of a liquid discharging apparatus will be described below with reference to the drawings. An ink jet type line printer that forms an image on recording paper P (example of "a medium") by discharging an ink (example of "liquid") will be described as an example of an ink jet type printer 11.

As illustrated in FIG. 1, the printer 11 includes a mounting mechanism 32 on which a head unit 20 is mounted. Four ink cartridges 31 as a liquid supply source are mounted on the mounting mechanism 32 in addition to the head unit 20. The four ink cartridges 31 are provided in one-to-one correspondence with four colors (CMYK) of black, cyan, magenta, and yellow. Each of the ink cartridges 31 is filled with an ink having a color corresponding to the ink cartridge 31. In the example illustrated in FIG. 1, four head units 20 are provided in the printer 11 so as to correspond to the four ink cartridges 31 one-to-one. The ink cartridges 31 as the liquid supply source may be provided at other places of the printer 11 instead of being mounted on the mounting mechanism 32. The liquid supply source is not limited to the ink cartridge. For example, an ink replenishment type ink tank attached to the side surface or the like of the exterior housing of the printer 11 may be provided as the liquid supply source.

As illustrated in FIG. 1, a transport mechanism 40 includes a storage portion 41 for storing a roll body PR in a rotatable state. In the roll body PR, recording paper P has been wound in a roll shape in advance. The transport mechanism 40 includes a guide roller 42, a support base 43, and a transport roller 45 in FIG. 2. The guide roller 42 is provided so as to be rotatable about an X-axis. The support base 43 is provided under the mounting mechanism 32 (in a −Z direction in FIG. 1). The transport roller 45 rotates by driving the transport motor 44. In a case where the printer 11 performs printing processing, the transport mechanism 40 feeds recording paper P out from the storage portion 41 and transports the recording paper P, for example, at a transport speed My along a transport path in a direction from the upstream side toward the downstream side. The transport path is defined by the guide roller 42, the support base 43, and the transport roller 45. In the following descriptions, as illustrated in FIG. 1, a direction from the upstream side of the transport path toward the downstream side thereof is referred to as a +Y direction, and a direction from the downstream side toward the upstream side is referred to as a −Y direction. In the following descriptions, the +Y direction and the −Y direction may be collectively referred to as a Y-axis direction, and a +X direction and a −X direction may be collectively referred to as an X-axis direction.

Figure 2:
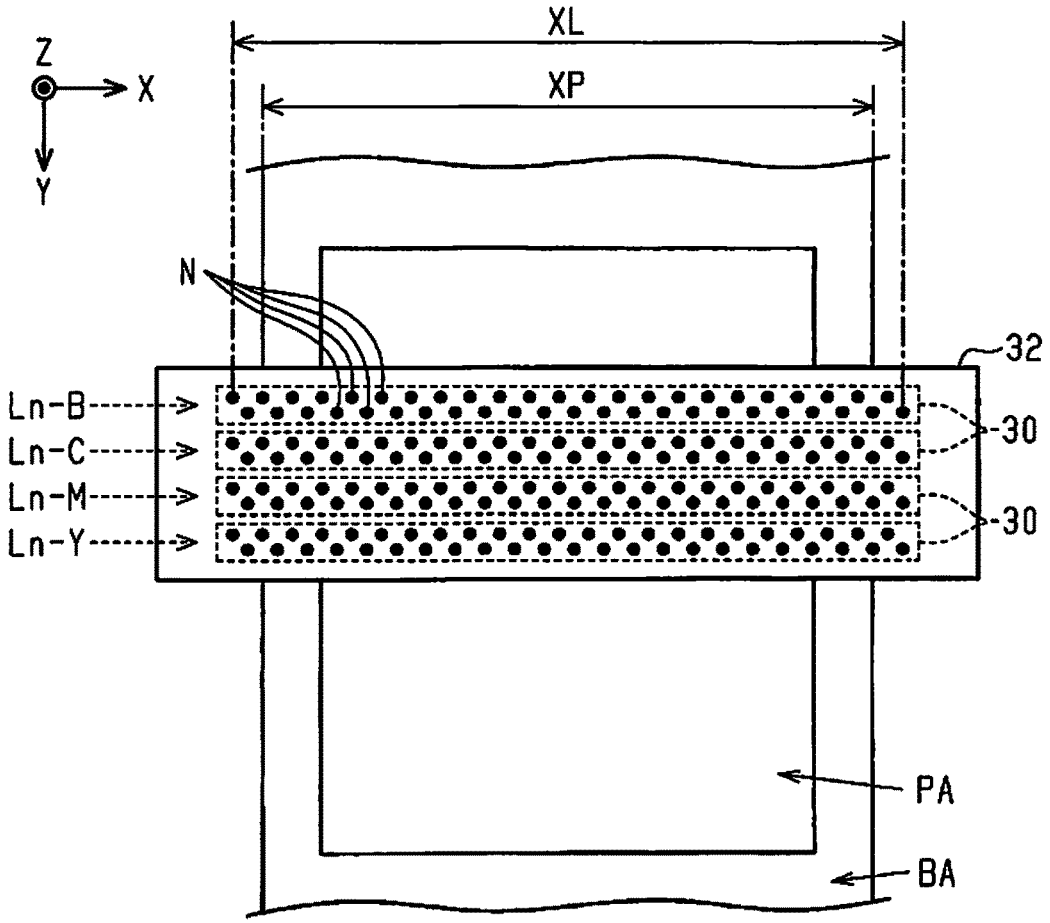
FIG. 2 is a plan view illustrating an arrangement example of nozzles in a discharge head.

FIG. 2 illustrates four head portions 30 mounted in the mounting mechanism 32 in a case where the printer 11 is viewed in plan view from the +Z direction toward the −Z direction. As illustrated in FIG. 2, a nozzle row Ln including M nozzles N is provided in each of the head portions 30. In other words, the printer 11 has four nozzle rows Ln. Specifically, the printer 11 has the four nozzle rows Ln including a nozzle row Ln-B, a nozzle row Ln-C, a nozzle row Ln-M, and a nozzle row Ln-Y. Each of a plurality of nozzles N in the nozzle row Ln-B is a nozzle N provided at a discharging portion D for discharging a black ink. Each of a plurality of nozzles N in the nozzle row Ln-C is a nozzle N provided at a discharging portion D for discharging a cyan ink. Each of a plurality of nozzles N in the nozzle row Ln-M is a nozzle N provided at a discharging portion D for discharging a magenta ink. Each of a plurality of nozzles N in the nozzle row Ln-Y is a nozzle N provided at a discharging portion D for discharging a yellow ink. In the embodiment, each of the four nozzle rows Ln is provided to extend in the X-axis direction, when viewed in plan view. A range XL in which the nozzle rows Ln extend in the X-axis direction is equal to or greater than a range XP of recording paper P in the X-axis direction in a case where printing is performed on the recording paper P having a width in the X-axis direction, which is the maximum width allowing printing of the printer 11 among plural types of recording paper P having a different size.

As illustrated in FIG. 2, the plurality of nozzles N constituting each of the nozzle rows Ln is arranged in a so-called staggered manner so that the positions of even-numbered nozzles N from the −X side are different from the positions of odd-numbered nozzles N in the Y-axis direction. The arrangement of the nozzles N illustrated in FIG. 2 is an example. The nozzle rows Ln may extend in a direction different from the X-axis direction, and the plurality of nozzles N in each of the nozzle rows Ln may be arranged in a straight line.

Regarding printing processing in the embodiment, as illustrated in FIG. 2, a case in which a plurality of images in one-to-one correspondence with a plurality of printing areas PA is formed in a state where recording paper P is divided into the plurality of printing areas PA and margin areas BA for respectively separating the plurality of printing areas PA from each other is assumed as an example. Cut paper may be used as the recording paper P, one printing area PA may be provided for one sheet of recording paper P, and one image may be formed on each of sheets of recording paper P of which the number corresponds to the number of sets.

Figure 3:
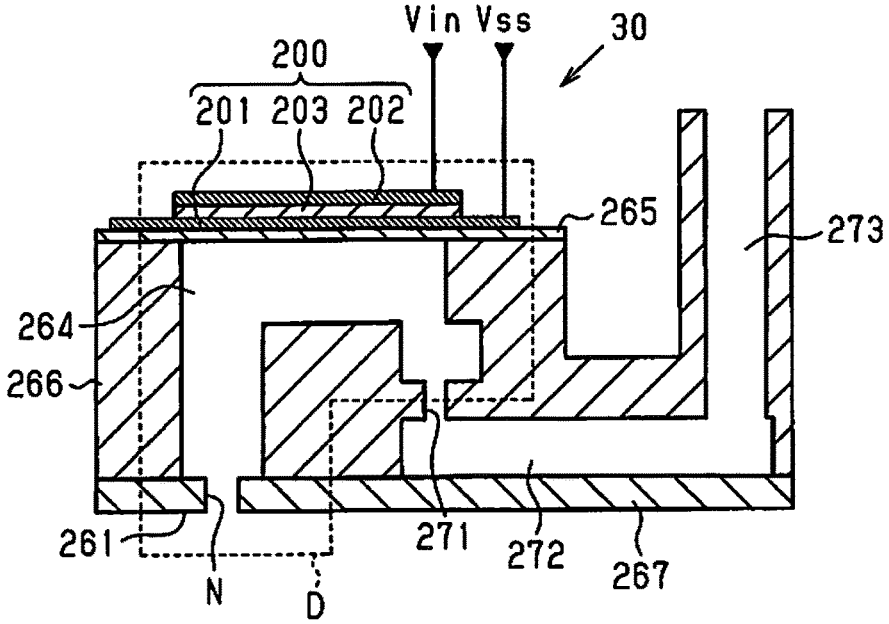
FIG. 3 is a sectional view illustrating a configuration of a discharging portion.

Next, a configuration of the discharging portion D that discharges ink droplets from the nozzles N of the head portion 30 will be described with reference to FIG. 3. In the discharging portion D illustrated in FIG. 3, a diaphragm 265 vibrates by driving the piezoelectric element 200, and thereby an ink (liquid) in a cavity 264 as an example of a pressure chamber is discharged from the nozzle N. FIG. 3 illustrates one discharging portion D among discharging portions D of which the number is equal to the number of the plurality of nozzles N provided in the head portion 30. A surface of the head portion 30, on which the nozzle N opens serves as a head surface 261. The head surface 261 faces a support base 43 or recording paper P on the support base 43, when printing is performed by discharging droplets from the nozzles N.

As illustrated in FIG. 3, the discharging portion D includes the piezoelectric element 200, the cavity 264 filled with an ink, the nozzle N communicating with the cavity 264, and the diaphragm 265. The discharging portion D discharges the ink in the cavity 264 from the nozzle N by driving the piezoelectric element 200 with a drive signal Vin.

The cavity 264 is defined by a cavity plate 266, a nozzle plate 267 in which the nozzle N has been formed, and the diaphragm 265. The cavity plate 266 is formed into a predetermined shape having a recess portion. The cavity 264 communicates with a reservoir 272 through an ink supply port 271. The reservoir 272 communicates with one ink cartridge 31 through an ink supply flow path 273.

In the embodiment, a unimorph (monomorph) type as illustrated in FIG. 3 is employed as the piezoelectric element 200. The piezoelectric element 200 includes a lower electrode 201 as an example of a first electrode, an upper electrode 202 as an example of a second electrode, and a piezoelectric body 203 provided between the lower electrode 201 and the upper electrode 202. The lower electrode 201 is set to have a predetermined reference potential VSS, and a drive signal Vin is supplied to the upper electrode 202. Thus, if a voltage between the lower electrode 201 and the upper electrode 202 is applied to the piezoelectric element 200, the piezoelectric element 200 vibrates with bending in a vertical direction in FIG. 3, in accordance with the applied voltage. In this example, the lower electrode 201 is a common electrode which is common between a plurality of piezoelectric elements 200. The upper electrode 202 is an individual electrode for separately supplying the drive signal Vin to the plurality of piezoelectric elements 200.

The lower electrode 201 of the piezoelectric element 200 is bonded to the diaphragm 265 provided in a state of closing an upper opening portion of the cavity plate 266. Therefore, if the piezoelectric element 200 vibrates by the drive signal Vin, the diaphragm 265 also vibrates. The volume of the cavity 264 changes by the diaphragm 265 vibrating, and pressure of the ink in the cavity 264 changes with the change of the volume of the cavity 264. Thus, a portion of the ink with which the cavity 264 is filled is discharged by the nozzle N.

The ink in the cavity 264 is reduced by discharging the ink, and the liquid amount of the reduced ink is replenished by supplying the ink from the reservoir 272 to the cavity 264. The ink is supplied from the ink cartridge 31 to the reservoir 272 through the ink supply flow path 273.

Figure 4:
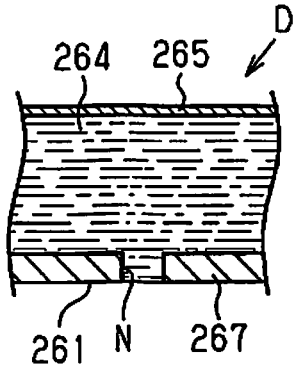
FIG. 4 is a schematic partial sectional view illustrating a discharge operation of the discharging portion.
Figure 5:
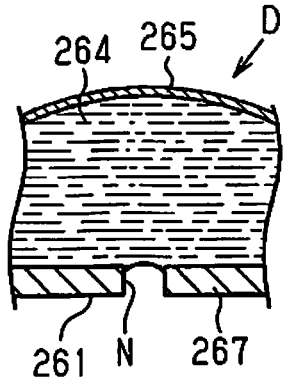
FIG. 5 is a schematic partial sectional view illustrating the discharge operation of the discharging portion.
Figure 6:
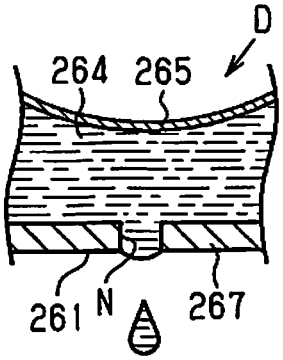
FIG. 6 is a schematic partial sectional view illustrating the discharge operation of the discharging portion.

Next, an ink discharge operation of the discharging portion D will be described with reference to FIGS. 4 to 6. In the state illustrated in FIG. 4, if the drive signal Vin (see FIG. 7 in any case) is supplied from a drive signal generation unit 51 to the piezoelectric element 200 (see FIG. 3) provided in the discharging portion D, distortion depending on the voltage applied between the electrodes 201 and 202 occurs in the piezoelectric element 200. Thus, the diaphragm 265 of the discharging portion D bends in a direction away from the nozzle N. Accordingly, as illustrated in FIG. 5, the volume of the cavity 264 of the discharging portion D increases in comparison to an initial state illustrated in FIG. 4. In the state illustrated in FIG. 5, if the potential of the drive signal Vin is changed, the diaphragm 265 is restored by an elastic restoring force thereof. Then, as illustrated in FIG. 6, the diaphragm 265 bends toward the nozzle N side beyond the position of the diaphragm in the initial state, and thus the volume of the cavity 264 is rapidly reduced. With pressure generated in the cavity 264 at this time, a portion of the ink of which the cavity 264 is full is discharged from the nozzle N communicating with the cavity 264, in a form of ink droplets.

Figure 7:
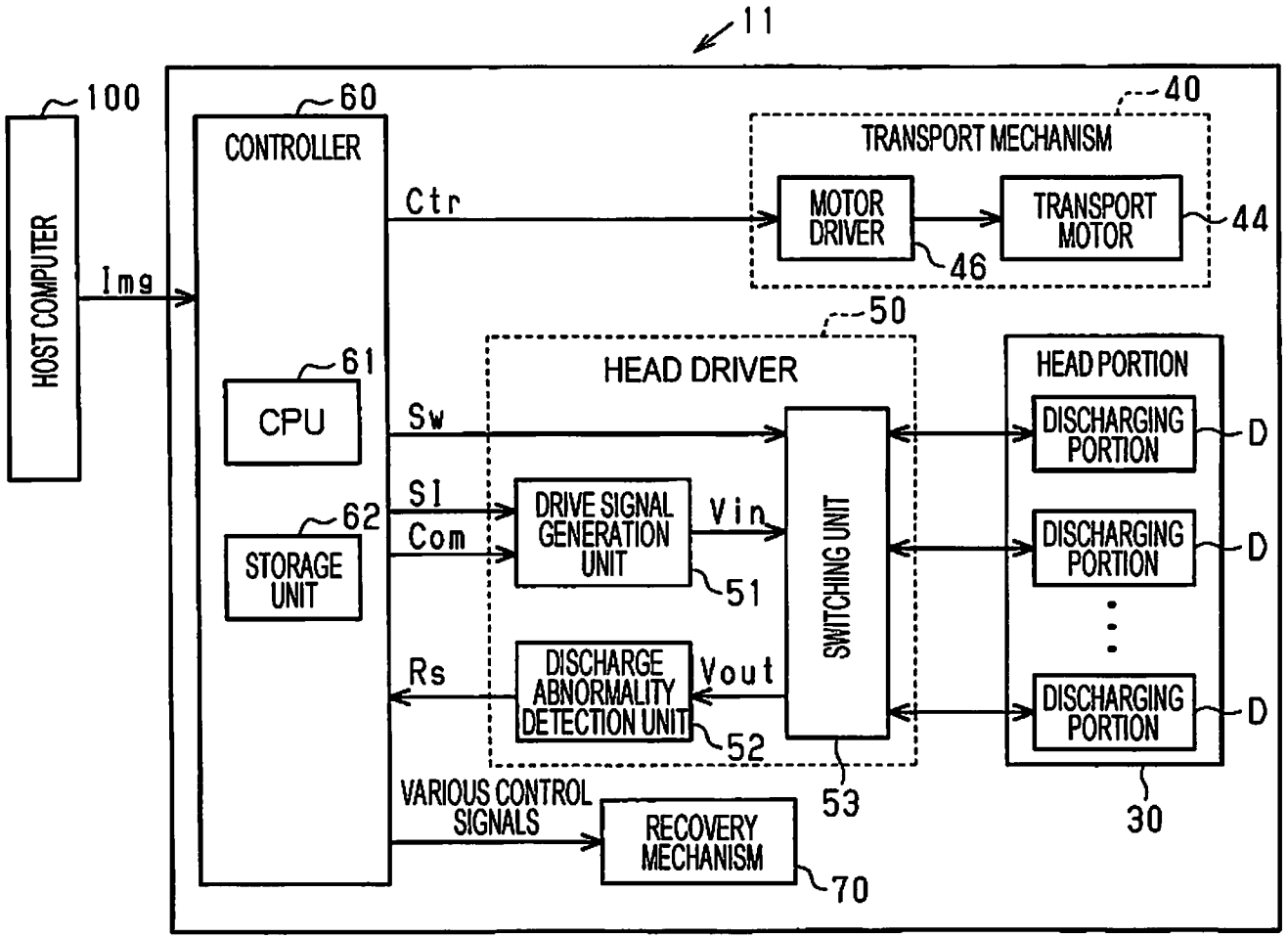
FIG. 7 is a block diagram illustrating an electrical configuration of the printer.

A functional configuration of the printer 11 according to the embodiment will be described with reference to FIG. 7. As illustrated in FIG. 7, the printer 11 includes the head portion 30 and a head driver 50. The head portion 30 includes M (M is a natural number of 2 or more) pieces of discharging portions D capable of discharging an ink with which the discharging portion has been filled. The head driver 50 drives the head portion 30. The printer 11 includes the transport mechanism 40 for moving the relative position of recording paper P to the head portion 30 and a recovery mechanism 70. The recovery mechanism 70 performs recovery processing for recovering a discharge state of the discharging portion D to be normal, in a case where a discharge abnormality occurring in the discharging portion D has been detected.

The printer 11 includes a controller 60 that controls operations of the transport mechanism 40, the head driver 50, and the recovery mechanism 70 based on image data Img supplied from a host computer 100 such as a personal computer or a digital camera. The controller 60 controls performing of various kinds of processing such as printing processing of forming an image on recording paper P, discharge abnormality detection processing of detecting a discharge abnormality of the discharging portion D, and recovery processing of recovering the discharge state of the discharging portion D to be normal.

The controller 60 includes a central processing unit (CPU) 61 and a storage unit 62. The storage unit 62 includes an electrically erasable programmable read-only memory (EEPROM) which is one kind of non-volatile semiconductor memory and stores image data Img supplied from the host computer 100 through an interface unit (not illustrated), in a data storage area. The storage unit 62 includes a random access memory (RAM) that temporarily stores data required when printing processing of, for example, information on the shape of recording paper P and discharge-abnormality detection result data indicating a result obtained by discharge abnormality detection processing, or temporarily develops a control program for performing various kinds of processing such as printing processing. The storage unit 62 includes a PROM which is one kind of non-volatile semiconductor memory and stores a control program and the like for controlling the components of the printer 11.

The CPU 61 controls performing of various kinds of processing such as printing processing, discharge abnormality detection processing, and recovery processing. More specifically, the CPU 61 stores image data Img supplied from the host computer 100, in the storage unit 62. The CPU 61 generates various signals and various control signals for controlling driving of the recovery mechanism 70, based on various kinds of data such as image data Img. Examples of the various signals include a driver control signal Ctr for controlling driving of the transport motor 44, and a printing signal SI, a switching control signal Sw, and a drive waveform signal Com which are used for controlling driving of the head driver 50. The CPU 61 supplies the signals to the components of the printer 11. Thus, the CPU 61 controls operations of the transport motor 44, the head driver 50, and the recovery mechanism 70 and controls performing of various kinds of processing such as printing processing, discharge abnormality detection processing, and recovery processing. The constituent components of the controller 60 are electrically connected to each other via a bus (not illustrated).

The head driver 50 illustrated in FIG. 7 includes the drive signal generation unit 51, a discharge abnormality detection unit 52 as an example of a residual vibration detection unit, and a switching unit 53.

The drive signal generation unit 51 generates a drive signal Vin for driving the discharging portion D provided in the head portion 30, based on the printing signal SI and the drive waveform signal Com supplied from the controller 60. The printing signal SI and the drive waveform signal Com are collectively referred to as "a printing control signal". That is, the drive signal generation unit 51 generates a drive signal Vin based on the printing control signal. Although the details thereof will be described later, the drive waveform signal Com in the embodiment includes three drive waveform signals Com-A, Com-B, and Com-C.

The discharge abnormality detection unit 52 detects the change of pressure in the discharging portion D, as a residual vibration signal Vout. The change of the pressure occurs after the discharging portion D has been driven by the drive signal Vin and is caused by a vibration and the like of the ink in the discharging portion D. Specifically, the discharge abnormality detection unit 52 detects a residual vibration of the diaphragm 265 vibrating with being attenuated in a vibration state depending on a state of liquid in the cavity 264 communicating with the nozzle N, after the drive signal Vin has been supplied to the piezoelectric element 200. The discharge abnormality detection unit performs the detection from the change of an electromotive force of the piezoelectric element 200. Then, the discharge abnormality detection unit acquires the change of the electromotive force, in a form of the residual vibration signal Vout. The discharge abnormality detection unit 52 determines whether or not a discharge abnormality occurs in the discharging portion D and determines a discharge state of the ink in the discharging portion D, based on the residual vibration signal Vout. Then, the discharge abnormality detection unit outputs a determination result in a form of a determination result signal Rs.

The switching unit 53 connects each of the discharging portions D to either the drive signal generation unit 51 or the discharge abnormality detection unit 52, based on the switching control signal Sw supplied from the controller 60. That is, the switching unit 53 performs switching between a first connection state and a second connection state. In the first connection state, the discharging portion D and the drive signal generation unit 51 are electrically connected to each other. In the second connection state, the discharging portion D and the discharge abnormality detection unit 52 are electrically connected to each other. The controller 60 outputs the switching control signal Sw for controlling the connection state of the switching unit 53, to the switching unit 53. Specifically, the controller 60 supplies the switching control signal Sw causing the switching unit 53 to maintain the first connection state, to the switching unit 53 in a unit operation period in which discharge processing is performed. Therefore, the drive signal Vin is supplied from the drive signal generation unit 51 to the discharging portion D in the unit operation period.

If it is a timing to end the unit operation period and start a unit checking period, the controller 60 changes the switching control signal Sw so as to switch the connection state from the first connection state to the second connection state. The switching unit 53 maintains the second connection state in a unit checking period (detection period Td which will be described later) in which checking the occurrence of a discharge abnormality in the discharging portion D of the head portion 30 is performed. In a unit period which is a sum of the unit operation period and the unit checking period, a discharge operation of ink droplets for one dot based on application of the drive signal Vin to the piezoelectric element 200 of the discharging portion D is performed, and the residual vibration signal Vout output by the piezoelectric element 200 receiving a residual vibration with performing the discharge operation of the ink droplets for the one dot is acquired. In a case where the discharge abnormality checking is performed in the process of printing, the checking is performed in a non-discharge state where the piezoelectric element 200 is vibrated as slight as an ink is not discharged, and thus an ink droplet is not discharged from the discharging portion D.

In a case where discharge abnormality checking is performed in non-printing in which printing is not performed, the controller 60 arranges the head portion 30 and the recovery mechanism 70 to have a position relationship for checking, and performs the discharge abnormality checking of the discharging portion D. In the unit period which is a sum of the unit operation period and the unit checking period, a discharge operation of ink droplets for checking based on application of the drive signal Vin to the piezoelectric element 200 of the discharging portion D is performed, and the residual vibration signal Vout output by the piezoelectric element 200 receiving a residual vibration with performing the discharge operation of the ink droplets for checking is acquired. The controller 60 switches the switching unit 53 to be in the second connection state, in the unit checking period. The discharge abnormality checking performed in the non-printing is performed by discharging ink droplets from the discharging portion D. The discharged ink droplets are collected in a waste liquid receiving portion (not illustrated) constituting the recovery mechanism 70.

The controller 60 is electrically connected to a motor driver 46 for driving the transport motor 44. The controller 60 supplies the driver control signal Ctr to the motor driver 46 so as to control driving of the transport motor 44. The transport mechanism 40 includes a feeding motor (not illustrated) for rotating the roll body PR.

A serial printer including a recording unit of a serial recording type may also be set as the printer 11, instead of the line printer. In this case, the head portion 30 is mounted in a carriage (not illustrated) and is configured to be movable in the X-axis direction. The serial recording type printer 11 includes a carriage motor for moving the carriage and a carriage motor driver for driving the carriage motor (none illustrated). While the controller 60 controls driving of the carriage motor with the carriage motor driver so as to perform reciprocating of the carriage in the X-axis direction as a scanning direction, ink droplets are discharged from each of the discharging portions D of the head portion 30, in the process of the moving. The controller 60 alternately repeats a printing operation and a conveyance operation so as to perform printing of an image and the like on the recording paper P. In the printing operation, an ink is discharged onto recording paper P from the nozzle N (see FIG. 2) of the head portion 30 while the carriage is reciprocated in the X-axis direction. In the conveyance operation, the recording paper P is transported in a Y-direction as a transport direction, with a transport amount up to the next printing position. In a case where the printer 11 is a serial printer, control of the discharging portions D of the head portion 30 by the controller 60 is basically identical to the discharge abnormality detection processing.

In discharge abnormality checking, a residual vibration remains in the diaphragm 265 of each of the discharging portions D by vibrating, in a period from after a discharge operation for one ink droplet or one vibration operation for slighting vibrating the ink in the nozzle N ends, until the next vibration operation starts. The residual vibration occurring in the diaphragm 265 of the discharging portion D may be assumed to have a natural vibration frequency determined by acoustic resistance Res (depending on the shape of the nozzle N or the ink supply port 271, viscosity of the ink, and the like), inertance Int (depending on the weight of the ink in the flow path), and compliance Cm of the diaphragm 265 and the like.

Figure 8:
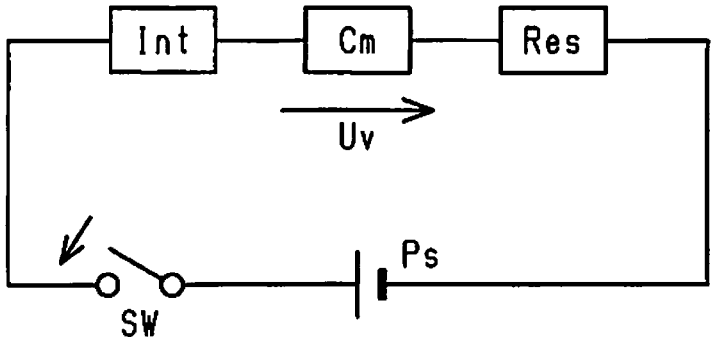
FIG. 8 is a circuit diagram illustrating an equivalent circuit of a discharge abnormality detection unit.

FIG. 8 illustrates an equivalent circuit representing a calculating model of a simple vibration assuming the residual vibration of the diaphragm 265 based on the above assumption. The calculating model of the residual vibration of the diaphragm 265 is represented by sound pressure Ps, inertance Int, compliance Cm, and acoustic resistance Res. If a step response when the sound pressure Ps has been applied to the circuit in FIG. 8 is calculated with respect to the volume velocity Uv, the following expression is obtained.

$$Uv=\{Ps/(\omega\cdot Int)\}e^{-\omega t}\cdot\sin\omega t$$

$$\omega=\{1/(Int\cdot Cm)-\alpha^2\}^{1/2}$$

$$\alpha=Res/(2\cdot Int)$$

The experiment on the residual vibration of the discharging portion D is performed. The experiment on the residual vibration is an experiment of detecting a residual vibration occurring in the diaphragm 265 of the discharging portion D after an ink has been discharged from the discharging portion D in which the discharge state of the ink has been normal.

Figure 9:
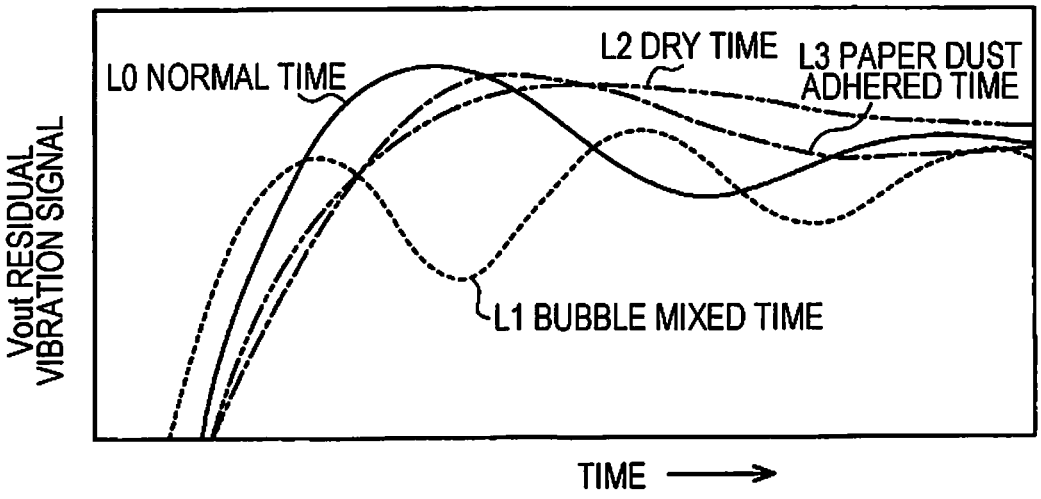
FIG. 9 is a graph illustrating a waveform of a residual vibration signal detected by the discharge abnormality detection unit.

FIG. 9 is a graph illustrating an example of an experimental value of the residual vibration. In a case where an ink discharge operation is normally performed in the discharging portion D, the acoustic resistance Res, the inertance Int, and the compliance Cm have normal values. The residual vibration waveform of the diaphragm 265 becomes a predetermined waveform in the normal time, which is indicated by "normal time LO" in FIG. 9. However, even though the ink discharge operation has been performed in the discharging portion D, the discharge state of the ink in the discharging portion D may be normal, and thus a discharge abnormality in that ink droplets are not normally discharged from the nozzle N of the discharging portion D may occur. Examples of the cause of the occurrence of the discharge abnormality include (a) mixing of bubbles in the cavity 264, (b) thickening or sticking of an ink, which is caused by drying the ink in the nozzle N and the cavity 264, and (c) adhering of foreign substances such as paper dust to the vicinity of an outlet of the nozzle N.

Figure 10:
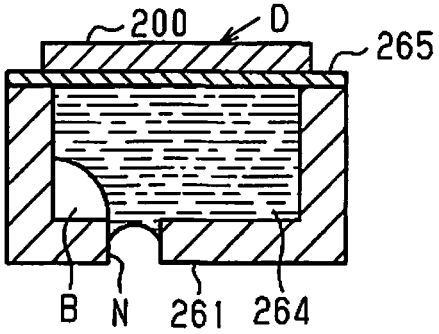
FIG. 10 is a schematic partial sectional view of the discharge head illustrating a discharge abnormality when bubbles are mixed.

Details of each of the causes of (a) to (c), which causes the discharge abnormality will be described with reference to FIGS. 10 to 13. As illustrated in FIG. 10, in a case where, for example, the tip end of the ink flow path of the cavity 264 or the like or the tip end of the nozzle N is clogged with bubbles B, the weight of the ink decreases as much as the bubbles B have been mixed. Thus, the inertance Int, and a state where the nozzle diameter increases by the bubbles B occurs. Therefore, in the discharge abnormality caused by the bubbles B, the acoustic resistance Res decreases, and thus, a characteristic residual vibration waveform that the frequency is high can be detected. Such a characteristic residual vibration waveform is indicated by "bubble mixed time L1" in FIG. 9.

Figure 11:
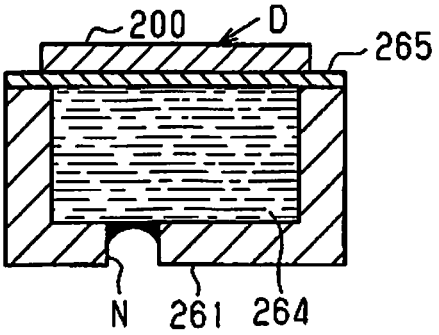
FIG. 11 is a schematic partial sectional view of the discharge head illustrating a discharge abnormality in which clogging occurs by a thickened or dried ink.

As illustrated in FIG. 11, in a case where an ink has been thickened or stuck by drying the ink in the nozzle N, and thereby the ink has not been discharged, viscosity of the ink in the vicinity of the nozzle N increases by the drying, and the acoustic resistance Res increases. Thus, a characteristic residual vibration waveform that damping has been excessively performed can be detected. Such a characteristic residual vibration waveform is indicated by "dry time L2" in FIG. 9.

Figure 12:
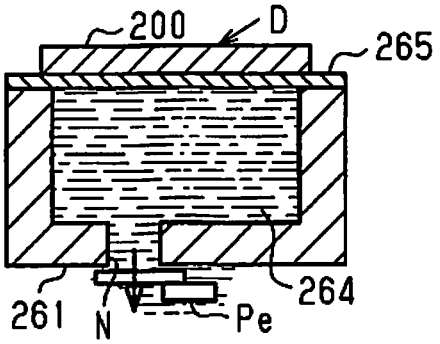
FIG. 12 is a schematic partial sectional view of the discharge head illustrating a discharge abnormality caused by adhering of paper dust.

As illustrated in FIG. 12, in a case where paper dust Pe such as paper powder has adhered to the head surface 261, the ink leaks out from the nozzle N by the paper dust Pe, and thereby the weight of the ink increases and the inertance Int increases. The acoustic resistance Res increases by the fiber of the paper dust Pe adhering to the nozzle N, and thus a characteristic residual vibration waveform that a period becomes longer than that in the normal discharge time, that is the frequency becomes low can be detected. Such a characteristic residual vibration waveform is indicated by "paper dust adhering time L3" in FIG. 9.

Figure 13:
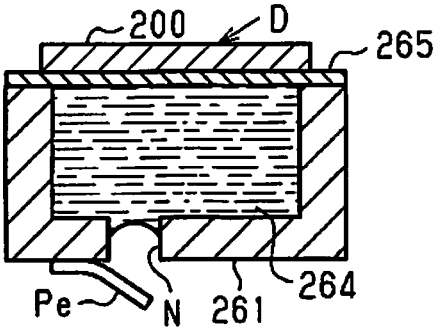
FIG. 13 is a schematic partial sectional view of the discharge head illustrating a discharge abnormality in which the paper dust has adhered in a state of floating.

As illustrated in FIG. 13, if a portion of the paper dust Pe adhering to the head surface 261 floats, and the floating portion is positioned away from the opening of the nozzle N onto the extension of the discharge direction, the ink from the nozzle N may not be leaked out to the paper dust Pe. In this case, the weight of the ink does not increase, and the inertance Int hardly changes in comparison to that in the normal time. In addition, the increase of the acoustic resistance Res by the fiber of the paper dust Pe adhering to the nozzle N is hardly caused. Therefore, a residual vibration waveform having a period which hardly changes in comparison to that in the normal time is detected. In this case, since the waveform of "paper dust adhering time L3" illustrated in FIG. 9 is not obtained, adhering of the paper dust Pe is not detected. The above descriptions are not limited to the paper dust Pe. The above descriptions are similarly applied to, for example, any foreign substance (dust, other kinds of powder, fibers, and the like) which has entered from the outside of the casing of the printer 11 into the casing thereof and adhered in a state where the ink is not leaked out to the head surface 261.

From the above descriptions, it is possible to detect a discharge abnormality of the ink droplet in the discharging portion D and to specify the cause of the discharge abnormality, by the difference of the residual vibration of the diaphragm 265. Therefore, in this example, the discharge abnormality detection unit 52 in the head driver 50 illustrated in FIG. 7 detects an abnormal nozzle in which a discharge abnormality of an ink droplet from the nozzle N occurs, that is, it is not possible to normally discharge an ink droplet, by using the residual vibration signal Vout as an input. The discharge abnormality detection unit 52 detects the size of at least one of the period, the amplitude, and a phase difference of the residual vibration signal Vout illustrated in FIG. 9. The discharge abnormality detection unit detects whether discharging is normally performed, or a discharge abnormality occurs, by using a plurality of thresholds allowed to distinguish discharge abnormalities from each other by the cause. In a case of detecting that the discharge abnormality occurs, the discharge abnormality detection unit 52 outputs a determination result signal Rs obtained by determination of the discharge abnormality by the causes such as bubbles, dry, and paper dust, to the controller 60. In the embodiment, the discharge abnormality detection unit 52 measures the phase and the amplitude of the residual vibration signal Vout. The discharge abnormality detection unit compares the measured values to the phase and the amplitude in the normal time, and thus detects the occurrence of a discharge abnormality caused by the paper dust Pe floating from the head surface 261, which is illustrated in FIG. 13. The controller 60 determines whether the state of the discharging portion D as a checking target is in a normal state of being capable of normally discharging droplets or is in a discharge abnormal state of not being capable of normally discharging droplets, based on the determination result signal Rs from the discharge abnormality detection unit 52. In a case where the determination result indicates the discharge abnormality, the controller 60 acquires a determination result of the discharge abnormality by the cause such as bubbles, dry, and paper dust.

Here, the discharge abnormality typically means a state where it is not possible to discharge an ink from the nozzle N. Thus, in this case, dot missing for pixels occurs in an image of which printing has been performed on the recording paper P. The discharge abnormality also includes an abnormal nozzle in which an ink has been discharged from the nozzle N, but the amount of the discharged ink is too small or in which the flight direction (ballistic trajectory) of the discharged ink droplet is deviated, and thus the ink droplet is not landed on an appropriate position and flight deflection inducing deviation of the landing position is obtained.

Figures 14, 15:
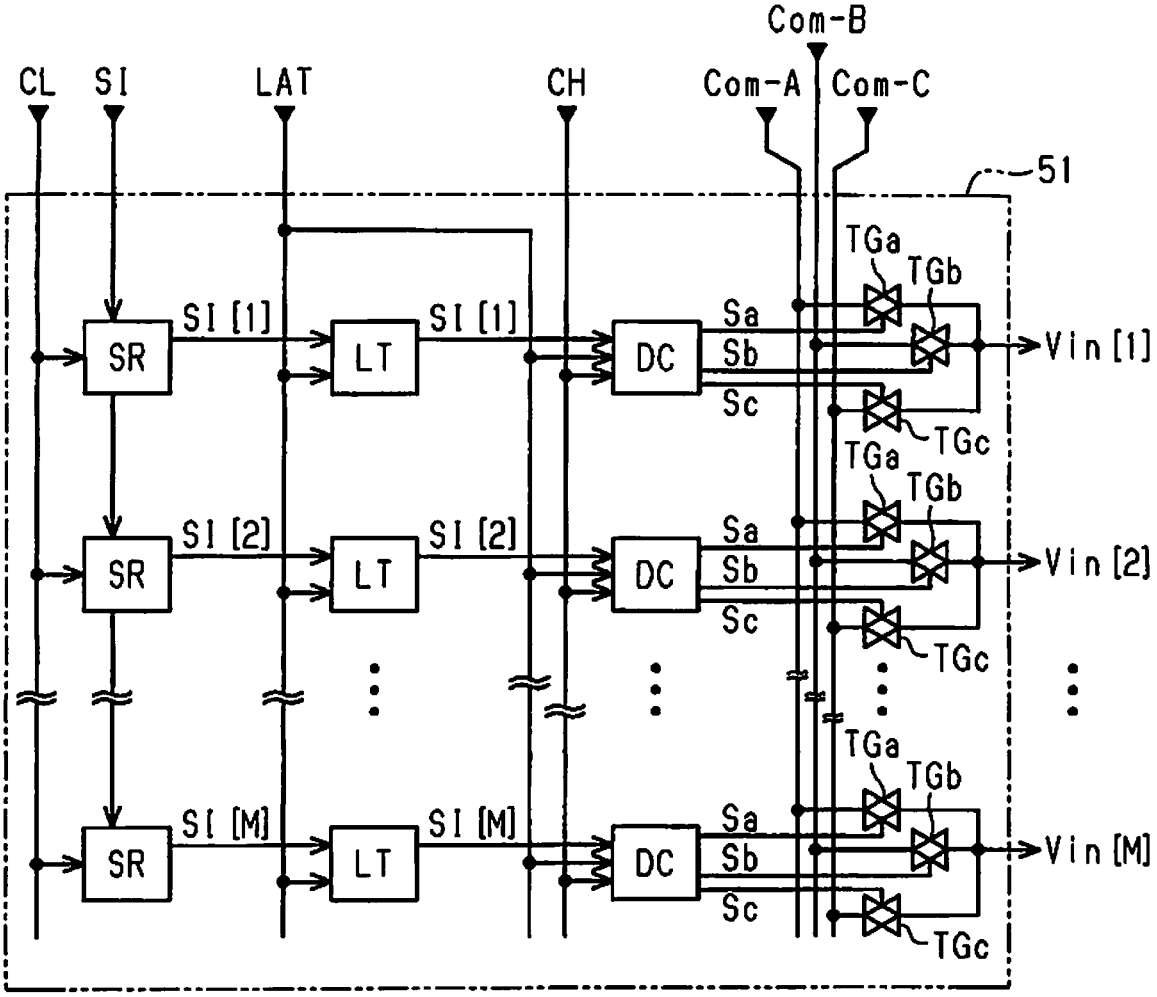
FIG. 14 is a block diagram illustrating a configuration of a drive signal generation unit.
FIG. 15 is a table diagram illustrating decoding contents of a decoder.

Next, a configuration and an operation of the head driver 50 will be described with reference to FIGS. 14 to 22. FIG. 14 illustrates a configuration of the drive signal generation unit 51 in the head driver 50. As illustrated in FIG. 14, the drive signal generation unit 51 includes M sets for one-to-one correspondence with M discharging portions D. Each of the sets includes a shift register SR, a latch circuit LT, a decoder DC, and a plurality of transmission gates TGa, TGb, and TGc. In the following descriptions, the components constituting the M sets may be referred to as a first stage, a second stages, . . . , and an M-th stage in order from the top in FIG. 14. Although details will be described later, the discharge abnormality detection unit 52 includes M discharge abnormality detection circuits DT (DT[1], DT[2], . . . , and DT[M]) illustrated in FIG. 22, for one-to-one correspondence with the M discharging portions D.

As illustrated in FIG. 14, a clock signal CL, a printing signal SI, a latch signal LAT, a change signal CH, and a drive waveform signal Com (Com-A, Com-B, and Com-C) are supplied to the drive signal generation unit 51 from the controller 60. Here, the printing signal SI is a digital signal for defining the amount of an ink discharged from each nozzle N of each discharging portion D, when one dot of an image is formed. More specifically, in the embodiment, the printing signal SI defines the amount of an ink discharged from each nozzle N of each of the discharging portions D, with three bits of an upper bit b1, a middle bit b2, and a lower bit b3. The printing signal is supplied to the drive signal generation unit 51 from the controller 60 in synchronization with the clock signal CL, in a serial manner. With the printing signal SI, the amount of an ink discharged from each discharging portion D is controlled. Thus, four gradations of non-recording, a small dot, a medium dot, and a large dot can be expressed for each dot of recording paper P. Further, a checking drive signal for checking the discharge state of an ink by generating a residual vibration can be generated.

The shift register SR holds the printing signal SI for each of the three bits corresponding to each of the discharging portions D. Specifically, the M shift registers SR of a first stage, a second stage, . . . , and an M-th stage, which are in one-to-one correspondence with the M discharging portions D are consecutively connected to each other, and the printing signal SI is sequentially transferred to the subsequent stage in accordance with the clock signal CL. At a time point at which the printing signal SI has been transferred to all the M shift registers SR, the supply of the clock signal CL is stopped, and each of the M shift registers SR maintains a state of holding data of 3 bits in the printing signal SI, which correspond to the own shift register.

Each of the M latch circuits LT latches the printing signal SI of the three bits corresponding to the stage at a timing at which the latch signal LAT rises. The printing signals SI of the three bits have been held in the M shift registers SR, respectively. In FIG. 14, SI[1], SI[2], . . . , and SI[M] are respectively output from the shift registers SR of the first stage, the second stage, . . . , and the M-th stage, and indicates the printing signal SI of the three bits, which has been latched by the latch circuit LT corresponding to the respective shift register SR.

A printing operation period which is a period in which the printer 11 performs printing by forming an image on recording paper P includes a plurality of unit operation periods Tu. The controller 60 assigns the unit operation period Tu to printing processing for one dot, for each of the M discharging portions D. Discharge abnormality checking performed in the printing operation period is performed in non-discharge in which an ink droplet is not discharged. Discharge abnormality checking performed in a not-printing period is performed by discharging an ink droplet to the waste liquid receiving portion of the recovery mechanism 70. Discharge abnormality checking with discharging an ink droplet is performed in a state where the waste liquid receiving portion is disposed at a position facing the head portion 30. In a case where the printer 11 is a serial printer, the checking is performed in a state where the head portion 30 is disposed at a home position at which the recovery mechanism 70 is disposed.

The controller 60 controls the discharging portion D in three forms. In a first form, printing processing is assigned to some of the M discharging portions D, and discharge abnormality detection processing is assigned to other discharging portions D. In a second form, printing processing is assigned to all the M discharging portions D. In a third form, discharge abnormality detection processing is assigned to all the M discharging portions D. In the first form, the discharge abnormality detection processing is performed in a non-discharge state. In the third form, the discharge abnormality detection processing is performed in a discharge or the non-discharge state.

Each unit operation period Tu includes a control period Tc1 and a control period Tc2 subsequent to the control period Tc1. In the embodiment, the control periods Tc1 and Tc2 have time lengths which are equal to each other.

The controller 60 supplies the printing signal SI to the drive signal generation unit 51 for each unit operation period Tu. The latch circuit LT latches the printing signals SI[1], SI[2], . . . , and SI[M] for each unit operation period Tu.

The decoder DC decodes the printing signal SI of the three bits, which has been latched by the latch circuit LT, and outputs selection signals Sa, Sb, and Sc in each of the control periods Tc1 and Tc2.

FIG. 15 illustrates a table representing contents of decoding performed by the decoder DC. The printing signal SI[m] illustrated in FIG. 15 indicates the contents of the printing signal SI[m] corresponding to an m-th stage (m is a natural number satisfying $1 \leq m \leq M$). In a case where the contents indicated by the printing signal SI[m] is (b1, b2, b3)=(1, 0, 0), the m-th decoder DC sets the selection signal Sa to a high level H and sets the selection signals Sb and Sc to a low level L, in the control period Tc1. The m-th decoder DC sets the selection signals Sa and Sc to the low level L and sets the selection signal Sb to the high level H, in the control period Tc2.

In a case where the lower bit b3 is "1", regardless of the values of the upper bit b1 and the middle bit b2, the m-th decoder DC sets the selection signals Sa and Sb to the low level L and sets the selection signal Sc to the high level H, in the control periods Tc1 and Tc2.

Descriptions will be made with reference to FIG. 14 again. As illustrated in FIG. 14, the drive signal generation unit 51 includes M sets of the transmission gates TGa and TGb so as to correspond to the M discharging portions D one-to-one.

The transmission gate TGa is in an ON state when the selection signal Sa is at the H level and is in an OFF state when the selection signal Sa is at the L level. The transmission gate TGb is in the ON state when the selection signal Sb is at the H level and is in the OFF state when the selection signal Sb is at the L level. The transmission gate TGc is in the ON state when the selection signal Sc is at the H level and is in the OFF state when the selection signal Sc is at the L level.

For example, at the m-th stage, in a case where the contents represented by the printing signal SI[m] is (b1, b2, b3)=(1, 0, 0), the transmission gate TGa is in the ON state and the transmission gates TGb and TGc are in the OFF state, in the control period Tc1. When the transmission gates TGa and TGc are in the OFF state in the control period Tc2, the transmission gate TGb is in the ON state.

The drive waveform signal Com-A is supplied to one end of the transmission gate TGa. The drive waveform signal Com-B is supplied to one end of the transmission gate TGb. The drive waveform signal Com-C is supplied to one end of the transmission gate TGc. Other ends of the transmission gates TGa, TGb, and TGc are connected to each other.

The transmission gates TGa, TGb, and TGc are exclusively in the ON state. The drive waveform signal Com-A, Com-B, or Com-C selected for each control period Tc1 and each control period Tc2 is supplied as a drive signal Vin[m]. The drive signal Vin[m] is supplied to the m-th discharging portion D via the switching unit 53.

Figure 16:
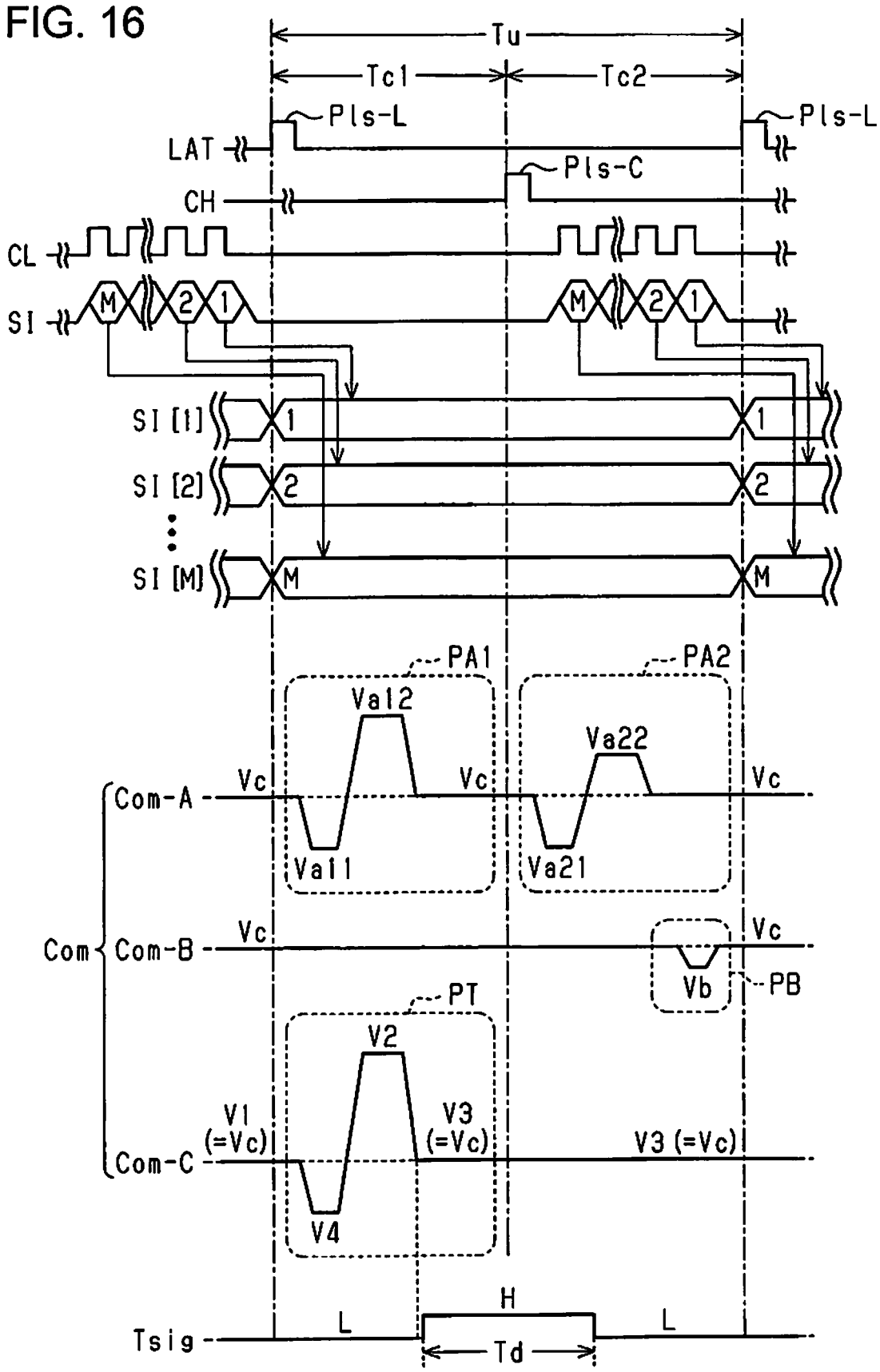
FIG. 16 is a timing chart illustrating a waveform of a drive waveform signal.

FIG. 16 is a timing chart illustrating an operation of the drive signal generation unit 51 in a unit operation period Tu. As illustrated in FIG. 16, the unit operation period Tu is defined by the latch signal LAT output by the controller 60. Each unit operation period Tu is defined by the latch signal LAT and the change signal CH and includes the control periods Tc1 and Tc2 having time lengths which are equal to each other.

As illustrated in FIG. 16, the drive waveform signal Com-A supplied from the controller 60 in the unit operation period Tu is a waveform obtained by linking a unit waveform PA1 (disposed in the control period Tc1 of the unit operation period Tu) and a unit waveform PA2 (disposed in the control period Tc2). All potentials at timings when the unit waveforms PA1 and PA2 start and end are intermediate potentials Vc. As illustrated in FIG. 16, a potential difference between a potential Vall and a potential Va12 of the unit waveform PA1 is greater than a potential difference between a potential Va21 and a potential Va22 of the unit waveform PA2. Therefore, the amount of the ink discharged from the nozzle N provided in each of the discharging portions D in a case where the piezoelectric element 200 provided in the corresponding discharging portion D is driven by the unit waveform PA1 is more than the amount of the ink discharged in a case where the piezoelectric element is driven by the unit waveform PA2.

The drive waveform signal Com-B supplied from the controller 60 in the unit operation period Tu is a waveform in which the potential is held to the intermediate potential Vc during the control period Tc1 and the unit waveform PB is disposed in the control period Tc2. All potentials at timings when the unit waveform PB starts and ends are intermediate potentials Vc. A potential difference between a potential Vb of the unit waveform PB and the intermediate potential Vc is smaller than the potential difference between the potential Va21 and the potential Va22 of the unit waveform PA2. Even in a case where the piezoelectric element 200 provided in each of the discharging portions D is driven by the unit waveform PB, the ink is not discharged from the nozzle N provided in the corresponding discharging portion D. Even in a case where the intermediate potential Vc is supplied to the piezoelectric element 200, the ink is not discharged from the nozzle N.

The drive waveform signal Com-C supplied from the controller 60 in the unit operation period Tu is a waveform which has a unit waveform PT disposed in the control period Tc1 and has an intermediate potential Vc held in the control period Tc2. A first potential V1 which is a potential at a start timing of the unit waveform PT is the intermediate potential Vc in this example. A third potential V3 which is a potential at an end timing of the unit waveform PT is the intermediate potential Vc in this example.

The unit waveform PT transitions from the first potential V1 to a second potential V2, transitions from the second potential V2 to the third potential V3, and then holds the third potential V3. In this example, the unit waveform PT transitions from the first potential V1 to the second potential V2 via a fourth potential V4. The drive waveform signal Com-C is selected when there is an attempt to check the discharge state of the ink. In this example, the first potential V1 and the third potential V3 are set to the intermediate potential Vc which is a potential to be held in the piezoelectric element 200 when the ink is not discharged.

As described above, the M latch circuits LT respectively output the printing signals SI[1], SI[2], . . . , and SI[M] at a rising timing of the latch signal LAT, that is, at a timing at which the unit operation period Tu (Tp or Tt) is started.

As described above, the m-th decoder DC outputs the selection signals Sa, Sb, and Sc based on the contents of the table illustrated in FIG. 15, in each control period Tc1 and each control period Tc2, in accordance with the printing signal SI[m].

As described above, the transmission gates TGa, TGb, and TGc at the m-th stage select any of the drive waveform signals Com-A, Com-B, and Com-C based on the selection signals Sa, Sb, and Sc and outputs the selected drive waveform signal Com as the drive signal Vin[m].

The waveform of the drive signal Vin output by the drive signal generation unit 51 in the unit operation period Tu will be described with reference to FIG. 17 in addition to FIGS. 14 to 16. In a case where the contents of the printing signal SI[m] supplied in the unit operation period Tu is (b1, b2, b3)=(1, 1, 0), the selection signals Sa, Sb, and Sc are respectively at the H level, the L level, and the L level in the control period Tc1 and the control period Tc2. Thus, the drive waveform signal Com-A is selected by the transmission gate TGa. As a result, the unit waveform PA1 and the unit waveform PA2 are output as the drive signal Vin[m]. In the control period Tc2, the selection signals Sa, Sb, and Sc are respectively at the H level, the L level, and the L level. Thus, the drive waveform signal Com-A is selected by the transmission gate TGa, and the unit waveform PA2 is output as the drive signal Vin[m].

As a result, in the m-th discharging portion D, in the unit operation period Tu, the ink of the substantially middle amount based on the unit waveform PA1 is discharged, and the ink of the substantially small amount based on the unit waveform PA2 is discharged. The inks discharged twice in this manner are combined on the recording paper P, and thus a large dot is formed on the recording paper P.

In a case where the contents of the printing signal SI[m] supplied in the unit operation period Tu is (b1, b2, b3)=(1, 0, 0), the selection signals Sa, Sb, and Sc are respectively at the H level, the L level, and the L level in the control period Tc1. Thus, the drive waveform signal Com-A is selected by the transmission gate TGa. As a result, the unit waveform PA1 is output as the drive signal Vin[m]. In the control period Tc2, the selection signals Sa, Sb, and Sc are respectively at the L level, the H level, and the L level. Thus, the drive waveform signal Com-B is selected by the transmission gate TGb, and the unit waveform PB is output as the drive signal Vin[m]. As a result, in the m-th discharging portion D, in the unit operation period Tu, the ink of the substantially middle amount based on the unit waveform PA1 is discharged, and thus a middle dot is formed on the recording paper P.

In a case where the contents of the printing signal SI[m] supplied in the unit operation period Tu is (b1, b2, b3)=(0, 1, 0), the selection signals Sa, Sb, and Sc are respectively at the L level, the H level, and the L level in the control period Tc1. Thus, the drive waveform signal Com-B is selected by the transmission gate TGb. Therefore, in the control period Tc1, a signal having a waveform of a predetermined potential Vc is output as the drive signal Vin[m]. In the control period Tc2, the selection signals Sa, Sb, and Sc are respectively at the H level, the L level, and the L level. Thus, the drive waveform signal Com-A is selected by the transmission gate TGa. Therefore, in the control period Tc2, the unit waveform PA2 is output as the drive signal Vin[m]. As a result, in the m-th discharging portion D, in the unit operation period Tu, the ink of the substantially small amount based on the unit waveform PA2 is discharged. Thus, a small dot is formed on the recording paper P.

In a case where the contents of the printing signal SI[m] supplied in the unit operation period Tu is (b1, b2, b3)=(0, 0, 0), the selection signals Sa, Sb, and Sc are respectively at the L level, the H level, and the L level in the control periods Tc1 and Tc2. Thus, the drive waveform signal Com-B is selected by the transmission gate TGb. Therefore, in the control periods Tc1 and Tc2, the unit waveform PB is output as the drive signal Vin[m]. As a result, in the unit operation period Tu, the ink is not discharged from the m-th discharging portion D, and a dot is not formed on the recording paper P.

In a case where the contents of the printing signal SI[m] supplied in the unit operation period Tu is (b1, b2, b3)=(0, 0, 1), the selection signals Sa, Sb, and Sc are respectively at the L level, the L level, and the H level in the control periods Tc1 and Tc2. Thus, the drive waveform signal Com-C is selected by the transmission gate TGc. Therefore, in the control periods Tc1 and Tc2, the unit waveform PT is output as the drive signal Vin[m]. As a result, in the unit operation period Tu, the ink for checking is discharged from the m-th discharging portion D, and the discharge state of the ink is checked.

Here, in a case where the drive signal Vin is supplied to the piezoelectric element 200, a mode in which a droplet is discharged from the nozzle N is defined as the discharge mode. In a case where the drive signal Vin is supplied to the piezoelectric element 200, a mode in which a droplet is not discharged from the nozzle N is defined as the non-discharge mode. That is, as a mode for defining discharge or non-discharge (also referred to as "a discharge/non-discharge mode), the discharge mode in which liquid is discharged and the non-discharge mode in which the liquid is not discharged are provided. In FIG. 17, the drive signal Vin[m] when the printing signal SI[m] is (1, 1, 0), (1, 0, 0), (0, 1, 0), or (0, 0, 1) belongs to the discharge mode. The drive signal Vin[m] when the printing signal SI[m] is (0, 0, 0) belongs to the non-discharge mode.

In the embodiment, a checking drive signal Vin including a unit waveform PT for checking is used in at least paper dust checking in which it is checked whether or not paper dust Pe adheres. When the occurrence of a discharge abnormality caused by a cause such as bubbles B or dry other than the paper dust Pe is checked, a paper-dust checking drive signal Vin is commonly used or another drive signal Vin is used. In this example, a signal having the same discharge/non-discharge mode as that of the paper-dust checking drive signal Vin among printing drive signals Vin is used as this another drive signal Vin. For example, in FIG. 17, the drive signal Vin[m] when the printing signal SI[m] is (1, 0, 0) is used as this another drive signal Vin. In this case, a period after the unit waveform PA1 and before the unit waveform PB serves as a detection period Td. A potential difference |V2−V3| between the second potential V2 and the third potential V3 in the paper-dust checking drive signal Vin is set to be greater than a potential difference |Va12−Vc| between the second potential Va12 and the third potential Vc in another drive signal Vin having the same discharge/non-discharge mode as that of the paper-dust checking drive signal Vin. The potential difference |V1−V2| between the first potential V1 and the second potential V2 in the paper-dust checking drive signal Vin is set to be greater than a potential difference |Vc−Va12| between the first potential Vc and the second potential Va12 in another drive signal Vin. A method of setting the second potential V2 and the second potential Va12 to be values different from each other, a method of setting the third potential V3 and the third potential Vc to be values different from each other, and a method of employing both the above two methods are provided for satisfying the conditions for the potential difference between the paper-dust checking drive signal Vin and another drive signal Vin.

The drive signal Vin for paper dust checking will be described below with reference to FIGS. 18 to 21. In FIGS. 18 to 21, the paper-dust checking drive signal Vin[m] is referred to as "a first drive signal VinA", and another drive signal Vin[m] having the same discharge/non-discharge mode as that of the first drive signal VinA is referred to as "a second drive signal VinB". The first drive signal VinA illustrated in FIGS. 18 to 21 and the second drive signal VinB indicated by a two-dot chain line in FIGS. 18 to 21 are signals in the discharge mode in which liquid is discharged. In the following descriptions, the ink may be referred to as "liquid" which is the generic term of the ink.

Figure 17:
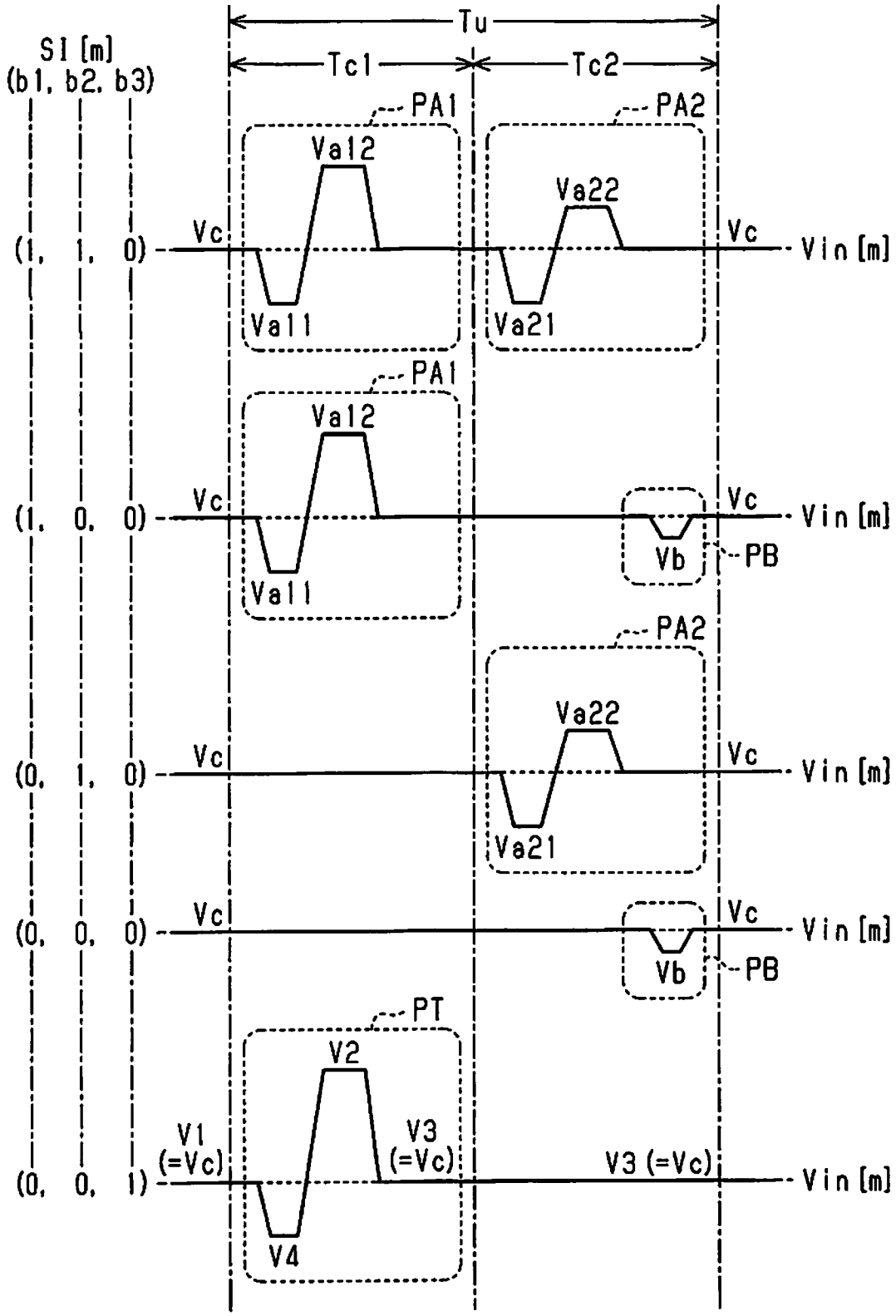
FIG. 17 is a timing chart illustrating a waveform of a drive signal.
Figure 18:
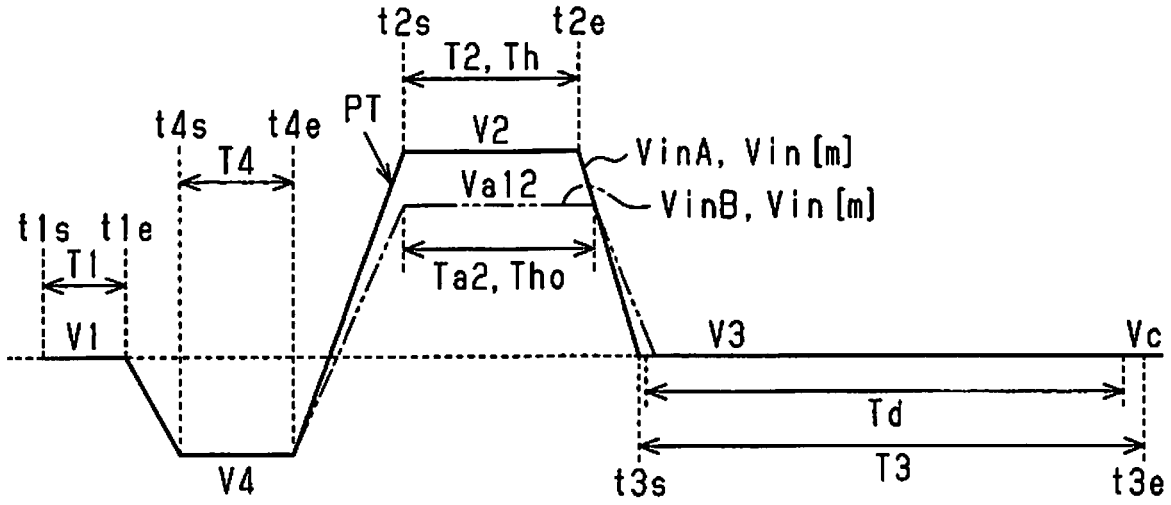
FIG. 18 is a timing chart illustrating a first drive signal.

FIG. 18 illustrates the first drive signal VinA (Vin[m]) for paper dust checking, which is illustrated in FIG. 17). The first drive signal VinA illustrated in FIG. 18 is just an example, and thus can be replaced with the first drive signal VinA illustrated in FIGS. 19 to 21. Here, the intermediate potential Vc is a potential corresponding to the reference volume of the cavity 264. The volume of the cavity 264 when the drive signal Vin supplied to the piezoelectric element 200 has the intermediate potential Vc is the reference volume. The diaphragm 265 is excited in a manner that the drive signal Vin is supplied to the piezoelectric element 200, and the volume of the cavity 264 increases or decreases in comparison to the reference volume. A voltage applied to the piezoelectric element 200 is determined by the potential of the drive signal VinA and the reference potential VSS. A voltage applied to the piezoelectric element 200 when the drive signal Vin has the intermediate potential Vc may be 0 Volts or may be a positive or negative voltage.

FIG. 18 illustrates the waveform of the first drive signal VinA. As illustrated in FIG. 18, the first drive signal VinA has the first potential V1 in a first period T1 from a time point t1*s* to a time point tie, has the second potential V2 in a second period T2 from a time point t2*s* to a time point t2*e*, and has the third potential V3 in a third period T3 from a time point t3*s* to a time point t3*e*. The first drive signal VinA transitions from the first potential V1 to the second potential V2, and then transitions from the second potential V2 to the third potential V3. In this example, the first potential V1 is equal to the third potential V3. In this example, the first drive signal VinA transitions from the first potential V1 to the second potential V2 via the fourth potential V4. The first drive signal VinA has the fourth potential V4 in a fourth period T4 from a time point t4*s* to a time point t4*e*. That is, the first drive signal VinA transitions from the first potential V1 to the fourth potential v4, transitions from the fourth potential V4 to the second potential V2, and then transitions from the second potential V2 to the third potential V3. The first potential V1 is a potential between the second potential V2 and the fourth potential V4. The third potential V3 is a potential between the second potential V2 and the fourth potential V4. A predetermined period just after a transition from the second potential V2 to the third potential V3 has been performed serves as the detection period Td in which residual vibration is detected. The detection period Td belongs to the third period T3.

In this example, charges charged in the piezoelectric element 200 in a period from the time point tie to the time point t4*s*, in which transitions from the first potential V1 to the fourth potential V4 is performed are discharged. As a result, the piezoelectric element 200 is excited so as to draw the meniscus in the nozzle N toward the cavity 264. Then, the first drive signal VinA holds the fourth potential V4 in the fourth period T4, and transitions from the fourth potential V4 to the second potential V2 in a period from the time point t4*e* to the time point t2*s*. Charges are charged in the piezoelectric element 200 in a period from the time point t4*e* to the time point t2*s*. As a result, the piezoelectric element 200 is excited so as to perform displacement in a direction in which the meniscus in the nozzle N is pushed out of the cavity 264. The second potential V2 is set to discharge a droplet from the nozzle N.

Then, the first drive signal VinA holds the second potential V2 in the second period T2 and transitions from the second potential V2 to the third potential V3 in a period from the time point t2*e* to the time point t3*s*. Charges are charged in the piezoelectric element 200 in a period from the time point t2*e* to the time point t3*s*. As a result, the piezoelectric element 200 is excited so as to draw the meniscus in the nozzle N toward the cavity 264. The vibration in the drawing direction is a vibration opposing a vibration in a pushout direction when the first drive signal VinA transitions from the fourth potential V4 to the second potential. Thus, the vibration in the drawing direction functions as vibration damping of suppressing a vibration by vibrating the tip of the liquid in the cavity 264. In this specification, excitation in a direction in which the piezoelectric element 200 pushes the liquid in the cavity 264 toward the opening of the nozzle N is referred to as "Push". Excitation in a direction in which the piezoelectric element 200 pulls the liquid toward an opposite side of the discharge direction of the nozzle N is referred to as "Pull".

As illustrated in FIG. 18, the second potential V2 of the first drive signal VinA is greater than the second potential Va12 (see FIG. 17) of the second drive signal VinB. Therefore, the potential difference |V2−V1| between the first potential V1 and the second potential V2 in the first drive signal VinA is greater than the potential difference |Va12−Vc| between the first potential Vc and the second potential Va12 in the second drive signal VinB. In this example in which the signal transitions from the first potential V1 to the second potential V2 via the fourth potential V4, the potential difference |V2−V4| between the fourth potential V4 and the second potential V2 in the first drive signal VinA is greater than the potential difference |Va12−Va11| between the fourth potential Va11(=V4) and the second potential Va12 (both see FIG. 17) in the second drive signal VinB. Thus, an excitation force at the time of Push driving when the first drive signal VinA is supplied to the piezoelectric element 200 and transitions from the fourth potential V4 to the second potential V2 is set to be larger than an excitation force at the time of Push driving when the second drive signal VinB is supplied to the piezoelectric element 200 and transitions from the fourth potential Va11 to the second potential Va12. As described above, since Pull driving is performed in a period from the time point t1*e* to the time point t4*s* just before Push driving, a large potential difference at the time of Push driving, which is from the next time point t4*e* to the time point t2*s*, is secured. Thus, an excitation force which is larger than that in a case where the signal does not pass through the fourth potential V4 in the process of transitioning from the first potential V1 to the second potential V2 is obtained.

The potential difference |V2−V3| between the second potential V2 and the third potential V3 in the first drive signal VinA is greater than the potential difference |Va12−Vc| between the second potential Va12 and the third potential Vc in the second drive signal VinB. Thus, an excitation force at the time of Pull driving when the first drive signal VinA is supplied to the piezoelectric element 200 and transitions from the second potential V2 to the third potential V3 is set to be larger than an excitation force when the second drive signal VinB is supplied to the piezoelectric element 200 and transitions from the second potential Va12 to the third potential Vc. As described above, since the first drive signal VinA illustrated in FIG. 18 is supplied so as to perform Pull-Push-Pull driving of the piezoelectric element 200, preliminary excitation in which the liquid in the cavity 264 is attracted in a direction (reverse discharge direction)

opposite to the discharge direction, excitation in which the liquid is pushed in the discharge direction, and damping in which the liquid is attracted in the reverse discharge direction are sequentially applied. Thus, the liquid in the nozzle N is vibrated with a large amplitude in the discharge direction, and thus droplets for checking are discharged from the nozzle N. As described above, just before discharge of the liquid completes, a force drawing the liquid in the nozzle N toward the cavity 264 acts.

Here, the first drive signal VinA illustrated in FIG. 18 is just an example. The first drive signal VinA may be replaced with a drive signal having another waveform, so long as the potential difference between the second potential V2 and the third potential V3 is greater than the potential difference between the second potential Va12 and the third potential Vc in the second drive signal VinB. An example of another first drive signal VinA will be described below.

Figure 19:
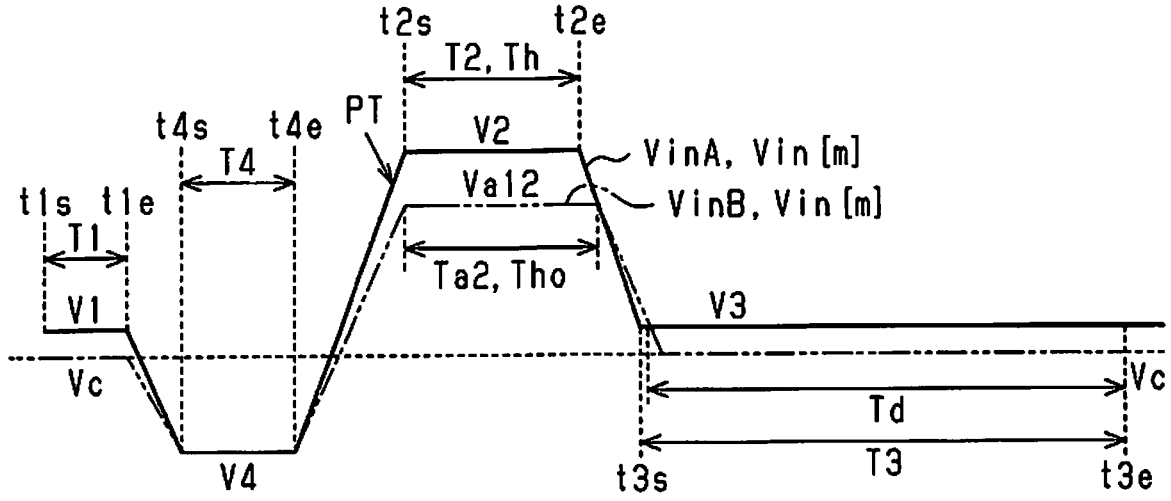
FIG. 19 is a timing chart illustrating the first drive signal different from that in FIG. 18.

The first drive signal VinA illustrated in FIG. 19 has the first potential V1, the second potential V2, and the third potential V3 which are greater than those of the second drive signal VinB having a waveform indicated by a two-dot chain line in FIG. 19, by a predetermined voltage. In the example illustrated in FIG. 19, the first potential V1 and the third potential V3 of the first drive signal VinA are potentials between the intermediate potential Vc and the second potential V2. The potential difference between the second potential V2 and the second potential Va12 is greater than the potential difference between the first potential V1 and the first potential Vc. The first potential V1 is equal to the third potential V3. Therefore, the potential difference |V2−V3| between the second potential V2 and the third potential V3 in the first drive signal VinA is greater than the potential difference |Va12−Vc| between the second potential Va12 and the third potential Vc in the second drive signal VinB. The potential difference |V2−V1| between the first potential V1 and the second potential V2 in the first drive signal VinA is greater than the potential difference |Va12−Vc| between the first potential Vc and the second potential Va12 in the second drive signal VinB. Further, since the signal transitions from the first potential V1 to the second potential V2 via the fourth potential V4, the potential difference |V2−V4| between the fourth potential V4 and the second potential V2 in the first drive signal VinA is greater than the potential difference |Va12−V4| between the fourth potential Va11 (=V4) and the second potential Va12 in the second drive signal VinB.

Figure 20:
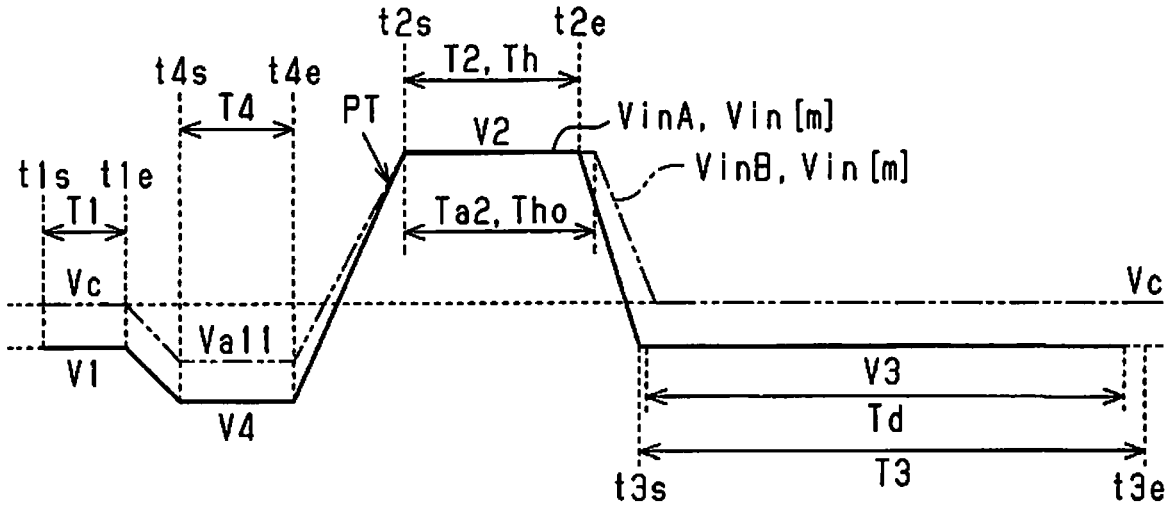
FIG. 20 is a timing chart illustrating the first drive signal different from that in FIG. 19.
Figure 21:
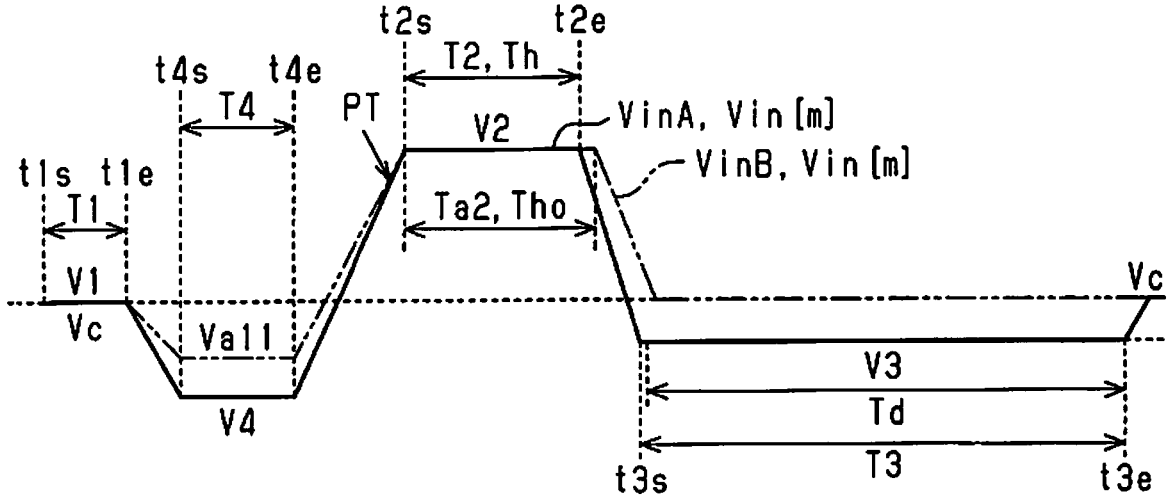
FIG. 21 is a timing chart illustrating the first drive signal different from that in FIG. 20.

In the drive signal VinA illustrated in FIGS. 20 and 21, the third potential V3 is set to a potential causing the intermediate potential Vc to be interposed between the third potential V3 and the second potential V2. In the drive signal VinA illustrated in FIG. 20, the first potential V1 is equal to the third potential V3. The second drive signal VinB indicated by a two-dot chain line in FIGS. 20 and 21 has a first potential Vc and a third potential Vc which are equal to the intermediate potential Vc. Therefore, the third potential V3 of the first drive signal VinA is different from the third potential Vc of the second drive signal VinB. In FIGS. 20 and 21, the second potential V2 of the first drive signal VinA is equal to the second potential Va12 (see FIG. 17) of the second drive signal VinB. That is, the third potential V3 of the first drive signal VinA is set to a potential causing the third potential Vc of the second drive signal VinB to be interposed between the third potential V3 and the second potential V2 which is equal to the second potential Va12 of the second drive signal VinB. Thus, the potential difference |V2−V3| between the second potential V2 and the third potential V3 in the first drive signal VinA is set to be greater than the potential difference |Va12−Vc| between the second potential Va12 and the third potential Vc in the second drive signal VinB.

The first drive signal VinA illustrated in FIGS. 20 and 21 transitions from the first potential V1 to the second potential V2 via the fourth potential V4. The fourth potential V4 is a potential causing the first potential V1 to be interposed between the fourth potential V4 and the second potential V2. The fourth potential V4 is a potential causing the first potential V1 to be interposed between the fourth potential V4 and the intermediate potential Vc. The fourth potential V4 of the first drive signal VinA is a potential causing the fourth potential Va11 of the second drive signal VinB to be interposed between the fourth potential V4 and the intermediate potential Vc. Therefore, the potential difference |V2−V4| at the time of Push driving in which the first drive signal VinA transitions from the fourth potential V4 to the second potential V2 is greater than the potential difference |V2−Va11| when the second drive signal VinB transitions from the fourth potential Va11 to the second potential. Therefore, it is possible to strongly excite the liquid in the cavity 264 at the time of Push driving, in comparison to the second drive signal VinB. The potential difference |V2−V3| at the time of Pull driving when the first drive signal VinA illustrated in FIG. 20 transitions from the second potential V2 to the third potential V3 after the second period T2 has elapsed after Push driving is greater than the potential difference |Va12−Vc| when the second drive signal VinB transitions from the second potential Va12 to the third potential Vc. Thus, at the time of Pull driving in which the first drive signal VinA transitions from the second potential V2 to the third potential V3, a drawing force which is larger than that at the time of driving when the second drive signal VinB transitions from the second potential Va12 (=V2) to the third potential Vc can be applied to the liquid in the cavity 264. In the first drive signal VinA which is a drive signal in the discharge mode, a large drawing force is applied at the time of Pull driving. Thus, it is possible to cut out the liquid in the nozzle N at a position nearer to the cavity 264. Therefore, at the normal time, the meniscus position in the nozzle N just after discharging of a droplet can be positioned more on the back side of the nozzle N.

The second potential V2, the third potential V3, and the fourth potential V4 in the first drive signal VinA illustrated in FIG. 21 are equal to those of the first drive signal VinA illustrated in FIG. 20. However, the first potential V1 in the first drive signal VinA illustrated in FIG. 21 is different from the first potential V1 of the first drive signal VinA illustrated in FIG. 20. Therefore, in the first drive signal VinA illustrated in FIG. 21, the first potential V1 is different from the third potential. The first potential V1 in the first drive signal VinA illustrated in FIG. 21 is a potential between the second potential v2 and the third potential v3.

As described above, in the first drive signal VinA illustrated in FIGS. 18 and 19, the second potential V2 is set to a potential allowing a potential difference at the time of Push driving and a potential difference at the time of Pull driving to be largely secured relative to the second potential Va12 of the second drive signal VinB. Thus, at the normal time, the meniscus position just after discharge of a droplet is positioned on the back side of the nozzle N than that when the second drive signal VinB is supplied. In the first drive signal VinA illustrated in FIGS. 20 and 21, the third potential V3 is set to a potential allowing a potential difference at the time of Pull driving to be largely secured relative to the third potential Vc of the second drive signal VinB. Thus, at the normal time, the meniscus position just after discharge of a droplet is positioned on the back side of the nozzle N than that when the second drive signal VinB is supplied. As described above, in the first drive signal VinA illustrated in FIGS. 18 to 21, the potential difference at time of excitation in which the liquid in the cavity 264 is pushed in the discharge direction and the potential difference at time of excitation in which the liquid in the cavity 264 is pulled toward the opposite side of the discharge direction are greater than the corresponding potential differences in the second drive signal VinB indicated by the two-dot chain line in FIGS. 18 to 21. Therefore, in the normal time, the amplitude of the liquid level in the nozzle N when the liquid in the cavity 264 is excited by supplying the first drive signal VinA to the piezoelectric element 200 is larger than the amplitude of the liquid level in the nozzle N when the liquid in the cavity 264 is excited by supplying the second drive signal VinB to the piezoelectric element 200. In the first drive signal VinA, at least the potential difference in pulling excitation among the potential difference in pushing excitation and the potential difference in pulling excitation may be greater than the potential difference in the second drive signal VinB in pulling excitation.

A timing at which the liquid in the cavity 264 is drawn in Pull driving next to Push driving is set to a timing at which a vibration of a pressure wave propagating to the liquid in the cavity 264 by excitation at time of Push driving is suppressed. The timing in Pull driving is defined by a first holding time Th which is a holding time of the second potential V2 of the first drive signal VinA, which is held in the second period T2. In this case, a force of drawing toward the opposite side of the discharge direction is applied to the diaphragm 265 at a timing in a predetermined period including a time point at which the phase of the pressure wave in the liquid in the cavity 264 turns from the discharge direction to the reverse discharge direction. Thus, the vibration of the liquid in the cavity 264 by excitation at the time of Push driving is damped. Therefore, the liquid in the nozzle N is cut out at a position of an inside toward the cavity 264 and is discharged in a form of a droplet. For example, in a case where the timing at which the liquid in the cavity 264 is drawn is before the phase of the pressure wave turns to the reverse discharge direction, the damping force of the liquid increases, and thus the amount of droplets discharged from the nozzle N increases. In a case where this timing is after the phase of the pressure wave turns to the reverse discharge direction, the force of drawing the liquid in the cavity 264 is accelerated. Even in any case, in the normal time, the liquid level position in the nozzle N just after discharge of a droplet can be more drawn to the back side of the nozzle N. Meanwhile, the droplet is set to have a discharge amount depending on a required dot size, or a separation of a droplet, which allows suppression of mist is performed, and then a second holding time Tho at which the second drive signal VinB is held to the second potential Va12 is set.

In the embodiment, the discharge abnormality checking is performed with a first checking method or a second checking method. The first checking method is a checking method in which first checking and second checking is performed with the common first drive signal VinA. In the first checking, it is checked whether or not a first discharge abnormality caused by foreign substances such as paper dust Pe, which have adhered to the head surface 261 on which the nozzle N opens, occurs. In the second checking, it is checked whether or not a second discharge abnormality caused by the cause other than the foreign substances such as paper dust Pe occurs. The second checking method is a checking method in which the first checking is performed with the first drive signal VinA and the second checking is performed with the second drive signal VinB.

In a case of the first checking method any one of the first drive signals VinA illustrated in FIGS. 18 to 21 is used as the common drive signal for the first checking and the second checking. The second drive signal VinB indicated by the two-dot chain line illustrated in FIGS. 18 to 21 functions as a drive signal for printing. In a case of the second checking method, any one of the first drive signals VinA illustrated in FIGS. 18 to 21 is used in the first checking, and the second drive signal VinB indicated by the two-dot chain line illustrated in FIGS. 18 to 21 is used in the second checking. The second drive signal VinB indicated by the two-dot chain line illustrated in FIGS. 18 to 21 corresponds to the drive signal Vin[m] for a middle dot, which is illustrated in FIG. 17. That is, the second drive signal VinB is a drive signal Vin[m] which is the same as the drive signal in printing, which includes the largest second potential Va12 among a plurality of drive signals belonging to the discharge mode illustrated in FIG. 17.

In a case of the first checking method, the common first drive signal VinA is used in the first checking and the second checking. In this case, the potential difference |V2−V3| between the second potential V2 and the third potential V3 of the first drive signal VinA for checking is greater than the potential difference |Va12−Vc| between the second potential Va12 and the third potential Vc of the second drive signal VinB for printing.

In a case of the second checking method, the first drive signal VinA is used in the first checking, and the second drive signal VinB is used in the second checking. In this case, the potential difference |V2−V3| between the second potential V2 and the third potential V3 of the first drive signal VinA for the first checking is greater than the potential difference |Va12−Vc| between the second potential Va12 and the third potential Vc of the second drive signal VinB for the second checking. In a case of the second checking method, the potential difference between the second potential and the third potential of the second drive signal VinB for the second checking may be different from the potential difference between the second potential and the third potential of the printing drive signal Vin[m].

A potential difference (voltage) between the reference potential VSS applied as a bias potential to the lower electrode 201 and the potential of the drive signal Vin supplied to the upper electrode 202 is applied to the piezoelectric element 200. The reference potential VSS is set to 0 Volts or a positive potential, for example. The intermediate potential Vc corresponding to the reference volume of the discharging portion D is equal to the reference potential VSS or is set to a potential between the reference potential VSS and the second potential V2. The reference potential VSS may be appropriately set in accordance with the characteristics of the piezoelectric element 200 and may be a negative potential, for example.

In a case of the first drive signal VinA illustrated in FIGS. 20 and 21, the third potential V3 is set to a potential between the intermediate potential Vc and the reference potential VSS. Specifically, as illustrated in FIG. 3, the piezoelectric element 200 includes the lower electrode 201 to which the reference potential VSS is supplied, and the upper electrode 202 to which the drive signal Vin including the first drive signal VinA and the second drive signal VinB is supplied. The first potential V1 and the third potential V3 in the first drive signal VinA illustrated in FIGS. 20 and 21 are set to a potential in a range of the intermediate potential Vc side corresponding to the reference volume of the cavity 264, rather than the reference potential VSS. In particular, the third potential V3 in the first drive signal VinA illustrated in FIGS. 18 and 19 is a potential causing the intermediate potential Vc to be interposed between the third potential V3 and the second potential V2. Thus, the third potential V3 is set to a potential between the intermediate potential Vc and the reference potential VSS. In the first drive signal VinA illustrated in FIG. 18, the first potential V1 is also set to a potential between the intermediate potential Vc and the reference potential VSS. The reason of setting described above is as follows. In the first period T1 and the third period T3 in which the first potential V1 and the third potential V3 are supplied to the piezoelectric element 200, application of a reverse bias to the piezoelectric element 200 is avoided, and induction of polarization collapse of the piezoelectric element 200 or failure caused by cracks or the like which occur by excessive stress distortion of the piezoelectric element 200 is prevented.

In the embodiment, the first holding time Th held to the second potential V2 preferably has a value in a range satisfying a condition of $Tc/2-Tc/4<Th\leq Tc+\alpha$ when the natural vibration period of the cavity 264 is set as Tc. $\alpha$ indicates a margin value and indicates a value satisfying $0<\alpha\leq Tc/10$, for example. The reason that the first holding time Th is set to the value in the range satisfying the condition is as follows. Pressure in the cavity 264 excited by the piezoelectric element 200 at the time of Push driving increases or decreases in synchronization with the natural vibration period Tc. In this case, the pressure in the cavity 264 turns from an increase to a decrease at a timing at which the first holding time Th reaches Tc/2. Starting Pull driving at a timing in a predetermined period including a time point at which the pressure in the cavity 264 turns from an increase to a decrease is preferable because the liquid in the nozzle N is cut out at the position on the back side. The first holding time Th is set to have a value appropriate for improving check accuracy of the paper dust checking, in the range. The first holding time Th is different from the second holding time Tho in which the second drive signal VinB is held to the second potential Va12. Only in a case where check accuracy of the paper dust checking is improved, the first holding time Th may have a value out of the above range or have a value equal to the second holding time Tho.

In the printer 11, the discharging portion D is driven by the first drive signal VinA for checking, which is generated by the drive signal generation unit 51 and is illustrated in FIGS. 18 to 21. The discharge abnormality detection unit 52 detects the change of the electromotive force of the piezoelectric element 200 based on the change of pressure in the cavity 264 of the discharging portion D, which occurs as a result of the driving the discharging portion D. The change of the electromotive force is detected in a form of the residual vibration signal Vout. The discharge abnormality detection unit 52 performs discharge abnormality detection processing of determining whether or not a discharge abnormality occurs in the discharging portion D, based on the residual vibration signal Vout.

Figure 22:
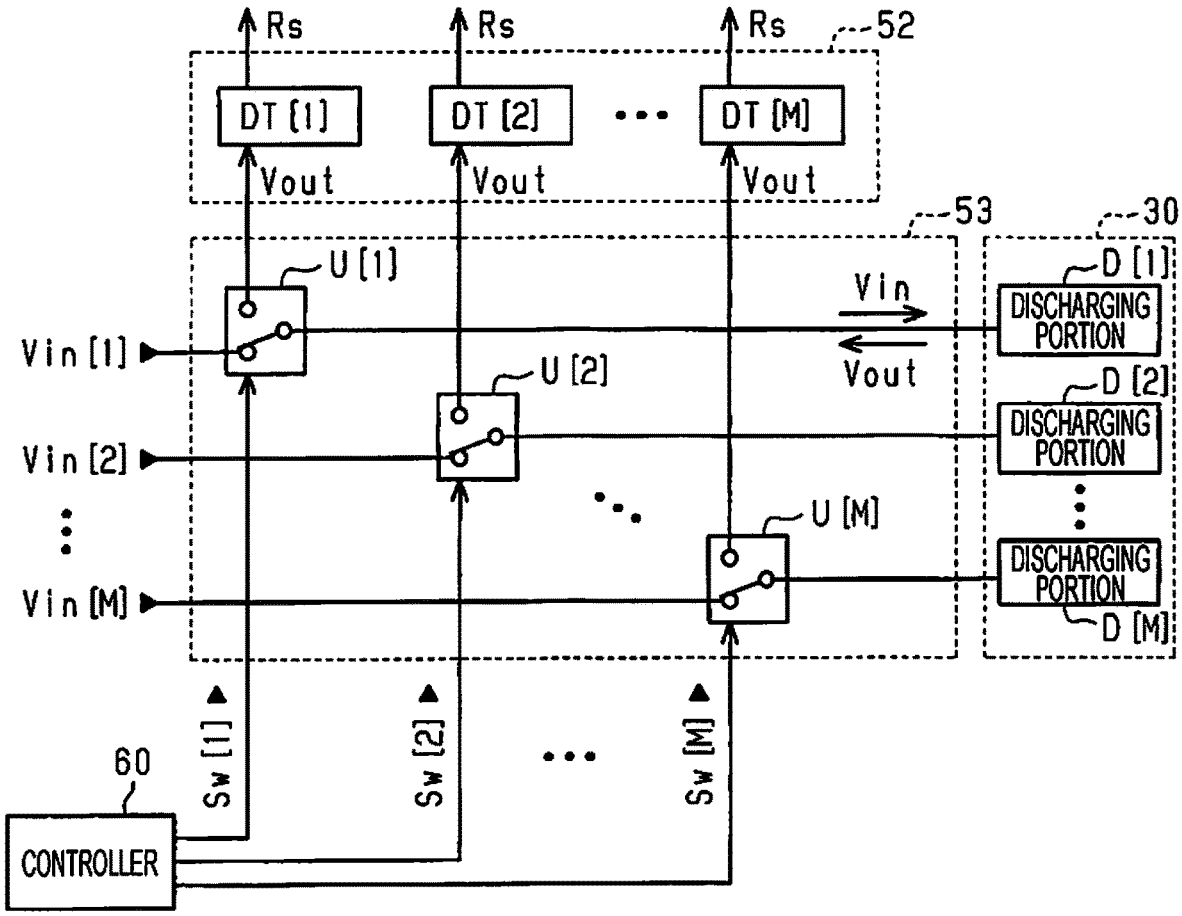
FIG. 22 is a circuit diagram illustrating a connection relation between a switching unit and a peripheral circuit such as a discharge abnormality detection unit.

Next, a configuration for the discharge abnormality detection processing will be described with reference to FIGS. 22 to 24. FIG. 22 illustrates the configuration of the switching unit 53 in the head driver 50 and an electrical connection relation between the switching unit 53 and the peripheral circuit. As illustrated in FIG. 22, the switching unit 53 includes M pieces, that is, first to M-th switching circuits U (U[1], U[2], . . . , and U[M]) corresponding to the M discharging portions D in one-to-one. The m-th switching circuit U[m] electrically connects the m-th discharging portion D to any one of a wiring on which the drive signal Vin[m] is supplied or the discharge abnormality detection circuit DT provided in the discharge abnormality detection unit 52. In the following descriptions, a state in which the discharging portion D and the drive signal generation unit 51 are electrically connected to each other in each of the switching circuits U is referred to as a first connection state. A state where the discharging portion D is electrically connected to the discharge abnormality detection circuit DT of the discharge abnormality detection unit 52 is referred to as a second connection state.

The controller 60 supplies a switching control signal Sw[m] for controlling the connection state of the switching circuit U[m], to the m-th switching circuit U[m]. Specifically, the controller 60 outputs switching control signals Sw[1], Sw[2], . . . , and Sw[M] in the unit operation period Tu such that the switching circuit corresponding to the discharging portion D by which printing is performed is in the first connection state, and the switching circuit corresponding to the discharging portion D as a target of checking is in the second connection state. That is, in the unit operation period Tu, the switching control signals Sw for the first connection state and the second connection state may be mixed, all the switching control signals Sw may designate the first connection state, and all the switching control signals Sw may designate the second connection state.

Figure 23:
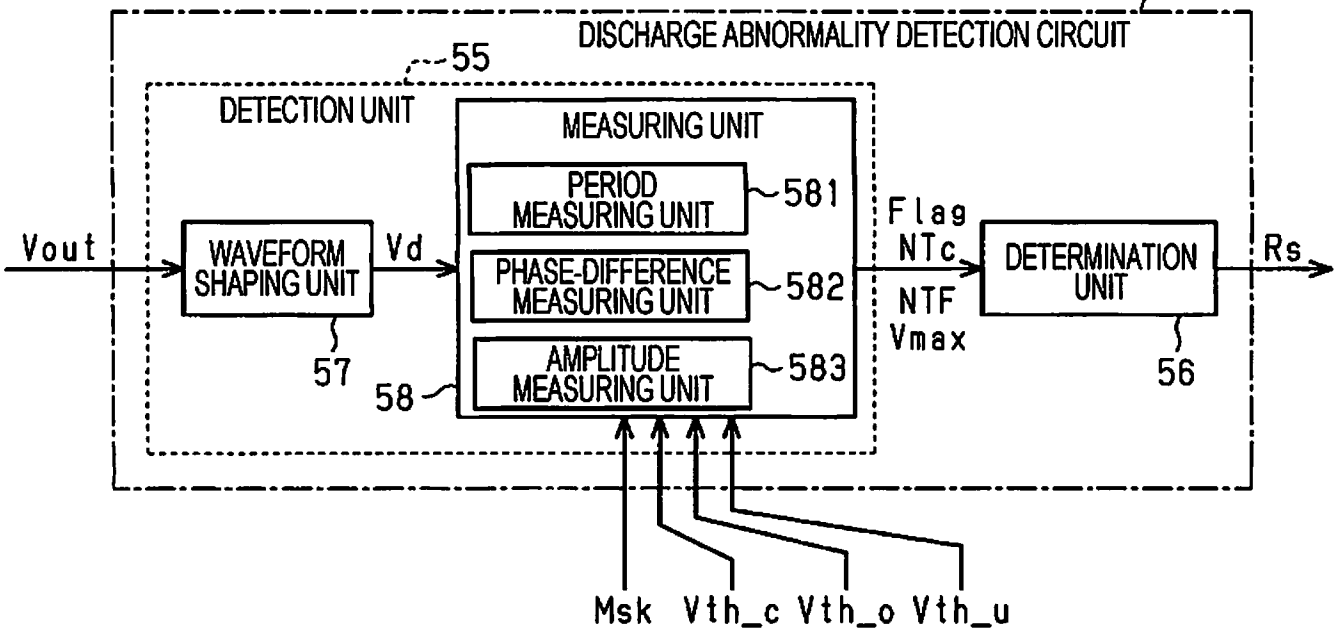
FIG. 23 is a block diagram illustrating a configuration of a discharge abnormality detection circuit.

FIG. 23 illustrates a configuration of the discharge abnormality detection circuit DT provided in the discharge abnormality detection unit 52 in the head driver 50. As illustrated in FIG. 23, the discharge abnormality detection circuit DT includes a detection unit 55 and a determination unit 56. The detection unit 55 outputs a physical quantity regarding a waveform having features in the residual vibration of the discharging portion D, as a detection signal, based on the residual vibration signal Vout. The determination unit 56 determines whether or not a discharge abnormality occurs in the discharging portion D, based on the detection signal. The determination unit determines the cause in a case where the discharge abnormality occurs, and outputs a determination result signal Rs indicating a determination result. The detection unit 55 outputs a period NTc, a phase difference NTF, and an amplitude Vmax of the residual vibration of the discharging portion D, based on the residual vibration signal Vout. The period NTc indicates a time length for one period in a residual vibration of the discharging portion D. The phase difference NTF indicates a difference between the phase of the residual vibration detected in the discharging portion D and the phase of the residual vibration in the normal time. The detection unit 55 includes a waveform shaping unit 57 and a measuring unit 58. The waveform shaping unit 57 generates a shaped waveform signal Vd obtained by removing a noise component and the like from the residual vibration signal Vout output from the discharging portion D. The measuring unit 58 generates a detection signal based on the shaped waveform signal Vd.

The waveform shaping unit 57 includes a high pass filter or a low pass filter, for example. The high pass filter is used for outputting a signal obtained by attenuating a frequency component in a frequency band lower than a frequency band of the residual vibration signal Vout. The low pass filter is used for outputting a signal obtained by attenuating a frequency component in a frequency band higher than the frequency band of the residual vibration signal Vout. The waveform shaping unit 57 has a configuration capable of limiting a frequency range of the residual vibration signal Vout and outputting the shaped waveform signal Vd obtained by removing the noise component. The waveform shaping unit 57 may have a configuration in which a negative feedback type amplifier for regulating the amplitude of the residual vibration signal Vout, a voltage follower for converting the impedance of the residual vibration signal Vout and outputting a shaped waveform signal Vd having low impedance, and the like are provided.

The shaped waveform signal Vd from the waveform shaping unit 57, a mask signal Msk generated by the controller 60, a threshold potential Vth_c determined to be a potential at the center level of the amplitude of the shaped waveform signal Vd, a threshold potential Vth_o determined to be a potential higher than the threshold potential Vth_c, and a threshold potential Vth_u determined to be a potential lower than the threshold potential Vth_c are supplied to the measuring unit 58. The measuring unit 58 outputs a validity flag Flag based on the signals Vd and Msk and the threshold potentials Vth_c, Vth_o, and Vth_u which have been input. The validity flag Flag indicates whether or not the shaped waveform signal Vd is valid when discharge abnormality detection is performed.

As illustrated in FIG. 23, the measuring unit 58 includes a period measuring unit 581, a phase-difference measuring unit 582, and an amplitude measuring unit 583. The phase-difference measuring unit 582 and the amplitude measuring unit 583 are used in at least paper dust checking. The period measuring unit 581 measures the period NTc of the residual vibration. Specifically, the period measuring unit 581 measures the period NTc of the shaped waveform signal Vd after a mask period ends, based on the signals Vd and Msk and the threshold potential Vth_c which have been input. The phase-difference measuring unit 582 measures a phase difference NTF in the paper dust checking. The phase difference NTF is a difference between the phase of a vibration waveform of the residual vibration when discharge abnormality is detected and the phase of a vibration waveform of the residual vibration in the normal time, which has been set in advance. The amplitude measuring unit 583 measures the amplitude Vmax of the residual vibration. The amplitude measuring unit 583 measures a difference between the threshold potential vth_c and the highest potential of the residual vibration. The threshold potential Vth_c is determined to a potential at the center level of the amplitude of the shaped waveform signal Vd. In this manner, the measuring unit 58 outputs the validity flag Flag, the period NTc, the phase difference NTF, and the amplitude Vmax.

Figure 24:
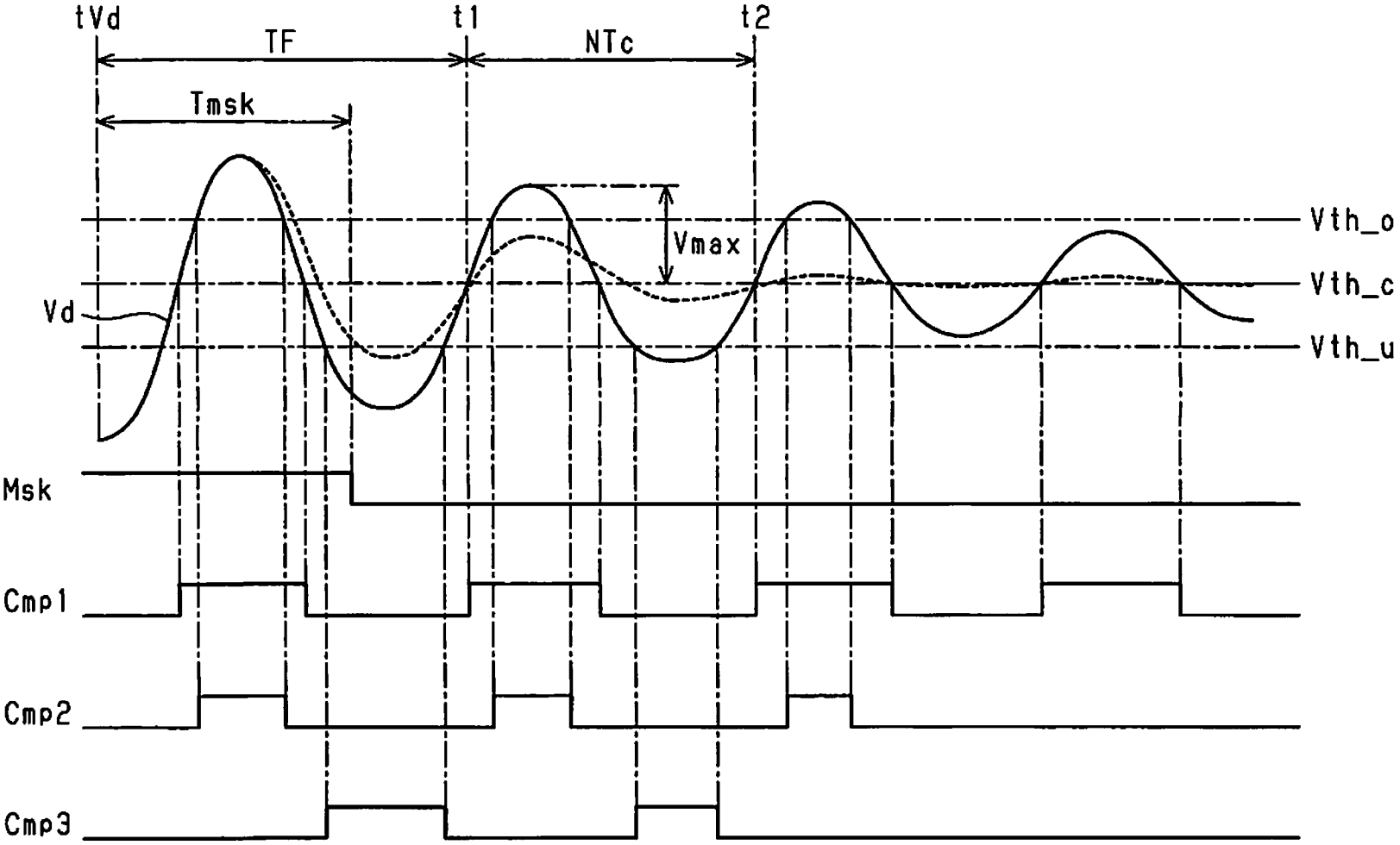
FIG. 24 is a timing chart illustrating an operation of the discharge abnormality detection circuit.

FIG. 24 is a timing chart illustrating an operation of the measuring unit 58. As illustrated in FIG. 24, the measuring unit 58 compares the potential of the shaped waveform signal Vd to the threshold potential Vth_c. The measuring unit generates a comparison signal Cmp1 which has a high level in a case where the potential of the shaped waveform signal Vd is equal to or greater than the threshold potential Vth_c, and has a low level in a case where the potential of the shaped waveform signal Vd is smaller than the threshold potential Vth_c.

The measuring unit 58 compares the potential of the shaped waveform signal Vd to the threshold potential Vth_o. The measuring unit generates a comparison signal Cmp2 which has a high level in a case where the potential of the shaped waveform signal Vd is equal to or greater than the threshold potential Vth_o, and has a low level in a case where the potential of the shaped waveform signal Vd is smaller than the threshold potential Vth_o.

The measuring unit 58 compares the potential of the shaped waveform signal Vd to the threshold potential Vth_u. The measuring unit generates a comparison signal Cmp3 which has a high level in a case where the potential of the shaped waveform signal Vd is smaller than the threshold potential Vth_u, and has a low level in a case where the potential of the shaped waveform signal Vd is equal to or greater than the threshold potential Vth_u.

The mask signal Msk has a high level only during a predetermined period Tmsk from when a supply of the shaped waveform signal Vd from the waveform shaping unit 57 is started. In the embodiment, it is possible to obtain a measurement value in which a noise component superimposed just after the residual vibration starts has been removed, with high accuracy by measuring the period NTc, a phase time TF, and the amplitude Vmax with only the shaped waveform signal Vd after the elapse of the period Tmsk, in the shaped waveform signal Vd, as a target.

The period measuring unit 581 includes a first counter (not illustrated). The first counter starts counting of a clock signal (not illustrated) at a time point t1 which is a timing at which the potential of the shaped waveform signal Vd becomes equal to the threshold potential Vth_c for the first time after the mask signal Msk falls to the low level. That is, the first counter starts counting at the time point t1 which is the earlier timing among a timing at which the comparison signal Cmp1 rises to the high level for the first time or a timing at which the comparison signal Cmp1 falls to the low level for the first time, after the mask signal Msk falls to the low level.

After starting the counting, the first counter ends counting of the clock signal at a time point t2 which is a timing at which the potential of the shaped waveform signal Vd becomes the threshold potential Vth_c for the second time. The first counter outputs the obtained count value as the period NTc. That is, the first counter ends counting at the time point t2 which is the earlier timing among a timing at which the comparison signal Cmp1 rises to the high level for the second time or a timing at which the comparison signal Cmp1 falls to the low level for the second time, after the mask signal Msk falls to the low level. As described above, the measuring unit 58 acquires the period NTc by measuring a time length from the time point t1 to the time point t2 as the time length of one period of the shaped waveform signal Vd.

In a case where the amplitude of the shaped waveform signal Vd is small as indicated by a broken line in FIG. 24, a probability that accurate measurement of the measurement value is not possible is high. In a case where the amplitude of the shaped waveform signal Vd is small, practically, there is a probability of a discharge abnormality occurring even in a case where it is determined that the discharge state of the discharging portion D is normal, based on only the result of the measurement value. Thus, in the embodiment, it is determined whether or not the amplitude of the shaped waveform signal Vd has a magnitude enough for measuring the measurement value, and a result obtained by the determination is output as the validity flag Flag. Specifically, the measuring unit 58 determines that the potential of the shaped waveform signal Vd satisfies a condition of being greater than the threshold potential Vth_o and being smaller than the threshold potential Vth_u in the period from the time point t1 to the time point t2, based on the comparison signal Cmp2. The value of the validity flag Flag is set to "1" which is a value indicating that the measurement value is valid, in a case where the potential satisfies the condition. The value of the validity flag Flag is set to "0" in other cases.

The phase-difference measuring unit 582 includes a second counter (not illustrated). If the time enters into the detection period Td, the second counter starts counting of a clock signal (not illustrated). The second counter ends the counting of the clock signal at a timing which is the time point t1 in the example illustrated in FIG. 24 and at which the potential of the shaped waveform signal Vd becomes equal to the threshold potential Vth_c for the first time after the mask signal Msk falls to the low level. Then, the second counter sets the obtained count value as the phase time TF. That is, the second counter starts counting of the clock signal at a timing at which a signal Tsig rises to the high level. Then, the second counter ends the counting of the clock signal at a timing which is, for example, the time point t1 and at which the comparison signal Cmp1 rises to the high level for the first time after the mask signal Msk falls to the low level. The second counter is set to be capable of ending counting at timings at which the shaped waveform signal Vd has the same phase in the normal time and in a discharge abnormality time. If the condition is satisfied, the second counter may end counting at a timing at which the comparison signal Cmp1 falls to the low level for the first time. The phase-difference measuring unit 582 calculates a difference between the phase time TF obtained by the measurement and a phase time TFo in the normal time, which has been set in advance, so as to acquire the phase difference NTF.

The amplitude measuring unit 583 acquires the maximum potential or the minimum potential in a period from the time point t1 (which is a timing at which the potential of the shaped waveform signal Vd becomes equal to the threshold potential Vth_c for the first time after the mask signal Msk falls to the low level) to a time point which is a timing at which the potential of the shaped waveform signal Vd becomes equal to the threshold potential Vth_c for the next time. That is, the time point t is the earlier timing among a timing at which the comparison signal Cmp1 rises to the high level for the first time or a timing at which the comparison signal Cmp1 falls to the low level for the first time, after the mask signal Msk falls to the low level. The amplitude measuring unit 583 acquire the maximum potential or the minimum potential in the period from the time point t1 to the time point which is a timing at which the comparison signal Cmp1 rises to the high level for the next time or a timing at which the comparison signal Cmp1 falls to the low level for the next time. That is, the amplitude measuring unit measures the maximum potential in the shown potential of the shaped waveform signal Vd if the period is a period in which the comparison signal Cmp1 is at the high level. The amplitude measuring unit measures the minimum potential in the shown potential of the shaped waveform signal Vd if the period is a period in which the comparison signal Cmp1 is at the low level. The amplitude measuring unit 583 acquires a potential difference between the maximum potential or the minimum potential which has been acquired, and the threshold potential Vth_c, as the amplitude Vmax.

The determination unit 56 determines the discharge state of the ink in the discharging portion D based on the period NTc, the phase difference NTF, the amplitude Vmax, and the validity flag Flag which have been input from the measuring unit 58. Then, the determination unit outputs a determination result as the determination result signal Rs.

The determination unit 56 is used for determining the period NTc. Three thresholds of NTx1, NTx2, and NTx3, which have a relation of NTx1<NTx2<NTx3 are set. The determination unit compares the period NTc to the thresholds NTx1, NTx2, and NTx3. Here, the threshold NTx1 is a threshold for determining whether or not bubbles are provided in the cavity 264. The threshold NTx2 is a threshold for determining whether or not paper dust adheres. The threshold NTx3 is a threshold for determining sticking or thickening of the ink. In a case where paper dust Pe floating in a state of being spaced from the nozzle N in the discharge direction adheres to the head surface 261, a condition of NTx2<NTc≤NTx3, which is set for detecting the paper dust Pe may not be satisfied. Therefore, in the embodiment, in order to reduce the omission of detection of this type of floating paper dust Pe, the first drive signal VinA illustrated in any one of FIGS. 18 to 21 is supplied to the piezoelectric element 200 in discharge abnormality detection processing including at least paper dust checking.

Figure 25:
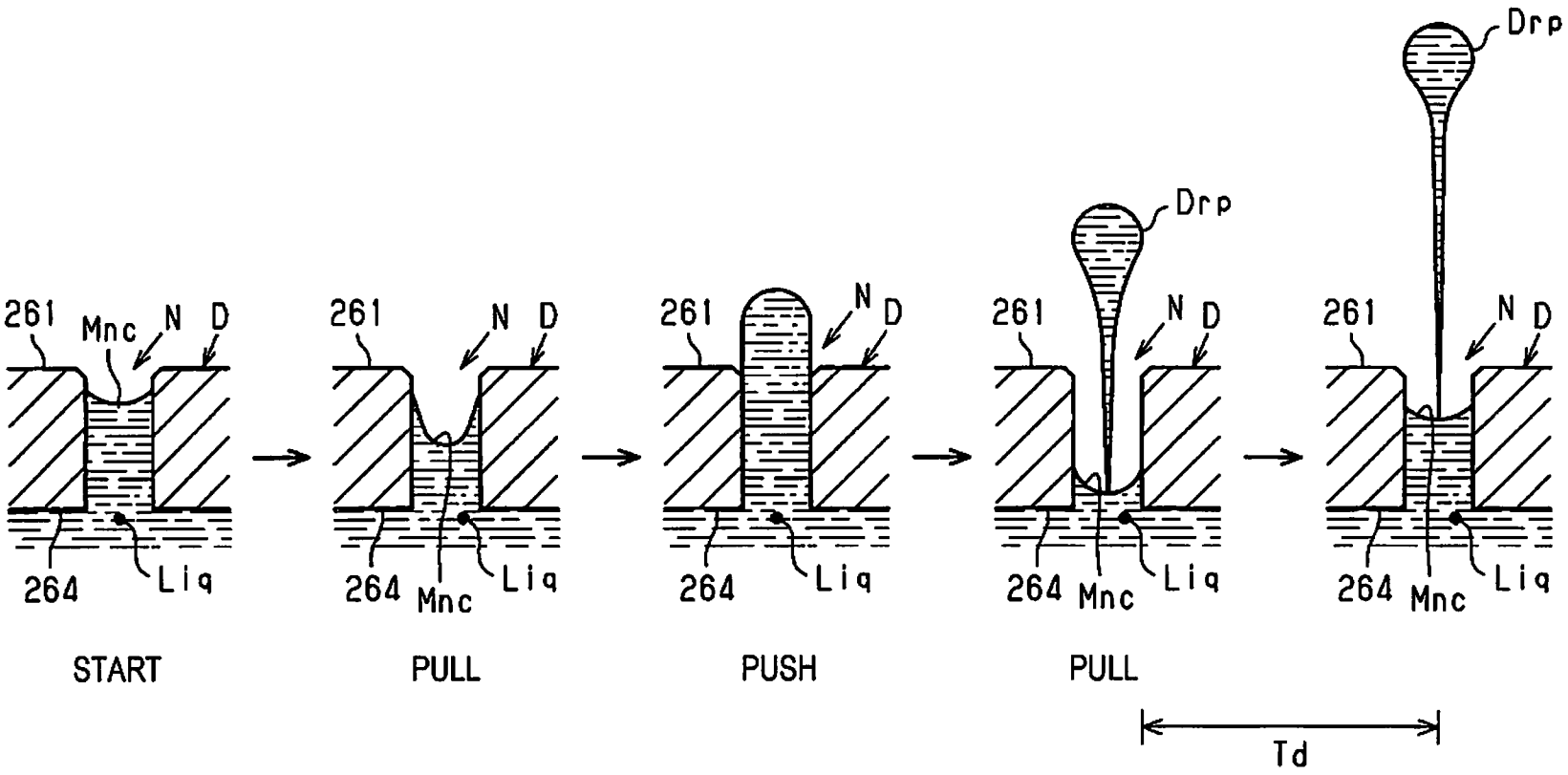
FIG. 25 is a schematic sectional view illustrating a form in which a droplet is discharged in Pull-Push-Pull driving.

FIG. 25 schematically illustrates a form in the nozzle N in the process of discharging liquid from the nozzle N at time of Pull-Push-Pull driving. As illustrated in FIG. 25, when one period of the unit operation period Tu starts (Start time), the nozzle N is in a state where the meniscus Mnc is positioned on the cavity 264 side so as to slightly move from the opening of the nozzle N. Liquid Liq in the cavity 264 is drawn by the first Pull driving, with following displacement of the meniscus Mnc in the nozzle N toward the cavity 264. Thus, the liquid Liq in the cavity 264 is preliminarily excited in the drawing direction which is opposite to the discharge direction. Then, with Push driving, the liquid Liq in the cavity 264 is excited in the discharge direction. The liquid Liq in is pushed from the inside of the nozzle N in the discharge direction by pressure at time of the excitation. With the pushing, the liquid Liq protrudes from the nozzle N in a columnar shape.

With the next Pull driving, pressure in the drawing direction which is opposite to the discharge direction is applied to the liquid Liq in the cavity 264. That is, a damping force in the drawing direction, which hinders movement in the discharge direction is applied to the liquid Liq in the cavity 264 in the process of the liquid Liq moving in the nozzle N in the discharge direction. As a result, the liquid Liq in the nozzle N is cut out at a position close to the cavity 264. The separated liquid Liq is discharged from the nozzle N as a droplet Drp. Then, the meniscus Mnc of the liquid Liq cut out at an inward position in the nozzle N converges at a predetermined position on the opening side of the nozzle N with an amplitude motion by a residual vibration. In the embodiment, the change of the residual vibration is detected in the detection period Td just after Pull driving, and whether or not discharge abnormality occurs is checked based on a result obtained by detecting the change of the residual vibration.

Next, a principle of detecting paper dust Pe adhering to the head surface 261 will be described with reference to FIGS. 26 to 29. Comparison is performed between a Push driving type and a driving type in which Pull driving is performed next to Push driving. Comparison is performed between the normal time and the paper dust adhering time.

Figure 26:
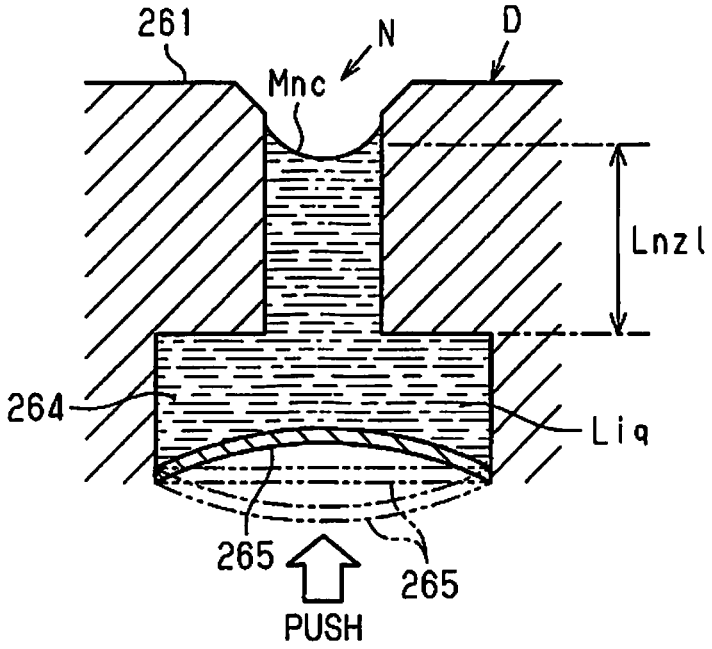
FIG. 26 is a schematic sectional view illustrating a form of liquid in a nozzle in Push driving in a normal time.
Figure 27:
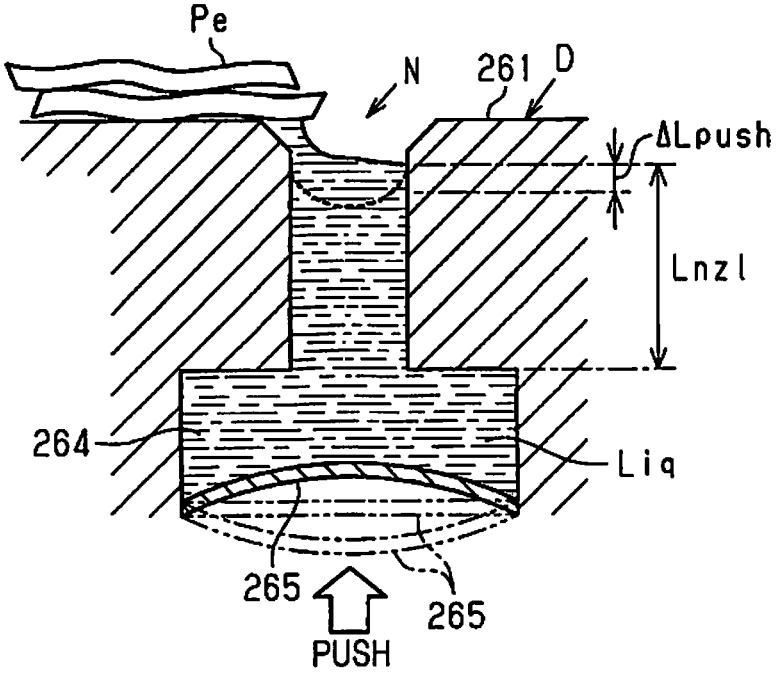
FIG. 27 is a schematic sectional view illustrating a form of liquid in a nozzle in Push driving when paper dust has adhered.
Figure 28:
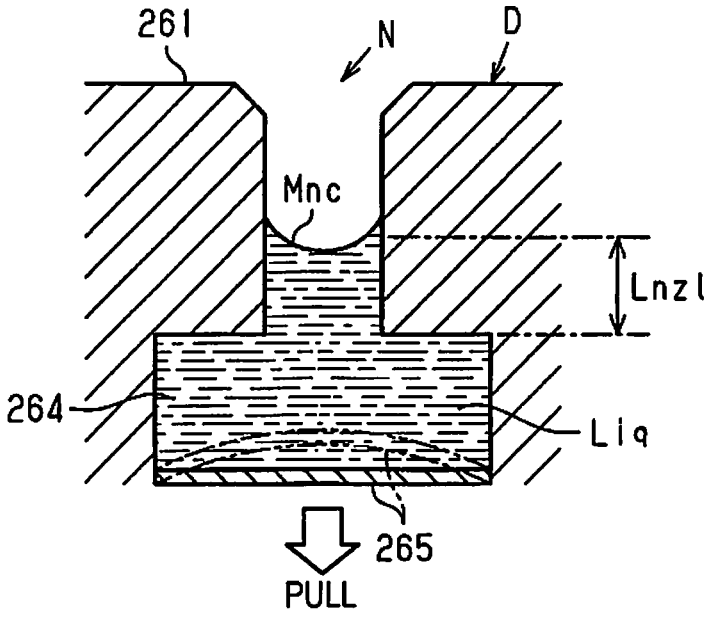
FIG. 28 is a schematic sectional view illustrating a form of liquid in a nozzle in Pull driving in the normal time.
Figure 29:
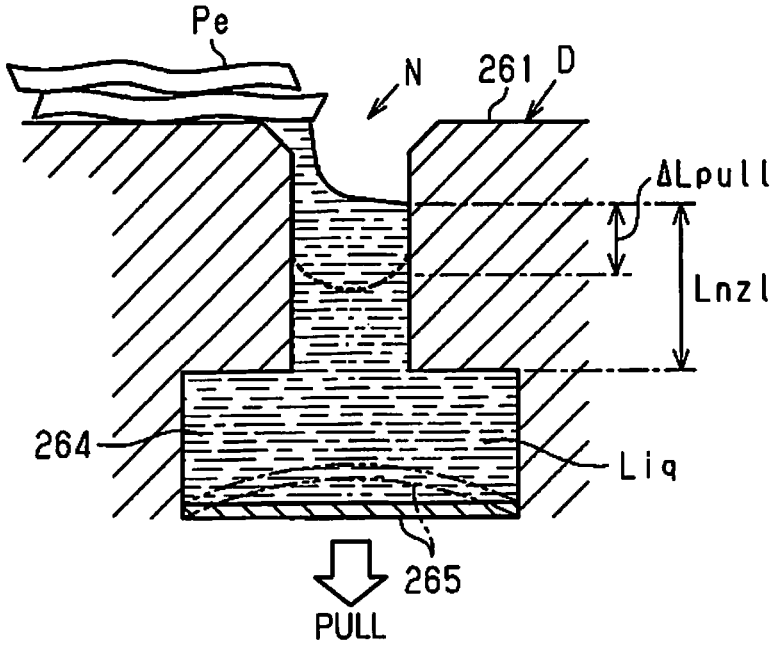
FIG. 29 is a schematic sectional view illustrating a form of liquid in a nozzle in Pull driving when paper dust has adhered.

FIGS. 26 and 27 illustrate forms of liquid in the nozzle N at time of Push driving. FIG. 26 illustrates the normal time, and FIG. 27 illustrates the paper dust adhering time. FIGS. 28 and 29 illustrate forms of the liquid in the nozzle N at time of Pull driving. FIG. 28 illustrates the normal time, and FIG. 29 illustrates the paper dust adhering time. In Push-Pull driving, Pull driving illustrated in FIGS. 28 and 29 is performed after Push driving illustrated in FIGS. 26 and 27. Pull driving referred here is driving in which a pressure wave in the drawing direction on an opposite side of the discharge direction is applied to the liquid Liq in the cavity 264 in the process (see FIG. 25) of the liquid Liq moving in the nozzle N in the discharge direction by a pressure wave in the discharge direction by Push driving, and thereby the liquid Liq in the cavity 264 is damped. If the pressure wave in the drawing direction is applied to the liquid Liq in the cavity 264 by Pull driving, the liquid Liq moving in the nozzle N in the discharge direction is cut out in the nozzle N and is discharged as the droplet Drp.

Push driving of the discharging portion D will be described with reference to FIGS. 26 and 27. Here, a case where Pull driving is performed as preliminary excitation, before Push driving, is used as an example. Firstly, checking in the normal time illustrated in FIG. 26 will be described. As illustrated in FIG. 26, the diaphragm 265 in the first Pull driving performs displacement from a substantially horizontal neutral position indicated by a two-dot chain line in FIG. 26 to a bending position indicated by the same two-dot chain line, and thereby the volume of the cavity 264 increases, and the liquid Liq in the cavity 264 is drawn to the diaphragm 265 side. This means the preliminary excitation, and the meniscus Mnc is slightly drawn to the back side of the nozzle N from an initial position (see FIG. 25). Then, with Push driving, the diaphragm 265 bends to a position indicated by a solid line in FIG. 26. Thus, the volume of the cavity 264 decreases, and thus the liquid Liq is excited in the discharge direction. The liquid Liq is pushed from the inside of the nozzle N in the discharge direction and thus protrudes from the opening of the nozzle N in a columnar shape (see FIG. 25). In a case where discharge abnormality detection is performed in the discharge mode, the liquid Liq in the nozzle N is cut out and is discharged as a droplet (see FIG. 25). At this time, as illustrated in FIG. 26, the meniscus Mnc is positioned on the opening side of the nozzle N. For example, in the Push driving type, the drive signal Vin is held to the second potential V2 for a while after the droplet has been discharged. Thus, when the residual vibration is detected, the meniscus Mnc is positioned on the opening side of the nozzle N. The discharge abnormality detection may be performed in the non-discharge mode. In this case, the liquid Liq slightly protrudes from the opening of the nozzle N in a columnar shape, and then is brought back into the nozzle N. In this case, the meniscus Mnc is also positioned on the opening side of the nozzle N.

Next, discharge abnormality detection in the paper dust adhering time illustrated in FIG. 27 will be described. As illustrated in FIG. 27, in a case where the paper dust Pe adheres to the head surface 261, the diaphragm 265 is preliminarily excited by the first Pull driving. Then, the diaphragm 265 bends in a direction causing the volume of the cavity 264 to decreases, by Push driving, and thus the liquid Liq in the cavity 264 is excited in the discharge direction. With the excitation, the liquid Liq is pushed out to the nozzle N, and thus protrudes from the inside of the nozzle N in a columnar shape (see FIG. 25). For example, in a case where the discharge abnormality detection is performed in the discharge mode, the liquid Liq is cut out in the nozzle N and is discharged as a droplet Drp (see FIG. 25). In a case of the non-discharge mode, the liquid Liq slightly protrudes from the opening of the nozzle N in a columnar shape, and then is brought back into the nozzle N.

The liquid comes into contact with the paper dust Pe adhering to the head surface 261, in the process of being discharged from the nozzle N, and thus a force in a direction where the liquid is attracted to the paper dust Pe acts on the liquid Liq in the nozzle N by a capillary force. Therefore, the liquid level position illustrated in FIG. 27 is positioned on the opening side of the nozzle N in comparison to the position of the meniscus Mnc in the normal time, which is illustrated in FIG. 26, at the time of Push driving. In this case, a liquid length Lnzl which is a length indicating that the nozzle N is filled with the liquid from a nozzle base position to the liquid level is slightly longer than that in the normal time illustrated in FIG. 26. However, in the example illustrated in FIGS. 26 and 27, in which the liquid is discharged in Push driving, a difference ΔLpush between the liquid length Lnzl in the normal time and the liquid length Lnzl in the paper dust adhering time is small. In a case of the non-discharge mode, the liquid Liq which has slightly protruded from the opening of the nozzle N in a columnar shape is brought into contact with the paper dust Pe, and then the liquid Liq is brought back into the nozzle N. In this case, with action of the force attracting the liquid Liq to paper dust Pe by the capillary force, the liquid level is positioned to be slightly closer to the opening of the nozzle N than the position in the normal time, which is indicated by a broken line. However, the difference ΔLpush is small.

Next, Pull driving of the discharging portion D will be described with reference to FIGS. 28 and 29. In the embodiment, the discharging portion D performs Pull driving next to Push driving. Push driving is performed in a manner similar to the above description made with FIGS. 26 and 27. The discharging portion D is subjected to Pull driving in a predetermined period which is within, for example, one period Tc of a vibration of the liquid Liq, which is caused by the excitation after Push driving ends. A timing of Pull driving is defined by the first holding time Th in which the first drive signal VinA is held to the second potential V2.

Firstly, checking in the normal time, illustrated in FIG. 28, will be described. As illustrated in FIG. 28, with Pull driving, the diaphragm 265 comes back to a neutral position indicated by a solid line in FIG. 28 from a bending position indicated by a two-dot chain line in FIG. 28 when Push driving ends. Thus, the volume of the cavity 264 increases, and thus pressure in the drawing direction, which is reverse to pressure in the discharge direction applied at the time of the previous Push driving is applied to the liquid Liq. This pressure acts as a damping force, on the liquid Liq. As a result, the liquid Liq in the nozzle N is cut out at the position on the back side close to the cavity 264, and is discharged as a droplet Drp (see FIG. 25). As a result, as illustrated in FIG. 28, the meniscus Mnc just after discharge of the droplet is positioned on the back side of the nozzle N. At this time, the liquid length Lnzl from the base position of the nozzle N to the meniscus Mnc is short.

Next, checking in a case where paper dust Pe adheres to the head surface 261 will be described with reference to FIG. 29. The discharging portion D illustrated in FIG. 29 performs Pull driving next to Push driving. Thus, the diaphragm 265 comes back to a neutral position indicated by a solid line in FIG. 29 from a bending position indicated by a two-dot chain line in FIG. 29 when Push driving ends. Thus, since the volume of the cavity 264 increases, pressure in the drawing direction, which is reverse to pressure in the discharge direction applied at the time of the previous Push driving is applied to the liquid Liq. This pressure acts as a damping force, on the liquid Liq. As a result, the liquid Liq is cut out in the nozzle N and is discharged as a droplet Drp (see FIG. 25).

In this discharge process, the liquid Liq comes into contact with the paper dust Pe. Thus, a force in a direction where the liquid is attracted to the paper dust Pe acts on the liquid Liq in contact with the paper dust Pe in the nozzle N by a capillary force or receive a resistance force from the paper dust Pe. In this state, a damping force in the direction in which the liquid Liq in the cavity 264 is drawn is applied by Pull driving. As a result, the position at which the liquid Liq in the nozzle N is cut out after the droplet Drp has been discharged varies from that in the normal time. In the example illustrated in FIG. 29, the liquid level in the nozzle N is positioned on the opening side in comparison to the liquid level (meniscus Mnc) in the normal time, which is indicated by a broken line in FIG. 29.

At this time, as illustrated in FIG. 29, the liquid length Lnzl from the base position of the nozzle N to the position of the meniscus Mnc is longer than that in the normal time. Therefore, a difference ΔLpull between the position of the meniscus Mnc in the normal time, which is indicated by the broken line in FIG. 29 and the liquid level position in the nozzle N in the paper dust adhering time is relatively greater than the difference ΔLpush in the Push driving type illustrated in FIG. 27. Thus, in the Pull-Push-Pull driving type, the significant difference ΔLpull in the liquid level position in the nozzle N just after the droplet has been discharged is provided between the paper dust adhering time and the normal time. The difference ΔLpull of the liquid level position is shown as a significant difference in a vibration form of the residual vibration just after the droplet has been discharged. In the embodiment, in checking, the difference of the change of the residual vibration, which is caused by the difference ΔLpull between the liquid level position in the nozzle N just after the discharge of the droplet and the liquid level position in the normal time is measured. Then, the occurrence of a discharge abnormality caused by the paper dust Pe adhering in a state where the portion of the paper dust has floated is also checked based on the measurement value.

Figure 30:
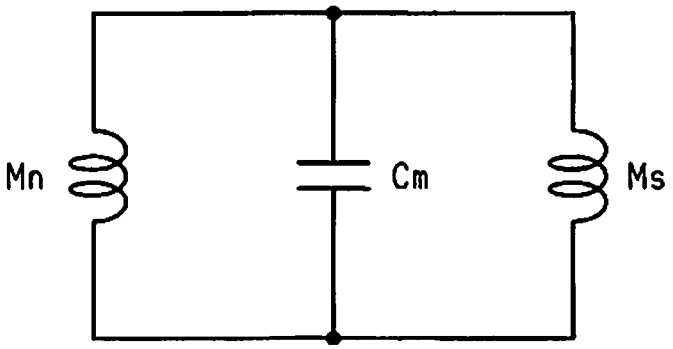
FIG. 30 is a circuit diagram illustrating an equivalent circuit of a model of a discharge system in the discharging portion.

Next, a principle of the paper dust checking will be described with reference to FIG. 30. The period NTc of the residual vibration of the liquid in the nozzle N changes depending on the liquid level position of the liquid vibrating in the nozzle N. The period NTc is given by the following expression.

$$NTc=2\pi(Mi\cdot \mathrm{Cm})^{1/2} \quad (1)$$

Here, Mi indicates inertance, and Cm indicates compliance. The compliance Cm is an integer determined by the liquid (ink in this example), the structural member of the discharging portion D, such as a flow path wall and the diaphragm 265, and the like.

A model of an ink discharge system in which an ink supply tube including the reservoir 272, the pressure chamber configured by the cavity 264, and a nozzle tube including the nozzle N are connected to each other is considered. The model is represented by an equivalent circuit illustrated in FIG. 30 with inertance Ms on the ink supply tube side, and inertance Mn and compliance Cm on the nozzle tube side. In the equivalent circuit, inertance Mi of the entirety of the ink discharge system is given by the following expression with the inertance Ms on the ink supply tube side and the inertance Mn on the nozzle tube side.

$$Mi=(Mn\cdot Ms)/(Mn+Ms) \quad (2)$$

The inertance Mk on a path is represented by Mk=ρ−l/s with the sectional area s and the length l of the path and density ρ of the liquid. Thus, the inertance Ms on the path of the ink supply tube configured to supply an ink into the cavity 264 and the inertance Mn on the path of the nozzle tube configured to discharge the ink from the cavity 264 are given by the following expressions, respectively.

$$Ms=\rho l1/s1$$

$$Mn=\rho^{*}l2/s2$$

Here, ρ indicates the density of the ink and is an integer which is slightly greater than 1. l1 indicates an ink length which is the length of a portion of the ink supply tube, which has been filled with the ink. s1 indicates the sectional area of the ink supply tube. l2 indicates an ink length which is the length of a portion of the nozzle N, which has been filled with the ink, to the liquid level. s2 indicates the sectional area of the nozzle N. The ink length l1 and the sectional area s1 of the ink supply tube which is normally filled with liquid are integers together. Thus, the inertance Ms on the supply side is an integer. The sectional area s2 of the nozzle tube is an integer. Therefore, the inertance Mi changes depending on the ink length l2 of the nozzle N. Thus, the period NTc of the residual vibration changes depending on the ink length l2 of the nozzle N, that is, on the liquid level position.

When the liquid level in the nozzle N is drawn to the cavity 264 side and is positioned on the back side, the ink length l2 becomes short, the inertance Mn on the nozzle side is reduced, and the inertance Mi of the discharging portion D is reduced. Thus, the period NTc of the residual vibration becomes short. On the contrary, when the liquid level in the nozzle N is positioned on the opening side of the nozzle, the ink length l2 of the nozzle N becomes long, the inertance Mn on the nozzle N increases, and the inertance Mi of the discharging portion D increases. Thus, the period NTc of the residual vibration becomes long.

Therefore, in a case of a configuration in the residual vibration is detected after Push driving illustrated in FIGS. 26 and 27, and whether or not a discharge abnormality occurs is checked, the difference of the liquid length Lnzl, that is, the difference ΔLpush of the liquid level position between the normal time illustrated in FIG. 26 and the paper dust adhering time illustrated in FIG. 27 is small. Therefore, performing paper dust checking by comparing the period NTc of the residual vibration between the normal time and the paper dust adhering time is not sufficient from a viewpoint of detection accuracy.

In the embodiment, Pull driving illustrated in FIGS. 28 and 29 is performed more, and thus the liquid Liq in the nozzle N is drawn to the cavity 264 side. In the normal time illustrated in FIG. 28, the liquid Liq in the nozzle N is drawn, and thus the liquid level (meniscus Mnc) is positioned on the back side of the nozzle N. In the paper dust adhering time illustrated in FIG. 29, the liquid moving in the discharge direction at the time of Push driving comes into contact with the paper dust Pe adhering to the head surface 261. Thus, even though a damping force in the drawing direction is applied to the liquid in the nozzle N at the time of Pull driving after that time, the liquid is in a state where a force in the direction of attracting the liquid to the paper dust Pe acts on the liquid by a capillary phenomenon. Thus, the position at which the liquid Liq is cut out varies in comparison to that in the normal time. For example, the liquid level in the nozzle N hardly performs displacement to the cavity 264 side. Therefore, in a case of a configuration in the residual vibration is detected after Pull driving illustrated in FIGS. 28 and 29, and whether or not a discharge abnormality occurs is checked, the difference of the liquid length Lnzl, that is, the difference ΔLpull of the liquid level position between the normal time illustrated in FIG. 28 and the paper dust adhering time illustrated in FIG. 29 is greater than the difference ΔLpush in checking of the Push driving type illustrated in FIGS. 26 and 27. Therefore, the period NTc of the residual vibration is different between the normal time and the paper dust adhering time, and the phase difference NTF and the amplitude Vmax are also different. Thus, it is possible to perform paper dust checking with high detection accuracy, based on the phase difference NTF and the amplitude Vmax in addition to the period NTc of the residual vibration signal Vout. In the embodiment, the descriptions are made with paper dust Pe having a high frequency of adhering to the head surface 261, as an example. However, foreign substances other than the paper dust, which adhere to the head surface 261 can be detected in the similar manner.

Figure 31:
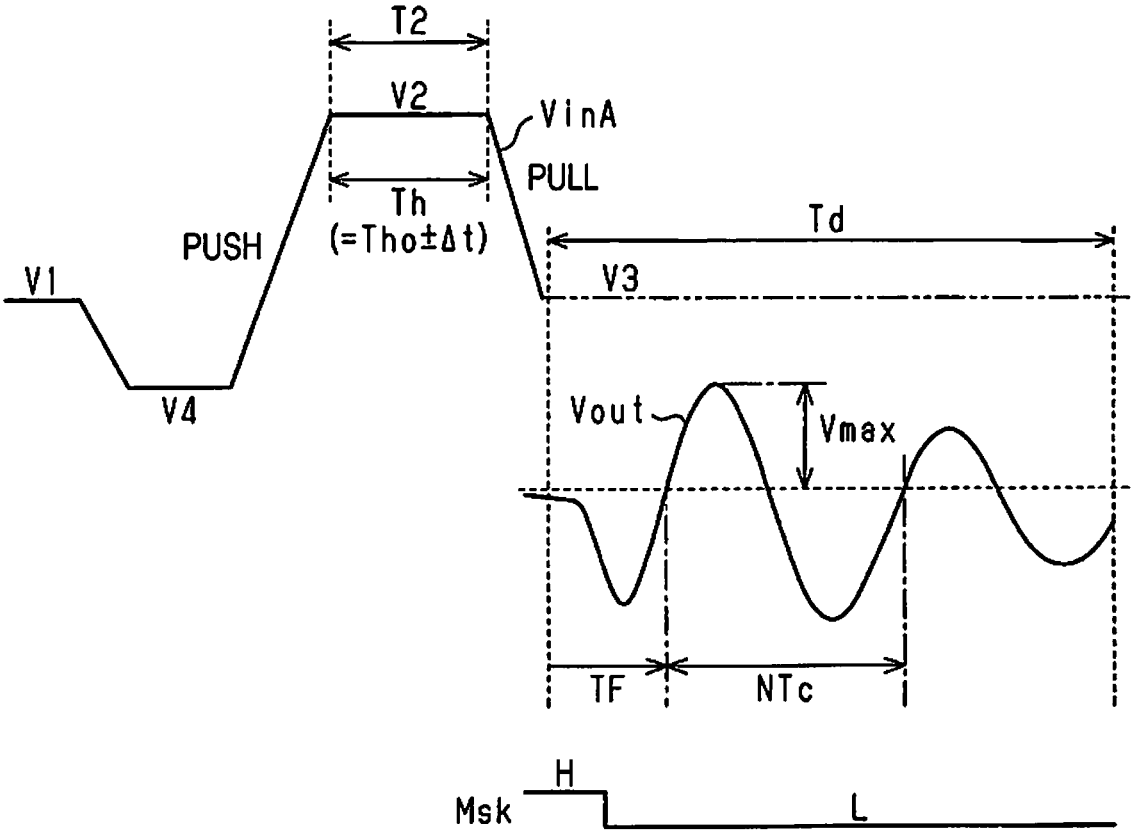
FIG. 31 is a diagram illustrating discharge abnormality detection when paper dust is checked.

FIG. 31 illustrates the period NTc, the phase time TF, and the amplitude Vmax of the residual vibration, which are measured by the measuring unit 58, in the detection period Td in which a residual vibration occurs after the liquid has been discharged. In the discharge abnormality detection, the first drive signal VinA illustrated in FIG. 31 is applied to the piezoelectric element 200 of the discharging portion D. The liquid is discharged from the nozzle N in the process of the piezoelectric element 200 being subjected to Pull-Push-Pull driving. In the detection period Td started just after Pull driving ends, the change of the residual vibration signal Vout is measured based on the change of the electromotive force of the piezoelectric element 200. That is, the measuring unit 58 measures the period NTc, the phase difference NTF, and the amplitude Vmax of the residual vibration based on the shaped waveform signal Vd obtained by shaping the residual vibration signal Vout. The phase-difference measuring unit 582 measures the phase time TF in a period, for example, from a start time point of the detection period Td until a mask period has ended by the mask signal Msk of the detection period Td switching from the H level to the L level. The phase time TF is measured in a manner that time elapsed until the residual vibration signal Vout reaches the threshold potential Vth_o for the first time is measured in a manner that a counter (not illustrated) counts the number of pulses of the clock signal. The phase-difference measuring unit 582 acquires the phase difference NTF by calculating a difference between the phase time TF and the phase time TFo which is stored in the storage unit 62 and is time until the shaped waveform signal in the normal time reaches the threshold potential Vth_o for the first time. The determination unit 56 determines whether or not the phase difference NTF is greater than a threshold NTFo and determines whether or not one determination condition for paper dust adhering has been established. The phase difference NTF may be not necessarily calculated. The determination unit compares the phase time TF until the residual vibration signal Vout reaches the threshold potential Vth_o for the first time to a preset threshold (TFo-NTFo). If the phase time TF is smaller than the threshold (TFo-NTFo), the determination unit determines that one determination condition for paper dust adhering has been established. As described above, the determination unit 56 may determine whether or not discharge abnormality occurs in the paper dust adhering time, based on the phase (phase time TF) measured by the measuring unit 58.

Figure 32:
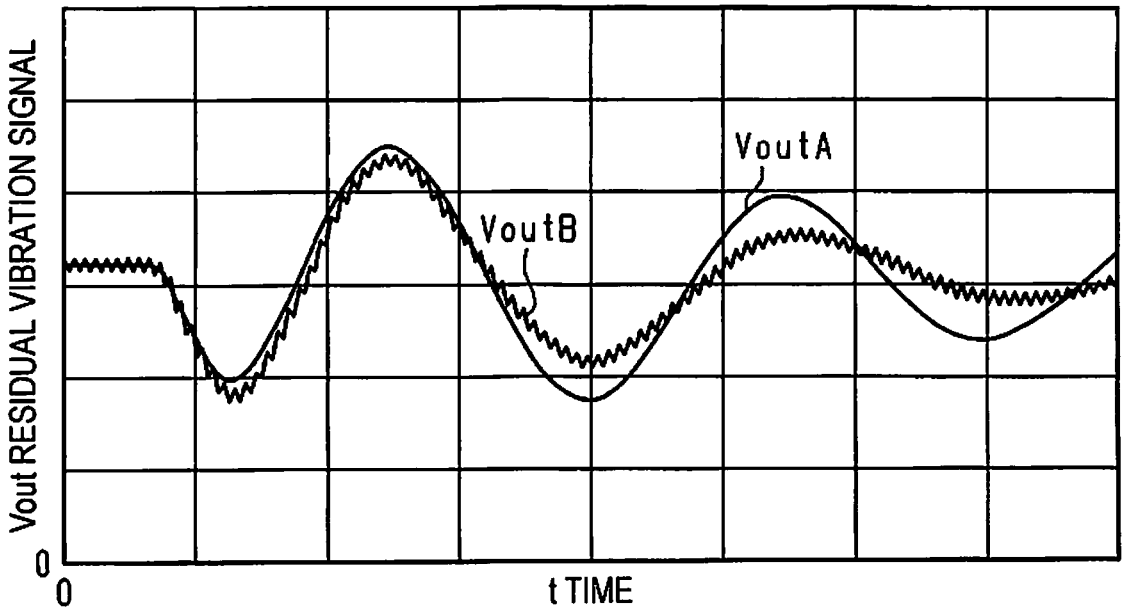
FIG. 32 is a graph illustrating the residual vibration signal when paper dust has adhered, in a comparative example.
Figure 33:
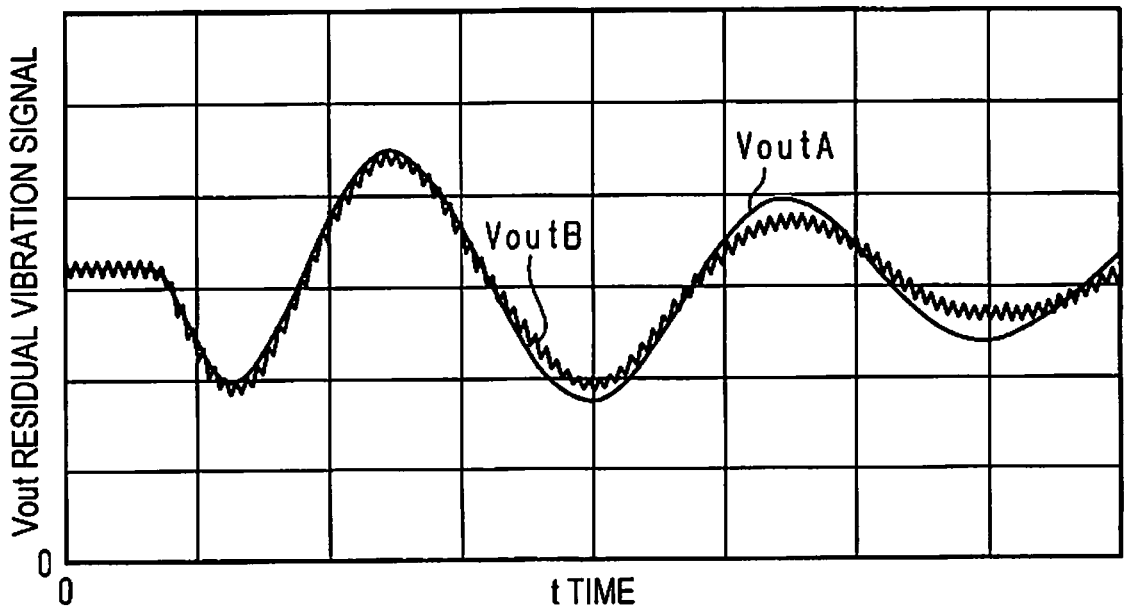
FIG. 33 is a graph illustrating the residual vibration signal when the floating paper dust has adhered, in the comparative example.
Figure 34:
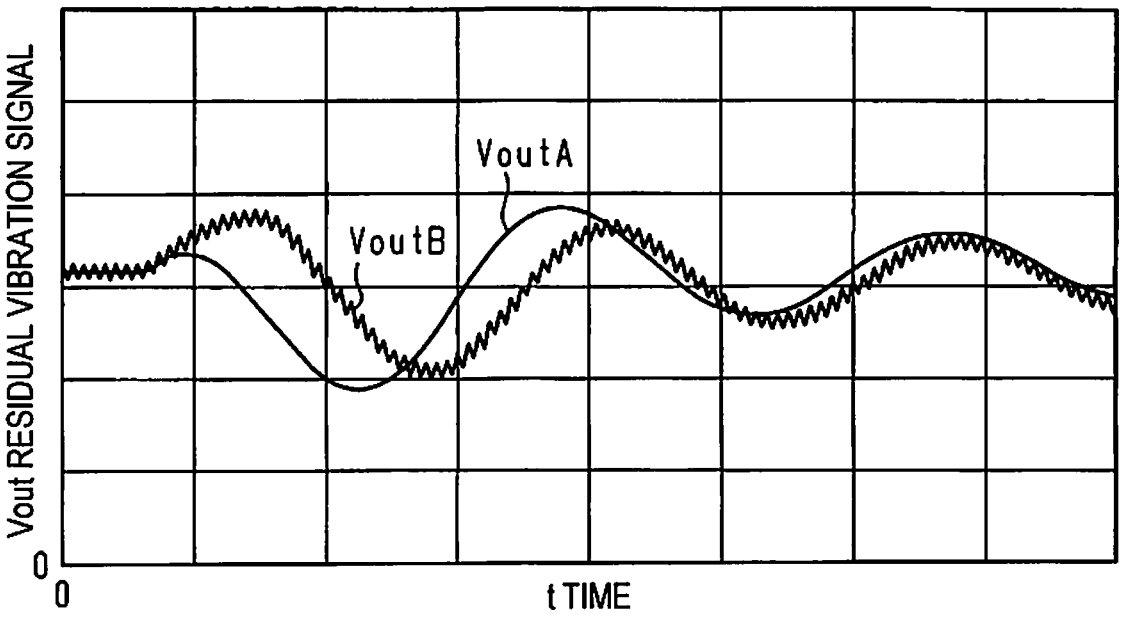
FIG. 34 is a graph illustrating the residual vibration signal in a paper dust adhering time in an example.
Figure 35:
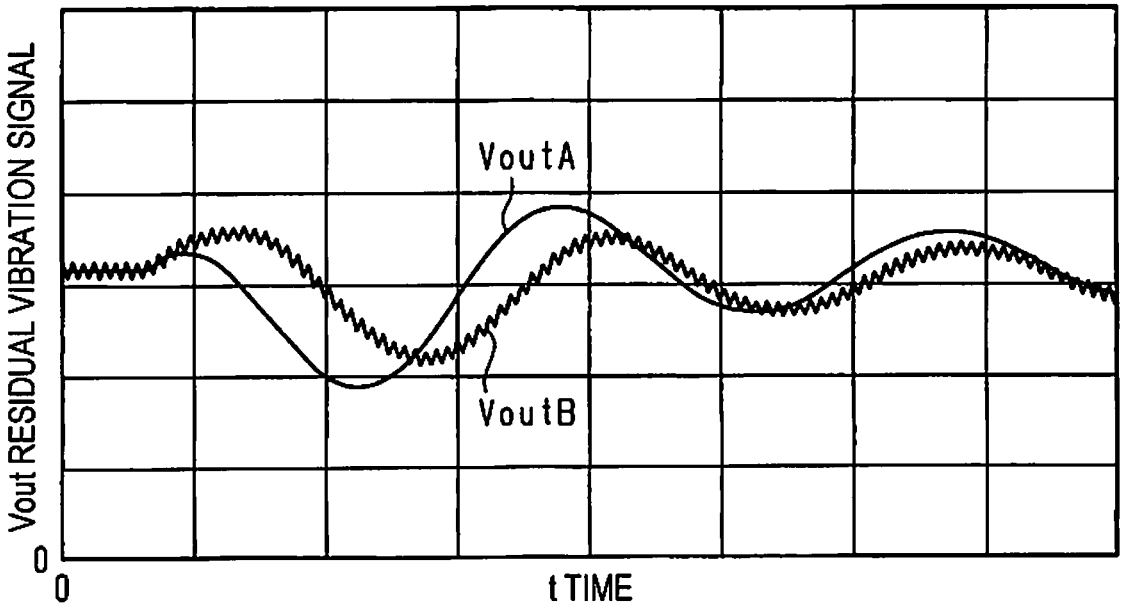
FIG. 35 is a graph illustrating the residual vibration signal when the floating paper dust has adhered, in the example.

The residual vibration signal Vout is measured when paper dust checking is performed with a checking method which is an example of Pull-Push-Pull driving. As a comparative example, a residual vibration signal Vout when a non-discharge type paper dust checking is performed is measured. FIGS. 32 and 33 illustrate measurement results of the residual vibration signal Vout when checking is performed with the non-discharge method in the comparative example. FIGS. 34 and 35 illustrate measurement results of the residual vibration signal Vout when checking is performed with the checking method in the example. In the example, the discharge mode of discharging droplets from the nozzle N is set. In each graph, a horizontal axis indicates time t, and a vertical axis indicates a potential of the residual vibration signal Vout. Each graph illustrates the residual vibration signal VoutA in the normal time and a residual vibration signal VoutB in the paper dust adhering time. In each graph, the residual vibration signal VoutA in the normal time indicates a signal corresponding to the shaped waveform signal Vd obtained by removing a noise component and the like.

Two kinds of adhesion forms having different ways of adhering paper dust are prepared, and the residual vibration signal Vout is measured for each adhesion form. The first adhesion form is an adhesion form in which paper dust Pe adhering to the head surface 261 is near to the opening of the nozzle N, as illustrated in FIG. 12. The second adhesion form is an adhesion form in which a portion of paper dust Pe adhering to the head surface 261 floats, and the floating portion is spaced from the opening of the nozzle N in the discharge direction as illustrated in FIG. 13. FIG. 32 illustrates the residual vibration signal Vout in the comparative example in a case of the first adhesion form. FIG. 33 illustrates the residual vibration signal Vout in the comparative example in a case of the second adhesion form. FIG. 34 illustrates the residual vibration signal Vout in the example in a case of the first adhesion form. FIG. 35 illustrates the residual vibration signal Vout in the example in a case of the second adhesion form.

As illustrated in the graph of FIG. 32, in the non-discharge checking in the comparative example, although a slight difference in the amplitude between the residual vibration signal VoutA in the normal time and the residual vibration signal VoutB in the paper dust adhering time is recognized in the first adhesion form in which paper dust Pe is near to the nozzle N, differences in the period and the phase difference are small. As illustrated in the graph of FIG. 33, in the second adhesion form in which paper dust Pe floats, a significant difference in any of the period, the phase difference, and the amplitude between the residual vibration signal VoutA in the normal time and the residual vibration signal VoutB in the paper dust adhering time is not recognized. The reason is because of the non-discharge checking. A point that the liquid in the nozzle N does not come into contact with the paper dust Pe, and a point that the liquid level position in the nozzle N when detection of the residual vibration starts just after discharge of a droplet is positioned on the opening side of the nozzle are exemplified. Even if the liquid in the nozzle N comes into contact with the paper dust Pe, the liquid level position in the nozzle N is positioned to be near to the opening of the nozzle and hardly differ from that in the normal time. Thus, it is observed that the significant difference in any of the period, the phase difference, and the amplitude between the residual vibration signals VoutA and VoutB is not provided.

As illustrated in the graph of FIG. 34, in the checking in the example, in the first adhesion form in which the paper dust Pe is near to the nozzle N, the significant difference in the period, the phase difference, and the amplitude between the residual vibration signal VoutA in the normal time and the residual vibration signal VoutB in the paper dust adhering time is recognized. As illustrated in the graph of FIG. 35, even in the second adhesion form in which the paper dust Pe floats, the significant difference in the period, the phase difference, and the amplitude between the residual vibration signal VoutA in the normal time and the residual vibration signal VoutB in the paper dust adhering time is recognized. In particular, regarding the phase difference, a large difference between the residual vibration signal VoutA in the normal time and the residual vibration signal VoutB in the paper dust adhering time is recognized in the first and second adhesion forms. In the second adhesion form, even regard the amplitude, a significant difference between the residual vibration signals VoutA and VoutB is recognized.

As understood from FIGS. 34 and 35, the phase difference between the residual vibration signals VoutA and VoutB is recognized from a time point at which a period in which a vibration just after Pull driving is unstable ends. Although a difference in the period between the residual vibration signals VoutA and VoutB is provided, the difference is small. The phase difference between both the residual vibration signals VoutA and VoutB is gradually reduced after one period has passed from when the unstable periods of the residual vibration signals VoutA and VoutB have ended. From the measurement results, in the checking in the example, regardless of the adhesion form of paper dust, a significant difference in, particularly, the phase difference in addition to the period is recognized in the detection period Td. In the second adhesion form, the significant difference in the phase difference and the amplitude is recognized in the detection period Td. The phase time TF and the period for measuring the amplitude Vmax is not limited to being within one period of the residual vibration after the mask period ends. The phase time TF and the period may be within two periods so long as a significant difference in the measurement value between the normal time and the paper dust adhering time is obtained.

Figure 36:
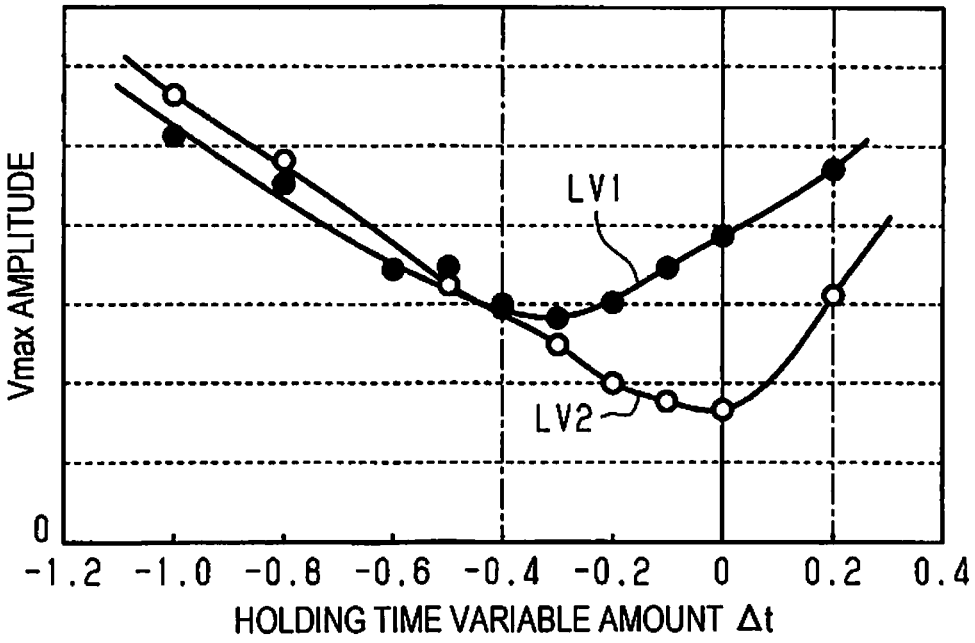
FIG. 36 is a graph illustrating a relation between a holding time variable amount and an amplitude in the normal time and the paper dust adhering time.
Figure 37:
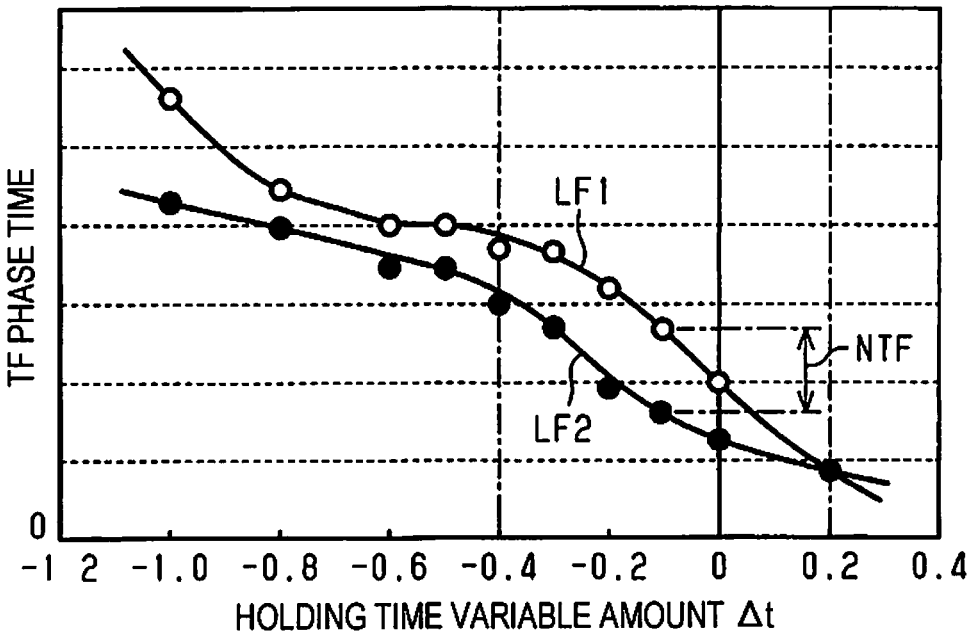
FIG. 37 is a graph illustrating a relation between the holding time variable amount and a phase in the normal time and the paper dust adhering time.

FIG. 36 illustrates a relation between the first holding time Th and the amplitude Vmax of the residual vibration signal Vout. FIG. 37 illustrates a relation between the first holding time Th and the phase time TF of the residual vibration signal Vout. Here, the first holding time Th is set to a value which has been changed from the second holding time Tho by the holding time variable amount Δt. Therefore, in the graphs in FIGS. 36 and 37, a horizontal axis indicates the holding time variable amount Δt. In the graph of the amplitude Vmax illustrated in FIG. 36, a curve LV1 passing through black circles indicates the normal time, and a curve LV2 passing through white circles indicates the paper dust adhering time. In the graph of the phase time TF illustrated in FIG. 37, a curve LF1 passing through black circles indicates the normal time, and a curve LF2 passing through white circles indicates the paper dust adhering time.

As understood from the graph in FIG. 36, if the amplitude Vmax in the paper dust adhering time indicated by the curve LV2 is compared to the amplitude Vmax in the normal time indicated by the curve LV1, a significant difference in the amplitude Vmax in both the cases is recognized in a range in which the holding time variable amount Δ is −0.2 to 2.0 μsec. Therefore, in the paper dust checking, in order to obtain a significant difference in the amplitude Vmax between the paper dust checking and the normal time, the first holding time Th (μsec.) in which the first drive signal VinA is held to the second potential V2 in the second period T2 is set to a value obtained by adding a predetermined holding time variable amount Δt in the range of −0.2 to 2.0 μsec. to the second holding time Tho in the second drive signal VinB. That is, preferably, setting is performed to satisfy $Th=Tho+\Delta t$ ($-0.2\leq\Delta t\leq 2.0$). Here, if $-0.2\leq\Delta t\leq 2.0$ is expressed as a ratio to the second holding time Tho, $-0.2\leq\Delta t\leq 2.0$ corresponds to $-0.04\cdot Tho\leq\Delta t\leq 0.04\cdot Tho$.

As understood from the graph in FIG. 37, if the phase time TF in the paper dust adhering time indicated by the curve LF2 is compared to the phase time TF in the normal time indicated by the curve LF1, a significant difference in the phase difference NTF which is a difference between the paper dust adhering time and the normal time in a range in which the holding time variable amount Δ is −0.4 to 0 μsec. is recognized. Therefore, in the paper dust checking, in order to obtain a significant difference in the phase difference NTF between the paper dust checking and the normal time, the first holding time Th (μsec.) in which the first drive signal VinA is held to the second potential V2 in the second period T2 is set to a value obtained by adding a predetermined holding time variable amount Δt in the range of −0.4 to 0 sec. to the second holding time Tho in the second drive signal VinB. That is, preferably, setting is performed to satisfy $Th=Tho+\Delta t$ ($-0.4\leq\Delta t\leq 0$). Here, if $-0.4\leq\Delta t\leq 0$ is expressed as a ratio to the second holding time Tho, $-0.4\leq\Delta t\leq 0$ corresponds to $-0.08\cdot Tho\leq\Delta t\leq 0$. Thus, in order to satisfy such conditions, in the embodiment, as illustrated in FIGS. 18 to 21, the first holding time Th in the first drive signal VinA used in the first checking is set to be different from the second holding time Tho in the second drive signal VinB used in the second checking or the printing.

From both the graphs illustrated in FIGS. 36 and 37, the holding time variable amount Δt causing a significant difference in both the amplitude Vmax and the phase difference NTF between the discharge abnormality time caused by paper dust and the normal time to be obtained is set. For example, the holding time variable amount Δt (μsec.) is set to a value satisfying $-0.3<\Delta t<0$. If this condition is expressed as a ratio of the second holding time Tho, the condition corresponds to $0.06\cdot Tho<\Delta t<0$.

Thus, in the discharge abnormality checking in the embodiment, paper dust checking is performed with the phase difference NTF and the amplitude Vmax in addition to the period NTc of the residual vibration. Therefore, the measuring unit 58 measures the phase difference NTF and the amplitude Vmax in addition to the period NTc of the residual vibration, and outputs the period NTc, the phase difference NTF, and the amplitude Vmax which have been measured to the determination unit 56. The determination unit 56 determines whether or not a discharge abnormality occurs, based on the validity flag Flag, the period NTc, the phase difference NTF, and the amplitude Vmax.

The measuring unit 58 may determine whether or not a first discharge abnormality occurs, by using only one of the phase difference NTF and the amplitude Vmax instead of the configuration in which both the phase difference NTF and the amplitude Vmax are measured and used for determining the occurrence of the first discharge abnormality. For example, in a case where only the amplitude Vmax among the phase difference NTF and the amplitude Vmax is employed, the holding time variable amount Δt is set to a value in the range of $-0.2\leq\Delta t\leq 2.0$, that is, a value in the range of $-0.04\cdot Tho\leq\Delta t\leq 0.04\cdot Tho$. For example, in a case where only the phase difference NTF among the phase difference NTF and the amplitude Vmax is employed, the holding time variable amount Δt is set to a value in the range of $-0.4\leq\Delta t\leq 0$, that is, a value in the range of $-0.08\cdot Tho\leq\Delta t\leq 0$. In the cases, preferably, the first holding time Th is set to be different from the second holding time Tho, and the holding time Th is adjusted to time proper for the paper dust checking.

Next, the action of the printer 11 will be described.

The controller 60 of the printer 11 performs discharge abnormality detection in a predetermined checking time before printing start, in the middle of printing, after the printing ends, and in the middle of not printing. In printing, the drive signal Vin generated by selecting the drive waveform signals Com-A and Com-B is applied to the piezoelectric element 200, and thus an image and the like is formed on recording paper P by droplets discharged from the nozzles N. In discharge abnormality detection, the drive signal Vin generated by selecting the drive waveform signal Com-C is supplied to the piezoelectric element 200, and thus whether or not a discharge abnormality occurs in the nozzle N is checked. At this time, before the time enters into the detection period Td, the switching unit 53 performs switching to the first connection state, and the drive signal VinA generated by the drive signal generation unit 51 is output to the discharging portion D.

The clock signal CL, the printing signal SI, the latch signal LAT, the change signal CH, and the drive waveform signal Com (Com-A, Com-B, and Com-C) are supplied from the controller 60 to the drive signal generation unit 51. At this time, the printing signal SI has a value for discharge abnormality detection, and specifically has a value of (b1, b2, b3)=(0, 0, 1). The drive signal generation unit 51 generates the drive signal Vin including the unit waveform PT for paper dust checking illustrated in FIG. 17. In the embodiment, the drive signal generation unit 51 generates the first drive signal VinA including the unit waveform PT illustrated in FIG. 18. The first drive signal VinA may be replaced with one of the first drive signals VinA illustrated in FIGS. 19 to 21.

The potential difference between the second potential V2 and the third potential V3 in the first drive signal VinA illustrated in FIGS. 18 to 21 is greater than the potential difference between the second potential Va12 and the third potential V3 in the second drive signal VinB at other discharge times. That is, |V2−V3|>|Va12−V3| is satisfied. The second potential V2 in the first drive signal VinA illustrated in FIGS. 18 and 19 is set to be different from the second potential Va12 in the second drive signal VinB in order to satisfy the above condition. Therefore, the potential difference between the intermediate potential Vc and the second potential V2 in the first drive signal VinA illustrated in FIGS. 18 and 19 is greater than the potential difference between the intermediate potential Vc and the second potential Va12 in the second drive signal VinB at other discharge times. That is, |V2−Vc|>|Va12−Vc| is satisfied. In the first drive signal VinA illustrated in FIG. 18, the first potential V1 and the third potential V3 are equal to the intermediate potential Vc. In the first drive signal VinA illustrated in FIG. 19, the first potential V1 and the third potential V3 are potentials between the intermediate potential Vc and the second potential V2. In both the first drive signal VinA illustrated in FIG. 18 and the first drive signal VinA illustrated in FIG. 19, the second potentials V2 are potentials which cause the second potential Va12 of the second drive signal VinB to be interposed therebetween and are on the opposite side of the first potential V1, the third potential, and the intermediate potential Vc.

The third potential V3 in the first drive signal VinA illustrated in FIGS. 20 and 21 is set to be different from the third potential Vc in the second drive signal VinB in order to satisfy the above condition of |V2−V3|>|Va12−V3|. Therefore, the potential difference between the second potential V2 and the third potential V3 in the first drive signal VinA illustrated in FIGS. 20 and 21 is greater than the potential difference between the second potential Va12 and the third potential Vc in the second drive signal VinB. That is, |V2−V3|>|Va12−Vc| is satisfied. In the first drive signal VinA illustrated in FIG. 20, the first potential V1 and the third potential V3 are potentials between the fourth potential V4 and the intermediate potential Vc. The first potential V1 is equal to the third potential V3. In the first drive signal VinA illustrated in FIG. 21, the first potential V1 is equal to the intermediate potential Vc, and the third potential V3 is a potential between the fourth potential V4 and the intermediate potential Vc.

In the first drive signal VinA illustrated in FIGS. 18 and 19, the second potential is set to be different from that of the second drive signal VinB. In addition, the third potential may also be set to be different from that of the second drive signal VinB. In the first drive signal VinA illustrated in FIGS. 20 and 21, the third potential is set to be different from that of the second drive signal VinB. In addition, the second potential may also be set to be different from that of the second drive signal VinB.

In the discharge abnormality detection, the first drive signal VinA illustrated in FIG. 18 is supplied to the piezoelectric element 200, and thus Pull-Push-Pull driving is performed. Here, the first drive signal VinA transitions from the first potential V1 to the second potential V2, and then transitions from the second potential V2 to the third potential V3. The transition from the first potential V1 to the second potential V2 is performed via the fourth potential V4. The first potential V1 is a potential between the fourth potential and the second potential V2. The third potential V3 is a potential between the fourth potential and the second potential V2. That is, the fourth potential V4 is a potential causing the first potential V1 to be interposed between the fourth potential V4 and the second potential V2. The fourth potential V4 is a potential causing the third potential V3 between the fourth potential V4 and the second potential V2. The above-described points are similar even though the first drive signal VinA illustrated in FIGS. 19 to 21 is supplied to the piezoelectric element 200.

The potential supplied to the piezoelectric element 200 transitions from the first potential V1 to the fourth potential V4 of the first drive signal VinA, and the piezoelectric element 200 is subjected to Pull driving in the process of the potential transitioning. Then, the potential supplied to the piezoelectric element 200 transitions from the fourth potential V4 to the second potential V2, and the piezoelectric element 200 is subjected to Push driving in the process of the potential transitioning. The potential supplied to the piezoelectric element 200 transitions from the second potential V2 to the third potential V3, and the piezoelectric element 200 is subjected to Pull driving in the process of the potential transitioning.

Since the first drive signal VinA for Pull-Push-Pull driving is supplied to the piezoelectric element 200, as illustrated in FIG. 25, the pressure in the liquid Liq in the cavity 264 in Pull-Push-Pull driving changes, and thus droplets are discharged from the nozzle N.

In the normal time, as illustrated in FIG. 26, the liquid level in the cavity 264 in Push driving after the first Pull driving is excited, and thus the liquid Liq in the nozzle N is pushed out to the opening side of the nozzle N. In this process, the diaphragm 265 is drawn to the liquid Liq by being bent to the drawing side by the first Pull driving. Then, the diaphragm 265 is largely bent to the pushing side by Push driving, and thus the liquid Liq in the cavity 264 is pushed to the opening side of the nozzle N at once. Then, the liquid Liq in the cavity 264 is damped with the drawing force by Pull driving illustrated in FIG. 28. Thus, the liquid Liq in the nozzle N is cut out, and the cut-out liquid is discharged from the nozzle N as a droplet. At this time, regarding a pushing force in Push driving, the potential difference between the fourth potential V4 and the second potential V2 is greater than the potential difference between the fourth potential Vall and the second potential Va12 of the second drive signal VinB at other discharge times. Thus, an excitation force larger than that at other discharge times is applied. The potential difference between the second potential V2 and the third potential V3 (=Vc) in Pull driving is also greater than the potential difference between the second potential Va12 and the third potential Vc of the second drive signal VinB at other discharge times. Thus, a damping force larger than that at other discharge times is obtained. Therefore, the liquid Liq moving in the nozzle N in the discharge direction by being largely excited at the time of Push driving is damped with a large force at the time of Pull driving, and thus the liquid Liq in the cavity 264 is cut out at the position on the back side near to the cavity 264 in the nozzle N. The liquid level position in the nozzle N just after the discharge of the droplet is drawn to the cavity 264 side by the drawing force at the time of Pull driving. As a result, the position of the meniscus Mnc just after Pull driving ends is positioned on the back side of the nozzle N, as illustrated in FIG. 28.

When the paper dust Pe adheres, as illustrated in FIG. 27, the liquid Liq in the nozzle N in Push driving after the first Pull driving is pushed out to the opening side of the nozzle N. In this process, the diaphragm 265 is drawn to the liquid Liq by being bent to the drawing side by the first Pull driving. Then, the diaphragm 265 is largely bent to the pushing side by Push driving, and thus the liquid Liq in the cavity 264 is pushed to the opening side of the nozzle N at once. In this process, the liquid Liq in the nozzle N pushed to the opening side comes into contact with the paper dust Pe adhering to the head surface 261, and a portion of the liquid Liq is leaked out to the paper dust Pe side by the capillary force. Before the discharge abnormality detection processing, the liquid Liq may be leaked out to the paper dust Pe when a droplet is discharged in the process of printing. Then, if the liquid Liq in the cavity 264 is damped with the large drawing force by Pull driving illustrated in FIG. 29, the liquid Liq in the nozzle N is cut out, and the cut-out liquid is discharged from the nozzle N as a droplet. Since, for example, the capillary force attracting the liquid Liq to the paper dust Pe or a resistance force of the paper dust Pe acts on the liquid Liq in the process of being discharged, the liquid is cut out at a position in the nozzle N, which is different from that in the normal time, or the liquid level position after cutting receives an influence of the capillary force, the resistance force, or the like. That is, this is different from the normal time. In the example illustrated in FIG. 29, the liquid level position just after Pull driving ends is positioned on the opening side of the nozzle N in comparison to that in the normal time indicated by the broken line in FIG. 29.

As described above, the excitation force for pushing the liquid Liq at the time of Push driving is set to be larger than those at other discharge times. In addition, the large damping force is applied to the liquid Liq by Pull driving at a timing at which the liquid Liq in the nozzle N is cut out when a droplet is discharged. Thus, the liquid level position in the nozzle N is largely different between the normal time and the paper dust adhering time. Thus, the difference ΔLpull between the position of the meniscus Mnc in the normal time indicated by the broken line in FIG. 29 and the liquid level position in the nozzle N in the paper dust adhering time is larger than the difference ΔLpush of the liquid level position obtained in discharge abnormality detection processing of the Push driving type.

After the discharge, the diaphragm 265 performs a residual vibration. If Pull-Push-Pull driving ends, the switching unit 53 performs switching from the first connection state to the second connection state. As a result, the residual vibration signal Vout from each of the discharging portions D is input to the discharge abnormality detection unit 52.

The residual vibration signal Vout input to the discharge abnormality detection unit 52 is input to each of the discharge abnormality detection circuits DT which respectively correspond to the discharging portions D. The waveform shaping unit 57 in the detection unit 55 constituting the discharge abnormality detection circuit DT removes noise from the residual vibration signal Vout, and the resultant is input to the measuring unit 58 as the shaped waveform signal Vd. The period measuring unit 581 measures the period of the residual vibration signal Vout by using the shaped waveform signal Vd. The phase-difference measuring unit 582 measures the elapsed time from when the detection period Td starts until the shaped waveform signal Vd after the mask period ends is greater than the threshold potential Vth_c for the first time, by using the counter (not illustrated), so as to measure the phase time TF of the residual vibration signal Vout. The phase-difference measuring unit 582 acquires the phase difference NTF by calculating the difference between the measured phase time TF of the residual vibration signal Vout and the phase time TFo in the normal time, which is stored in the storage unit 62. The amplitude measuring unit 583 measures the amplitude Vmax of the residual vibration signal Vout by using the shaped waveform signal Vd. The detection unit 55 outputs the validity flag Flag, the period NTc, the phase difference NTF, and the amplitude Vmax to the determination unit 56.

The determination unit 56 receives inputs of the validity flag Flag, the period NTc, the phase difference NTF, and the amplitude Vmax from the detection unit 55. In a case where the validity flag Flag is set to "1" which is a value indicating that the measurement value is valid, the determination unit 56 determines whether or not the discharge abnormality occurs, that is, determines whether or not an abnormal nozzle in which it is not possible to normally discharge a droplet is provided, based on the period NTc, the phase difference NTF, and the amplitude Vmax. The determination unit 56 determines the cause in a case where the abnormal nozzle is provided. In a case where at least paper dust checking is set as a target, the determination unit 56 determines whether or not the discharge abnormality occurs, based on the phase difference NTF and the amplitude Vmax in addition to the period NTc. Even though a determination result indicating being normal is obtained based on the period NTc, the determination unit 56 determines that the first discharge abnormality caused by paper dust occurs, if a determination result indicating paper dust abnormality is obtained from a comparison between the phase difference NTF and the phase difference threshold is obtained, or a determination result indicating paper dust abnormality is obtained from a comparison between the amplitude Vmax and the amplitude threshold is obtained.

Here, in the first checking method, the first checking of checking the occurrence of the first discharge abnormality caused by foreign substances such as paper dust Pe and the second checking of checking the occurrence of the second discharge abnormality caused by the cause other than the foreign substance are performed by commonly using the first drive signal VinA in the discharge mode. In this case, the second drive signal VinB having the same discharge mode as that when printing is performed on the recording paper P is used. In the second checking method, the first checking of checking the occurrence of the first discharge abnormality caused by foreign substances such as paper dust Pe is performed by using the residual vibration occurring after the droplet has been discharged, based on the first drive signal VinA in the discharge mode. The second checking of checking the occurrence of the second discharge abnormality caused by the cause other than the foreign substance is performed by using the residual vibration occurring after the droplet has been discharged, based on the second drive signal VinB in the discharge mode. In the cases, the second checking method is performed in the third form in which discharge abnormality detection processing is assigned to all the M discharging portions D. In a case of the discharge mode, in any of the first checking method and the second checking method, it is not possible to perform the discharge abnormality checking in the process of printing. Therefore, the discharge abnormality checking is performed by discharging droplets from the nozzle N to the waste liquid receiving portion in a not-printing period, for example, a flushing time or time before and after printing.

In a case where the discharge abnormality checking is performed in the process of printing, the checking is performed in the non-discharge mode in which droplets are not discharged from the nozzle N. In this case, if the first drive signal VinA for generating a fine vibration (not illustrated) for checking is supplied to the piezoelectric element 200, discharge abnormality detection processing is performed in the first form in which printing processing is assigned to some of the M discharging portions D, and discharge abnormality detection processing is assigned to others. In the first drive signal VinA in the non-discharge mode, the second potential V2 has a potential having a magnitude such that it is not possible to discharge droplets from the nozzle N. In the non-discharge mode, the first checking method and the second checking method are also provided. In the first checking method, the first checking and the second checking are performed with the common first drive signal VinA in the non-discharge mode. In the second checking method, the first checking is performed with the first drive signal VinA in the non-discharge mode, and the second checking is performed with the second drive signal VinB in the non-discharge mode. The discharge abnormality checking in the non-discharge mode may also be performed in the not-printing period in which the printing operation is not performed.

In a case where the discharge abnormality is detected, the controller 60 arranges the head portion 30 and the recovery mechanism 70 at positions facing each other and performs recovery processing on each of the discharging portions D of the head portion 30. As the recovery processing, cleaning in which the liquid is forcibly removed from the nozzle N is performed. As the recovery processing, weak recovery processing including flushing in which droplets are discharged from the nozzle N to the waste liquid receiving portion of the recovery mechanism 70, or flushing and the subsequent wiping of the head surface 261 by a wiping member such as a wiper may be performed. In a case where the weak recovery processing is performed, if the discharge abnormality checking is performed after the recovery processing ends, but the discharge abnormality is not solved, cleaning may be performed.

Hitherto, according to the embodiment described in detail, it is possible to obtain effects as follows.

(1) The printer 11 includes the nozzle N that discharges liquid by driving the piezoelectric element 200, the drive signal generation unit 51 that generates the drive signal Vin for driving the piezoelectric element 200, and the discharge abnormality detection unit 52 that detects the change of the electromotive force of the piezoelectric element 200, which is caused by the residual vibration in the cavity 264 communicating with the nozzle N after the drive signal Vin is supplied. The drive signal generation unit 51 generates the first drive signal VinA for checking whether or not the first discharge abnormality caused by foreign substances adhering to the head surface 261 on which the nozzle N opens occurs and the second drive signal VinB for checking whether or not the second discharge abnormality caused by the cause other than the foreign substances occurs. The potential change for detecting the first drive signal VinA is greater than the potential change for detecting the second drive signal VinB. Thus, the amplitude of the liquid in the nozzle N by the residual vibration in the cavity 264 when the first drive signal VinA is supplied to the piezoelectric element 200 is greater than the amplitude of the liquid in the nozzle N by the residual vibration in the cavity 264 when the second drive signal VinB is supplied to the piezoelectric element 200. Accordingly, the abnormal time being in the state where the foreign substance adhering to the head surface 261 on which the nozzle N opens has been in contact with the liquid in the nozzle N, and the normal time in which the foreign substance is not provided have a significant difference in the liquid level position in the nozzle N in the residual vibration period. The significant difference in the liquid level position is shown as a significant difference of the change of the residual vibration. Thus, the discharge abnormality detection unit 52 detects the difference of the change of the residual vibration, and thereby it is possible to check whether or not the first discharge abnormality caused by adhering of the foreign substance occurs, with high accuracy.

(2) The first drive signal VinA and the second drive signal VinB have the same mode for defining discharge or non-discharge. When checking is performed by discharging liquid in order to secure high check accuracy, both the first drive signal VinA and the second drive signal VinB are in the discharge mode in which the potential change allowing discharging of the liquid is provided. When checking is performed in a non-discharge state in which liquid is not discharged, for example, in order to save the consumption of the liquid or because of being in the process of printing, both the first drive signal VinA and the second drive signal VinB are in the non-discharge mode in which the potential change which does not cause discharge of the liquid is provided. It is possible to perform checking (first checking) of whether or not the first discharge abnormality caused by adhering of the foreign substance occurs and checking (second checking) of whether or not the second discharge abnormality caused by the cause other than the foreign substance occurs, with high accuracy even in a case where any type of checking of discharge and non-discharge is performed depending on the situation or needs at time of checking.

(3) The first drive signal VinA and the second drive signal VinB have the first potential V1 in the first period T1, have the second potential V2 in the second period T2, and have the third potential V3 in the third period T3. The first drive signal VinA and the second drive signal VinB transition from the first potential V1 to the second potential V2 and transitions from the second potential V2 to the third potential V3. Thus, the first drive signal VinA and the second drive signal VinB perform a transition in order of the first potential V1, the second potential V2, and the third potential V3. At least one of the potential difference in the process of transitioning from the first potential V1 to the second potential V2 and the potential difference in the process of transitioning from the second potential V2 to the third potential V3 in the first drive signal VinA is greater than that in the second drive signal VinB. Accordingly, it is possible to check whether or not the first discharge abnormality caused by adhering of the foreign substance occurs, with high accuracy.

(4) The potential difference between the second potential V2 and the third potential V3 in the first drive signal VinA is greater than the potential difference between the second potential Va12 and the third potential Vc in the second drive signal VinB. Thus, in checking the occurrence of the discharge abnormality, when the first drive signal VinA supplied to the piezoelectric element 200 transitions from the second potential V2 from the third potential V3, the force causing the liquid in the cavity 264 to be drawn toward the opposite side of the discharge direction at time of the transition from the first potential V1 to the second potential V2 is set to be larger than that when the second drive signal VinB transitions from the second potential V2 to the third potential Vc. As a result, the amplitude of the liquid level in the nozzle N, which performs displacement by the residual vibration increases. If a state where the liquid in the nozzle N is in contact with the paper dust Pe adhering to the head surface 261 occurs, the liquid in contact with the paper dust Pe is influenced by the capillary force and the like. Thus, the liquid level position in the nozzle N in the residual vibration period after the liquid in the cavity 264 has been drawn has a significant difference between the abnormal time and the normal time. The significant difference in the liquid level position is shown as the significant difference of the change of the residual vibration. Therefore, the discharge abnormality detection unit 52 detects the significant difference of the change of the residual vibration, and thereby it is possible to check whether or not the first discharge abnormality caused by adhering of the paper dust Pe occurs, with high accuracy. That is, it is possible to also check the occurrence of the first discharge abnormality caused by the paper dust Pe which has a floating portion in a state of being positioned to be spaced from the opening of the nozzle N in the discharge direction and has adhered to the head surface 261, with high accuracy.

(5) The potential difference between the first potential V1 and the second potential V2 in the first drive signal VinA is greater than the potential difference between the first potential Vc and the second potential Va12 in the second drive signal VinB. Therefore, in a case where the first drive signal VinA is supplied to the piezoelectric element 200, it is possible to strongly excite the liquid in the cavity 264 in the discharge direction by the piezoelectric element 200 when the signal transitions from the first potential V1 to the second potential V2, in comparison to that in a case where the second drive signal VinB is supplied to the piezoelectric element 200. Thus, it is possible to increase the amplitude of the liquid level in the nozzle N, which performs displacement by the residual vibration in checking. For example, when the mode is the discharge mode in which the liquid is discharged, in the normal time, a large droplet is discharged or the liquid level in the nozzle N has a large amplitude, by large excitation or large damping applied to the liquid in the cavity 264. Thus, the liquid level position in the nozzle N just after the discharge is positioned on a side which is relatively close to the cavity 264. When the paper dust Pe adheres, the liquid in the nozzle N after the liquid has been discharged is in a state of being in contact with the paper dust Pe. Thus, the liquid in the nozzle N is influenced by the capillary force and the like. The liquid level position in the nozzle N just after the discharge is different from that in the normal time. When the mode is the non-discharge mode in which the liquid is not discharged, a portion of the liquid protrudes from the opening of the nozzle N at time of the previous discharge of the liquid or at time of the checking. Thus, the liquid in the nozzle N is in a state of being in contact with the paper dust Pe. Thus, even in the non-discharge mode, the liquid in the nozzle N is influenced by the capillary force and the like, and thus the liquid level position in the nozzle N in the residual vibration period is different from that in the normal time. As described above, the significant difference in the liquid level position in the nozzle N is provided between the abnormal time in which the foreign substance has adhered and the normal time. Since the significant difference is shown as the significant difference of the change of the residual vibration, the discharge abnormality detection unit 52 detects the significant difference of the change of the residual vibration, and thereby it is possible to improve check accuracy when whether or not the first discharge abnormality caused by adhering of the paper dust Pe occurs is checked.

(6) In the normal time having no discharge abnormality, the amplitude of the liquid level in the nozzle N when the first drive signal VinA is supplied to the piezoelectric element 200 is larger than the amplitude of the liquid level in the nozzle N when the second drive signal VinB is supplied to the piezoelectric element 200. Thus, when the liquid is in the state of being contact with the paper dust Pe, the liquid level position in the nozzle N is different from that in the normal time, and the significant difference in the liquid level position is provided in comparison to the normal time. The significant difference in the liquid level position is shown as the significant difference of the change of the residual vibration. The discharge abnormality detection unit 52 detects the significant difference of the change of the residual vibration, and thereby it is possible to check whether or not the first discharge abnormality caused by adhering of the paper dust Pe occurs, with high accuracy. In a case of the non-discharge mode, the amplitude of the liquid level in the nozzle N when the first drive signal VinA is supplied to the piezoelectric element 200 is large. Thus, in a case where a portion of the liquid protrudes from the opening of the nozzle N by the large amplitude, the foreign substance such as paper dust Pe, which has adhered to the head surface 261 on which the nozzle N opens and the liquid easily come into contact with each other.

(7) In the first drive signal VinA, the first potential V1 is equal to the third potential V3. Thus, the next operation can be simply started without changing the potential after the residual vibration is attenuated, that is, after the checking ends. For example, if the first potential V1 is different from the third potential V3, the change of pressure of the liquid in the cavity 264 is caused by the change of the potential after the checking ends, and this may influence the next discharge of the liquid. However, since the first potential V1 and the third potential V3 in the first drive signal VinA are equal to each other, there is no concern of this type.

(8) In the first drive signal VinA, the first potential V1 is a potential between the second potential v2 and the third potential V3. Thus, since the second potential V2 and the third potential V3 are set to interpose the first potential V1, it is possible to create a residual vibration having a large amplitude, and to check whether or not the first discharge abnormality having a concern that it is not possible to normally discharge liquid because of adhering of the paper dust Pe occurs, with high accuracy.

(9) The first drive signal VinA transitions from the first potential V1 to the second potential V2 via the fourth potential V4. The first potential V1 is a potential between the second potential V2 and the fourth potential V4. Thus, since the first drive signal VinA transitions from the first potential V1 to the fourth potential V4, the piezoelectric element 200 deforms in the pull direction on the opposite side of the direction of pushing in the discharge direction, and then can largely deform in the direction of pushing in the discharge direction. Thus, it is possible to largely excite the liquid in the cavity 264 by the large deformation of the piezoelectric element 200 in the direction of pushing the piezoelectric element. As a result, it is possible to increase the amplitude of the liquid level in the nozzle N. The significant difference in the liquid level position in the nozzle N in the residual vibration period is provided between the abnormal time in which the paper dust Pe has adhered and the normal time in which the paper dust Pe does not adhere. The significant difference in the liquid level position is shown as the significant difference of the change of the residual vibration. The discharge abnormality detection unit 52 detects the significant difference of the change of the residual vibration, and thereby it is possible to check whether or not the first discharge abnormality caused by adhering of the paper dust Pe occurs, with high accuracy.

(10) The first holding time Th at which the first drive signal VinA is held to the second potential V2 is different from the second holding time Tho at which the second drive signal VinB is held to the second potential V2. Thus, it is possible to set the first holding time Th to an appropriate time which is different from the second holding time Tho. Accordingly, it is possible to increase the difference of the change of the residual vibration between the paper dust adhering time and the normal time. Thus, the discharge abnormality detection unit 52 detects the difference of change of the residual vibration, and thereby it is possible to improve check accuracy for checking whether or not the first discharge abnormality caused by adhering of the paper dust Pe occurs, with high accuracy.

(11) When the first drive signal VinA has been supplied, the discharge abnormality detection unit 52 detects the amplitude Vmax of the residual vibration based on the electromotive force of the piezoelectric element 200, and performs checking based on the amplitude Vmax. The significant difference in the liquid level position in the nozzle N in the residual vibration period is provided between the abnormal time in which the paper dust Pe adheres and the normal time, and the significant difference of the liquid level position is shown as the significant difference of the amplitude Vmax of the residual vibration. Therefore, the discharge abnormality detection unit 52 performs checking based on the amplitude Vmax, and thereby it is possible to check whether or not the first discharge abnormality caused by adhering of the paper dust Pe occurs, with high accuracy.

(12) When the first drive signal VinA has been supplied, the discharge abnormality detection unit 52 detects the phase of the residual vibration based on the electromotive force of the piezoelectric element 200, and checks whether or not the first discharge abnormality occurs, based on the phase. The significant difference in the liquid level position in the nozzle N is provided between the abnormal time in which the paper dust Pe adheres and the normal time, and the significant difference of the liquid level position is shown as the significant difference of the phase of the residual vibration. Therefore, the discharge abnormality detection unit 52 performs checking based on the phase, and thereby it is possible to check whether or not the first discharge abnormality caused by adhering of the paper dust Pe occurs, with high accuracy. Specifically, the discharge abnormality detection unit 52 measures the phase time TF indicating the phase of the residual vibration, based on the change of the electromotive force of the piezoelectric element 200, and performs checking by comparing the phase time TF to the phase time TFo indicating the phase of the residual vibration in the normal time. That is, the discharge abnormality detection unit 52 compares the phase time TF to the threshold (TFo-NTFo). If the phase time TF is smaller than the threshold (TFo-NTFo), that is, if the phase difference NTF indicated by the difference between the phase time TF and the phase time TFo in the normal time is greater than the phase difference threshold NTFo, the determination unit determines that the first discharge abnormality by adhering of the paper dust has occurred.

(13) The first drive signal VinA is supplied to the piezoelectric element 200 when first checking of checking whether or not the first discharge abnormality caused by paper dust Pe adhering to the head surface 261 on which the nozzle N opens occurs and the second checking of checking whether or not the second discharge abnormality caused by the cause other than the paper dust Pe occurs are performed together. The second drive signal VinB is supplied to the piezoelectric element 200 in the process of the printing operation performed by discharging the liquid from the nozzle N onto the recording paper P. Regarding the first drive signal VinA supplied to the piezoelectric element 200 when the first checking and the second checking are performed together, the potential difference between the second potential and the third potential is greater than that in the second drive signal VinB supplied to the piezoelectric element 200 in the process of the printing operation performed by discharging the liquid onto the recording paper P (medium) ($|V2-V3|>|Va12-Vc|$). Thus, it is possible to improve check accuracy of the first checking in which it is checked whether or not the first discharge abnormality caused by the paper dust Pe occurs. In addition, since the first checking and the second checking are performed by detecting the common residual vibration, it is possible to reduce time required for discharge abnormality checking. In checking in the discharge mode, it is possible to reduce the consumed amount of the liquid at the time of the discharge abnormality checking.

(14) The mode is the discharge mode in which the liquid is discharged from the nozzle N. Thus, in a case where the paper dust Pe adheres to the head surface 261 on which the nozzle N opens, the liquid discharged from the nozzle N comes into contact with the paper dust Pe. Thus, the significant difference in the liquid level position in the nozzle N just after discharge is provided in comparison to the normal time. The difference in the liquid level position is shown as the difference of the change of the residual vibration. Thus, the discharge abnormality detection unit 52 detects the difference of the change of the residual vibration, and thereby it is possible to improve check accuracy for the occurrence of the discharge abnormality caused by adhering of the paper dust Pe. With the checking in the discharge mode, it is possible to increase an amplitude of the liquid level in the nozzle N by a residual vibration, and to improve check accuracy.

(15) The mode is the non-discharge mode in which the liquid is not discharged from the nozzle N. Thus, in a case where the paper dust Pe adheres to the head surface 261 on which the nozzle N opens, the liquid remaining in previous discharging comes into contact with the paper dust Pe, or the liquid which temporarily protrudes from the opening of the nozzle N comes into contact with the paper dust Pe. Thus, the liquid in the nozzle N comes into contact with the paper dust Pe. Therefore, even in the non-discharge mode, when the foreign substance adheres, the force attracting the liquid in the nozzle N to paper dust Pe by the capillary force and the like acts. Thus, the significant difference in the liquid level position in the nozzle N is provided by the residual vibration, in comparison to the normal time. Since the significant difference in the liquid level position is shown as the significant difference of the change of the residual vibration, the discharge abnormality detection unit 52 detects the significant difference of the change of the residual vibration, and thereby it is possible to improve check accuracy of a discharge abnormality caused by adhering of the paper dust Pe. With checking in the non-discharge mode, it is possible to check the occurrence of a discharge abnormality in the process of the printing operation. Because of the checking in the non-discharge mode, checking the occurrence of the discharge abnormality is completed without consuming the liquid.

The embodiment may change like a modification example as follows. The components provided in the embodiment and components provided in the following modification example may be randomly combined, and the components provided in the following modification example may be randomly combined.

Figure 38:
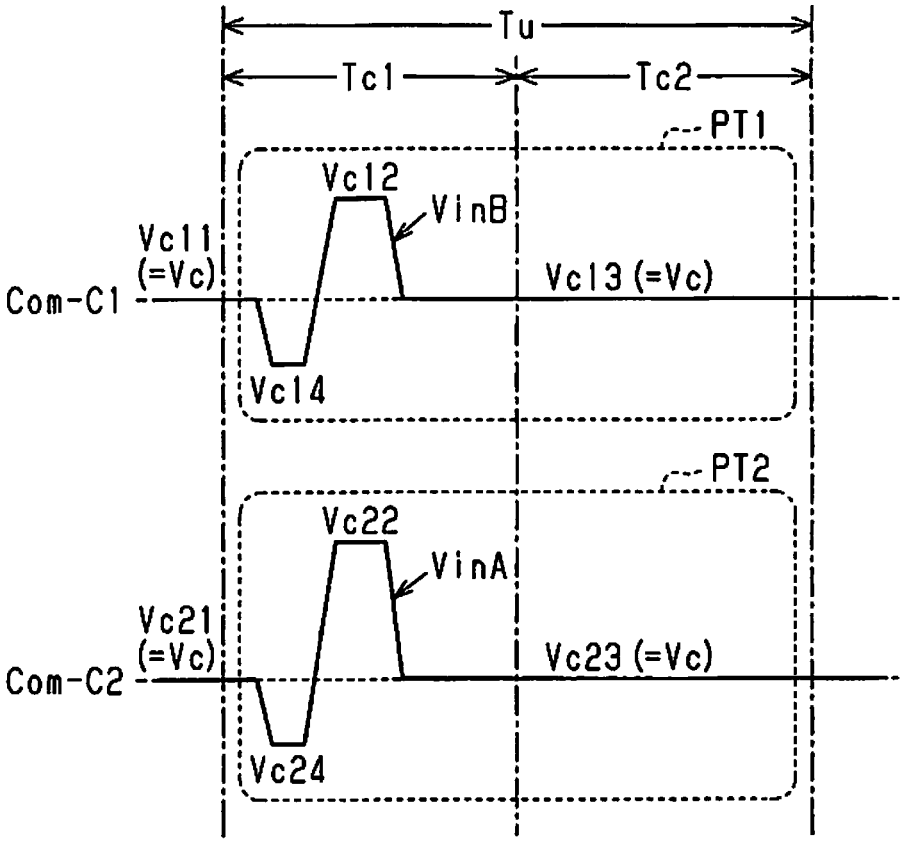
FIG. 38 is a timing chart illustrating a drive waveform signal for checking in a modification example.

As illustrated in FIG. 38, the drive waveform signal Com-C for the discharge abnormality detection in the drive waveform signal Com illustrated in FIG. 16 may be replaced with two kinds of the drive waveform signal Com-C1 for paper dust detection and the drive waveform signal Com-C2 for another discharge abnormality detection. The controller 60 generates the drive waveform signals Com-A, Com-B, Com-C1, and Com-C2. The drive waveform signal Com-C1 has a waveform including the unit waveform PT1 for checking. The drive waveform signal Com-C2 has a waveform including the unit waveform PT2 for the checking. The drive signal generation unit 51 selects one of the drive waveform signals Com-C1 and Com-C2 in accordance with the printing signal SI and generates the first drive signal VinA or the second drive signal VinB. That is, when checking the occurrence of the first discharge abnormality caused by the paper dust, the drive signal generation unit 51 selects the drive waveform signal Com-C1 and generates the first drive signal VinA. When checking the occurrence of the second discharge abnormality caused by the cause other than the paper dust, the drive signal generation unit 51 selects the drive waveform signal Com-C2 and generates the second drive signal VinB. The potential difference |Vc22–Vc24| between the second potential Vc22 and the fourth potential Vc24 in the first drive signal VinA is greater than the potential difference |Vc12–Vc14| between the second potential Vc12 and the fourth potential Vc14 in the second drive signal VinB. The potential difference |Vc22–Vc23| between the second potential Vc22 and the third potential Vc23 in the first drive signal VinA is greater than the potential difference |Vc12–Vc13| between the second potential Vc12 and the third potential Vc13 in the second drive signal VinB. That is, the potential difference of the first drive signal VinA at the time of Push driving is greater than the potential difference of the second drive signal VinB at the time of Push driving. The potential difference of the first drive signal VinA at the time of Pull driving is greater than the potential difference of the second drive signal VinB at the time of Pull driving. Therefore, checking of the occurrence of the first discharge abnormality and the second discharge abnormality having the different causes is performed by separately discharging droplets, and thus it is possible to further improve check accuracy for the discharge abnormality checking. Thus, it is possible to reduce the omission of detecting the first discharge abnormality in which the paper dust Pe in the floating state adheres. In FIG. 38, the drive waveform signal Com-C1 and the second drive signal VinB generated based on the drive waveform signal Com-C1 have the same waveform. The drive waveform signal Com-C2 and the first drive signal VinA generated based on the drive waveform signal Com-C2 have the same waveform. Thus, the drive waveform signals Com-C1 and Com-C2 are denoted by the reference signs VinB and VinA, respectively.

Figure 39:
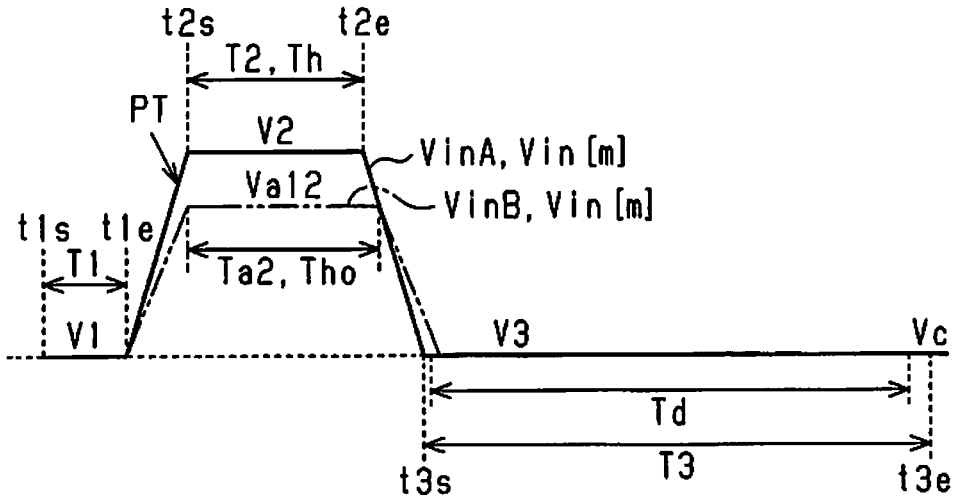
FIG. 39 is a timing chart illustrating the first drive signal in a modification example different from that in FIG. 38.

As illustrated in FIG. 39, the first drive signal VinA may be a signal having no fourth potential V4. That is, Push-Pull driving without the first Pull driving may be provided instead of Pull-Push-Pull driving in the embodiment. In the example illustrated in FIG. 39, the first potential V1 is equal to the third potential V3. The excitation force in Push driving is reduced as much as the first Pull driving is not provided. However, the potential difference between the first potential V1 and the second potential V2 is set to be greater than the potential difference between the fifth potential Vc and the second potential Va12 in the second drive signal VinB. In addition, the potential difference between the second potential V2 and the third potential V3 is set to be greater than the potential difference between the second potential Va12 and the third potential Vc in the second drive signal VinB.

Figure 40:
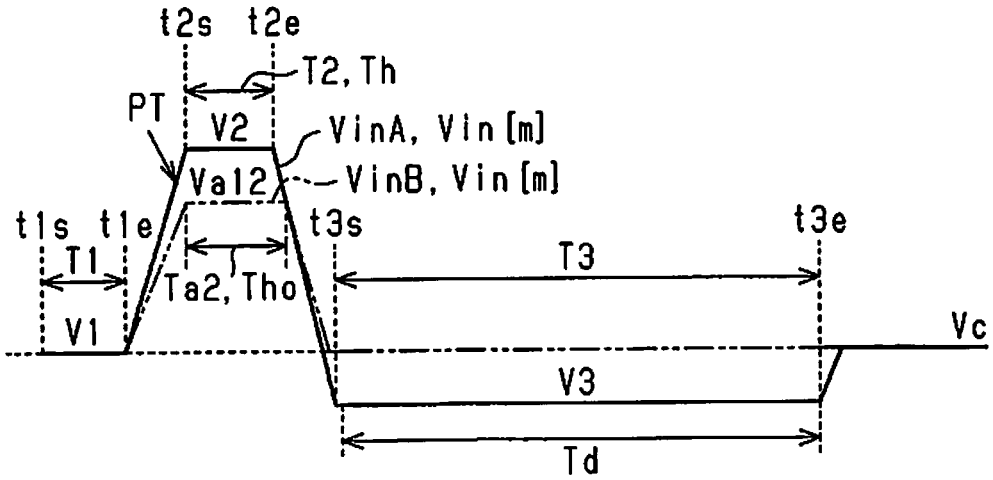
FIG. 40 is a timing chart illustrating the first drive signal in a modification example different from that in FIG. 39.

As illustrated in FIG. 40, the first drive signal VinA may be a drive signal having no fourth potential V4. The first potential V1 in the first drive signal VinA illustrated in FIG. 40 is a potential between the second potential V2 and the third potential V3. That is, the third potential V3 is a potential causing the first potential V1 to be interposed between the third potential V3 and the second potential V2. The third potential V3 is a potential causing the intermediate potential Vc to be interposed between the third potential V3 and the second potential V2. According to this first drive signal VinA, it is possible to set the potential difference between the first potential V1 and the second potential V2 (which is the potential difference at the time of Push driving) and the potential difference between the second potential V2 and the third potential V3 (which is the potential difference at the time of Pull driving) to be greater than those in the first drive signal VinA illustrated in FIG. 39. Therefore, it is possible to largely excite the liquid in the cavity 264 at the time of Push driving and to bring the liquid into contact with the paper dust Pe by pushing the liquid from the nozzle N. In this case, regardless of the discharge mode, even in the non-discharge mode in which the second potential V2 is a potential causing the liquid not to be discharged, a portion of the liquid can be caused to protrude from the opening of the nozzle N, and thus be brought into contact with the floating paper dust Pe. In addition, since the significant difference in the liquid level position in the nozzle N just after droplets have been discharged is provided between the normal time and the paper dust adhering time, by Pull driving, it is possible to reduce the omission of detecting the paper dust Pe.

Figure 41:
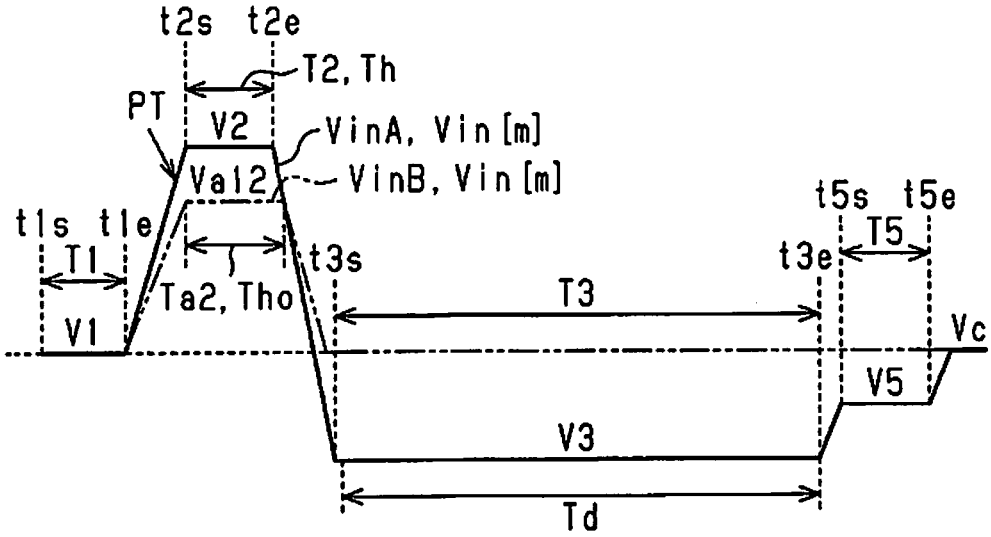
FIG. 41 is a timing chart illustrating the first drive signal in a modification example different from that in FIG. 40.

As illustrated in FIG. 41, the first drive signal VinA may transition from the third potential V3 to the first potential V1 via a fifth potential v5. The first drive signal VinA has the fifth potential V5 in a fifth period T5 from a time point t5*s* to a time point t5*e*. The first potential V1 in the first drive signal VinA is a potential between the second potential V2 and the third potential V3. The potential difference between the third potential V3 and the first potential V1 is greater than that in the examples illustrated in FIGS. 18, 19, and 39. The fifth potential V5 is a potential between the first potential V1 and the third potential V3. In the example in FIG. 41, the first potential V1 is equal to the intermediate potential Vc. Thus, the fifth potential V5 is a potential between the intermediate potential Vc and the third potential V3. According to this configuration, if the signal rapidly transitions from the third potential V3 to the first potential V1, the liquid in the cavity 264 may be strongly excited, and thus the residual vibration generated by the excitation may influence discharge of droplets in the next unit operation period Tu. In this example, the first drive signal VinA comes stepwise back from the third potential V3 to the first potential V1 (=Vc) via the fifth potential V5. Thus, the rapid potential change does not occur, and there is hardly an influence on the next discharge of the liquid. In FIGS. 18, 19, and 39, in a case where the potential difference between the third potential V3 and the first potential V1 in the first drive signal VinA is relatively large, the signal may transition from the third potential V3 to the first potential V1 via the fifth potential V5.

Figure 42:
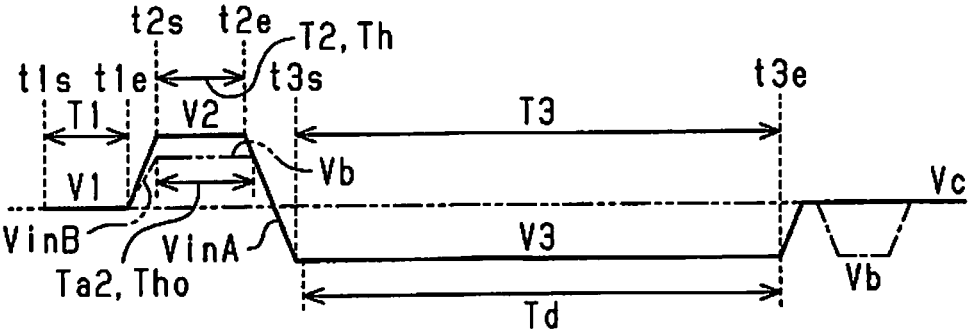
FIG. 42 is a timing chart illustrating the first drive signal in a modification example different from that in FIG. 41.

As illustrated in FIG. 42, the first drive signal VinA may be a drive signal in the non-discharge mode in which droplets are not discharged. The first drive signal VinA has a driving waveform in non-discharge. As illustrated in FIG. 42, the first drive signal VinA in the non-discharge mode has the first potential V1 in the first period T1, has the second potential V2 in the second period T2, and has the third potential V3 in the third period T3. The signal transitions from the first potential V1 to the second potential V2, and then transitions from the second potential V2 to the third potential v3. The second potential V2 is a potential at which it is not possible to discharge droplets, but is a potential at which the liquid may slightly protrude from the opening of the nozzle N. The first potential V1 is a potential between the second potential V2 and the third potential V3. That is, the third potential V3 is a potential causing the first potential V1 to be interposed between the third potential V3 and the second potential V2. In this example in which the first potential V1 is the intermediate potential Vc, the third potential V3 is also a potential causing the intermediate potential Vc to be interposed between the third potential V3 and the second potential V2. In FIG. 42, the waveform of a potential Vb (indicated by a one-dot chain line) of the first drive signal VinA in a period after the third period T3 is used for a fine vibration and is provided in the second drive signal for the non-discharge mode in printing. The liquid in the nozzle N is stirred by a fine vibration in order to prevent thickening of the liquid in the nozzle N, which is not used yet in printing. Therefore, the excitation force causing the liquid in the nozzle N to finely vibrate is weak, and the meniscus Mnc in the nozzle N is positioned on the back side rather than the opening of the nozzle. On the contrary, the second potential V2 in the first drive signal VinA does not enable the liquid to be discharged from the nozzle N. However, the second potential V2 has a magnitude which can cause the portion of the liquid to temporarily protrude from the opening of the nozzle N, in a columnar shape, and then can come back into the nozzle N. That is, the second potential V2 is a potential allowing the portion of the liquid to protrude from the opening of the nozzle N such that the liquid can come into contact with the paper dust Pe adhering in a state of slightly floating from the head surface 261. Thus, with the large potential difference corresponding to a transition from the second potential V2 to the third potential V3 at the time of Pull driving, the significant difference in the position of the meniscus Mnc when the liquid which has temporarily protruded comes back into the nozzle N again can be provided in comparison to the normal time. Thus, it is possible to reduce the detection omission of the paper dust Pe adhering in a state of floating on the head surface 261 and to detect the first discharge abnormality caused by adhering of the paper dust Pe, with high accuracy. Since the discharge abnormality checking is possible in the non-discharge mode, it is possible to detect the discharge abnormality in the process of printing. Therefore, it is possible to recognize the discharge abnormality early and to reduce the amount of printing with defects.

In the example of the non-discharge mode illustrated in FIG. 42, the first checking method and the second checking method can be employed. In FIG. 42, a signal which has the second potential Vb in the second period T2 and is indicated by a two-dot chain line is the second drive signal VinB in the non-discharge mode which is similar to the first drive signal VinA. The drive signal generation unit 51 generates the first drive signal VinA in the non-discharge mode, which is indicated by a solid line in FIG. 42 and the second drive signal VinB in the non-discharge mode, which is indicated by the two-dot chain line in FIG. 42. In the first checking method, the discharge abnormality detection unit 52 performs the first checking of checking the occurrence of the first discharge abnormality caused by the foreign substance such as the paper dust Pe and the second checking of checking the occurrence of the second discharge abnormality caused by the cause other than the foreign substance, by commonly using the residual vibration after fine vibration driving of the piezoelectric element 200 based on the first drive signal VinA in the non-discharge mode. In this case, when the liquid in the nozzle N, which is not used yet in the process of printing in which printing is performed on the recording paper P is vibrated finely, the fine vibration is performed by supplying the second drive signal VinB in the non-discharge mode to the piezoelectric element 200. In the second checking method, the discharge abnormality detection unit 52 performs the first checking by using the residual vibration after the fine vibration driving generated by supplying the first drive signal VinA in the non-discharge mode to the piezoelectric element 200. The discharge abnormality detection unit 52 performs the second checking by using the residual vibration after the fine vibration driving generated by supplying the second drive signal VinB in the non-discharge mode to the piezoelectric element 200. As illustrated in FIG. 42, the potential difference |V2−V1| between the first potential V1 and the second potential V2 in the first drive signal VinA is greater than the potential difference |Vb−Vc| between the first potential Vc and the second potential Vb in the second drive signal VinB. Therefore, the liquid can temporarily protrude from the opening of the nozzle N in a columnar shape, at the time of Push driving, and the protruding liquid can be brought into contact with the paper dust Pe adhering in a state of floating on the head surface 261. The third potential V3 of the first drive signal VinA is different from the third potential Vc of the second drive signal VinB. Thus, the potential difference |V2−V3| between the second potential V2 and the third potential V3 in the first drive signal VinA is greater than the potential difference |Vb−Vc| between the second potential Vb and the third potential Vc in the second drive signal VinB. Thus, it is possible to draw the liquid toward the cavity 264 side with a large force by Pull driving, when the liquid which has temporarily protruded from the opening of the nozzle N comes back into the nozzle N again. Therefore, even in the non-discharge mode, similar to the discharge mode illustrated in FIG. 29, the significant difference ΔLpull in the liquid level position in the nozzle N is provided between the normal time and the paper dust adhering time. Thus, the discharge abnormality detection unit 52 performs checking based on at least the amplitude Vmax or the phase difference NTF of the residual vibration, and thereby it is possible to detect the discharge abnormality with high accuracy even though the discharge abnormality caused by the floating paper dust Pe occurs.

In FIGS. 18, 19, 39 to 42, the first potential V1 may be set to a potential causing the intermediate potential Vc to be interposed between the first potential V1 and the second potential V2, and the third potential V3 may be set to a potential between the first potential V1 and the second potential V2. In FIGS. 40 to 42, the first potential V1 may be set to a potential which is equal to the third potential V3 and may transition from the first potential V1 to the second potential v2 via the fourth potential V4.

Both the second potential and the third potential may differ between the first drive signal VinA and the second drive signal VinB. That is, the second potential V2 of the first drive signal VinA is different from the second potential Va12 of the second drive signal VinB, and the third potential V3 of the first drive signal VinA is different from the third potential Vc of the second drive signal VinB. Even in a case, in a case where the first drive signal VinA and the second drive signal VinB having the same mode for defining discharge or non-discharge are compared to each other, the potential difference |V2−V3| of the first drive signal VinA may be greater than the potential difference |Va12−Vc| of the second drive signal VinB. The potential difference |V1−V21 of the first drive signal VinA is preferably larger than the potential difference |Vc−Va12| of the second drive signal VinB.

The piezoelectric element 200 may have a configuration in which the relation between the direction of a voltage to be applied and the direction in which the piezoelectric element deforms by an electrostrictive action is reverse to that in the embodiment. In this case, a waveform having a shape in which the waveform of the drive signal Vin is made to be symmetric with respect to the intermediate potential Vc. For example, in FIGS. 18 to 21 and 39 to 42, the waveforms of the first drive signal VinA and the second drive signal VinB may change to waveforms which are line-symmetrical with the level of the intermediate potential Vc as the center. Even in this case, in the same discharge form (discharge mode), the potential difference |V2−V3| of the first drive signal VinA may be greater than the potential difference |Va12−Vc| of the second drive signal VinB.

In a case where the liquid is an ink, the liquid includes various kinds of liquid compositions such as a general water-based ink, an oil-based ink, a gel ink, and a hot melt ink.

The liquid is not limited to the ink, and any kind of liquid may be provided so long as the ink can be discharged from the liquid discharging apparatus. For example, a liquid state may be provided. The liquid includes a liquid material having high or low viscosity, sol, gel water, other inorganic solvents, organic solvents, solutions, and liquid resins. The liquid also includes a liquid containing some particles of a functional material.

The medium is not limited to paper such as recording paper P, and a synthetic resin film or sheet, fabric, nonwoven fabric, a laminate sheet, a metal foil, a ceramic sheet, and the like may be provided. Further, a substrate and the like on which elements, wirings, and the like are formed by discharging liquid are also included in the medium.

The liquid discharging apparatus is not limited to the ink jet type printer 11. A liquid discharging apparatus that discharges another liquid other than the ink may be provided. For example, a liquid discharging apparatus that discharges a liquid material containing dispersed or dissolved functional materials such as electrode materials and coloring materials (pixel materials) used in manufacturing a liquid crystal display, an electroluminescence (EL) display, and a surface emitting display may be provided. A liquid discharging apparatus that discharges a bioorganic material used in manufacturing a biochip, and a liquid discharging apparatus that discharges liquid as a sample used as a precise pipette may be provided. Further, a liquid discharging apparatus that discharges a transparent resin liquid such as a thermosetting resin, onto a substrate so as to form a hemispherical optical lens or the like used for an optical communication element or the like, and a liquid discharging apparatus that discharges an etching liquid such as an acid or alkali so as to perform etching of a substrate or the like may be provided. The liquid discharging apparatus may be a 3D printer and may manufacture a three-dimensional molded product by an ink jet method.

What is claimed is:

1. A liquid discharging apparatus comprising:

a nozzle that discharges liquid by driving a piezoelectric element;

a drive signal generation unit that generates a drive signal for driving the piezoelectric element; and a residual vibration detection unit that detects a change of an electromotive force of the piezoelectric element, which is caused by residual vibration in a pressure chamber communicating with the nozzle after the drive signal is supplied, wherein the drive signal generation unit generates a first drive signal and a second drive signal, the first drive signal being for checking whether or not a first discharge abnormality caused by a foreign substance adhering to a surface on which the nozzle opens occurs, and the second drive signal being for checking whether or not a second discharge abnormality caused by a cause other than the foreign substance occurs, and a potential change for detecting the change of the electromotive force of the piezoelectric element in the first drive signal is greater than a potential change for detecting the change of the electromotive force of the piezoelectric element in the second drive signal.

2. The liquid discharging apparatus according to claim 1, wherein the first drive signal and the second drive signal have a same mode, the mode being for defining discharge or non-discharge.

3. The liquid discharging apparatus according to claim 2, wherein the mode is a discharge mode in which liquid is discharged from the nozzle.

4. The liquid discharging apparatus according to claim 2, wherein the mode is a non-discharge mode in which liquid is not discharged from the nozzle.

5. The liquid discharging apparatus according to claim 1, wherein the first drive signal and the second drive signal have a first potential in a first period, a second potential in a second period, and a third potential in a third period, and the first drive signal and the second drive signal transition from the first potential to the second potential and transition from the second potential to the third potential.

6. The liquid discharging apparatus according to claim 5, wherein a potential difference between the second potential and the third potential in the first drive signal is greater than a potential difference between the second potential and the third potential in the second drive signal.

7. The liquid discharging apparatus according to claim 6, wherein a potential difference between the first potential and the second potential in the first drive signal is greater than a potential difference between the first potential and the second potential in the second drive signal.

8. The liquid discharging apparatus according to claim 6, wherein, in a normal time in which the discharge abnormality does not occur, an amplitude of a liquid level in the nozzle when the first drive signal is supplied to the piezoelectric element is greater than an amplitude of the liquid level in the nozzle when the second drive signal is supplied to the piezoelectric element.

9. The liquid discharging apparatus according to claim 6, wherein the first potential and the third potential in the first drive signal are equal to each other.

10. The liquid discharging apparatus according to claim 6, wherein the first potential in the first drive signal is a potential between the second potential and the third potential.

11. The liquid discharging apparatus according to claim 10, wherein the first drive signal transitions from the third potential to the first potential via a fifth potential, and the fifth potential is a potential between the third potential and the first potential.

12. The liquid discharging apparatus according to claim 6, wherein the first drive signal transitions from the first potential to the second potential via a fourth potential, and the first potential is a potential between the second potential and the fourth potential.

13. The liquid discharging apparatus according to claim 6, wherein a first holding time at which the first drive signal is held to the second potential is different from a second holding time at which the second drive signal is held to the second potential.

14. The liquid discharging apparatus according to claim 1, wherein, when the first drive signal has been supplied, the residual vibration detection unit detects an amplitude of the residual vibration based on an electromotive force of the piezoelectric element and checks whether or not the first discharge abnormality occurs, based on the detected amplitude.

15. The liquid discharging apparatus according to claim 1, wherein, when the first drive signal has been supplied, the residual vibration detection unit detects a phase of the residual vibration based on an electromotive force of the piezoelectric element and checks whether or not the first discharge abnormality occurs, based on the detected phase.

* * * * *